US007693449B2

(12) United States Patent
Kaseno et al.

(10) Patent No.: US 7,693,449 B2
(45) Date of Patent: Apr. 6, 2010

(54) IMAGE FORMING APPARATUS WITH MOVEABLE IMAGE PROCESSING UNITS

(75) Inventors: Atsushi Kaseno, Kyoto (JP); Kenzoh Yoshida, Nara (JP); Fumikazu Shimanuki, Utsunomiya (JP); Kenji Shimanuki, legal representative, Natori (JP); Seiko Shimanuki, legal representative, Natori (JP); Naoki Saito, Hyogo (JP); Takaaki Kuwabara, Osaka (JP); Kanji Mizusugi, Mie (JP); Takashi Matsuda, Nara (JP); Yukio Kanaoka, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 0 days.

(21) Appl. No.: 11/723,923

(22) Filed: Mar. 22, 2007

(65) Prior Publication Data

US 2008/0031641 A1 Feb. 7, 2008

(30) Foreign Application Priority Data

| | | |
|---|---|---|
| Mar. 23, 2006 | (JP) | 2006-081368 |
| Mar. 24, 2006 | (JP) | 2006-083616 |
| Mar. 29, 2006 | (JP) | 2006-091814 |
| Oct. 20, 2006 | (JP) | 2006-286596 |
| Oct. 20, 2006 | (JP) | 2006-286613 |
| Oct. 20, 2006 | (JP) | 2006-286619 |

(51) Int. Cl.
*G03G 15/00* (2006.01)

(52) U.S. Cl. ..... 399/107; 399/9; 399/38; 399/75

(58) Field of Classification Search ..... 399/9, 399/38, 75

See application file for complete search history.

(56) References Cited

U.S. PATENT DOCUMENTS

| | | | | |
|---|---|---|---|---|
| 6,347,203 | B1 * | 2/2002 | Kutsuwada | 399/82 |
| 7,103,296 | B2 * | 9/2006 | Kiyosumi et al. | 399/82 |
| 7,231,171 | B2 * | 6/2007 | Shibata et al. | 399/367 |
| 2001/0031162 | A1 * | 10/2001 | Koshimizu et al. | 399/405 |
| 2003/0086130 | A1 * | 5/2003 | Guddanti et al. | 358/498 |
| 2003/0090715 | A1 * | 5/2003 | Yoshikawa | 358/1.15 |
| 2003/0198493 | A1 * | 10/2003 | Gomi et al. | 399/380 |
| 2004/0081479 | A1 * | 4/2004 | Kobayashi et al. | 399/80 |

FOREIGN PATENT DOCUMENTS

| | | |
|---|---|---|
| JP | 59-177759 B2 | 10/1984 |
| JP | 3-53696 | 3/1991 |
| JP | 5-9065 | 2/1993 |
| JP | 06-044444 | 2/1994 |
| JP | 7-157140 A | 6/1995 |

(Continued)

*Primary Examiner*—David M Gray
*Assistant Examiner*—Ryan D Walsh
(74) *Attorney, Agent, or Firm*—Birch, Stewart, Kolasch & Birch, LLP

(57) ABSTRACT

An image forming apparatus includes a processing unit which performs an image recording process for recording an image on a recording medium based on image data; a movement mechanism which moves the processing unit; a first control section which controls the image recording process performed by the processing unit; and a second control section which acquires a state of progress of the image recording process and controls the movement mechanism so as to move the processing unit to a position according to the progress state.

20 Claims, 63 Drawing Sheets

FOREIGN PATENT DOCUMENTS

| | | | |
|---|---|---|---|
| JP | 08106240 | | 4/1996 |
| JP | 09-110399 | A | 4/1997 |
| JP | 09110399 | | 4/1997 |
| JP | 10-269671 | B2 | 10/1998 |
| JP | 2000-39817 | A | 2/2000 |
| JP | 2000-214731 | | 8/2000 |
| JP | 2001-69283 | A | 3/2001 |
| JP | 2002142052 | A | 5/2002 |
| JP | 2005-084437 | A | 3/2005 |
| JP | 2005-180471 | A | 7/2005 |

* cited by examiner

IMAGE FORMING APPARATUS WITH MOVEABLE IMAGE PROCESSING UNITS

CROSS-REFERENCE TO RELATED APPLICATION

This application is related to Japanese patent applications No. 2006-083616 filed on Mar. 24, 2006, No. 2006-081368 filed on Mar. 23, 2006, No. 2006-091814 filed on Mar. 29, 2006, No. 2006-286596 filed on Oct. 20, 2006, No. 2006-286613 filed on Oct. 20, 2006, No. 2006-286619 filed on Oct. 20, 2006, whose priorities are claimed under 35 USC §119, the disclosures of which are incorporated by reference in their entirety.

BACKGROUND OF THE INVENTION

1. Field of the Invention

The present invention relates to an image forming apparatus such as a copier or a printer.

2. Description of the Related Art

Most image forming apparatuses are generally used at fixed positions, once having been installed directly on a floor or on a mount base disposed on the floor. Further, an operation panel, a sheet cassette section, a sheet ejection tray section, a document reading section and a toner supply section of such an image forming apparatus, for example, are each disposed at a fixed height. The height of the operation panel, for example, is determined so that a user of average stature can easily operate the operation panel, and is generally about 80 cm to about 120 cm as measured from the floor.

It is well known that, when the image forming apparatus or a like apparatus is installed on the mount base or on the floor, a manual adjuster is used for finely adjusting the inclination and height of the apparatus (see, for example, Japanese Unexamined Patent Publication No. 2005-180471).

When the image forming apparatus is in a standby state or the operation panel is not operated during a process, the operation panel is not necessarily required to be located at the fixed height. In order to visually check the operation status of the apparatus from a distance, it is rather advantageous to locate the apparatus at a higher level depending on the operation status. From the viewpoint of security, it is preferred to locate the apparatus at a higher level during a printing process in order to prevent a third person from looking at printed and ejected sheets.

The apparatus may be used by various users including tall users, short users, junior users and senior users. Further, the apparatus may be used by handicapped users. For example, the operation panel located at the fixed height is too high for a handicapped user in a wheelchair. Accordingly, the handicapped user cannot easily operate the operation panel. Therefore, it is difficult to ensure easy operation for all the various users.

The users access not only the operation panel but also the sheet cassette section for supplying sheets, the sheet ejection tray section for taking out ejected sheets, the document reading section for setting document originals, and the toner supply section for supplying toner. A footprint requirement and mechanical limitations make it difficult to locate these sections at the same height, so that the respective sections are located at different height levels. Thus, it is difficult to ensure easy operation on all these sections.

In order to ensure easy operation, it is desirable to design the image forming apparatus so that the image forming apparatus per se or the respective sections thereof are movable up and down according to the operation status of the apparatus. However, an image forming apparatus designed in such a manner is not known yet.

SUMMARY OF THE INVENTION

In view of the foregoing, the present invention provides image forming apparatuses which provide more user-friendly functions according to an operation to be performed by a user and/or the operation status of the apparatus.

According to the present invention, there is provided an image forming apparatus, which comprises a processing unit which performs an image forming process for forming an image on a recording medium based on image data, a movement mechanism which moves the processing unit, a first control section which controls the image forming process performed by the processing unit, and a second control section which acquires the state of progress of the image forming process and controls the movement mechanism so as to move the processing unit to a position according to the progress state.

According to this inventive aspect, the processing unit is moved according to the progress state. Therefore, when a user is to perform an operation on the processing unit, the unit is located at a position which facilitates the operation performed by the user. During the process, the processing unit is located at a position which indicates that the process is currently performed. Upon completion of the process, the processing unit is moved to a position which permits the user to easily take out the recording medium. This facilitates the use of the image forming apparatus.

DESCRIPTION OF THE PREFERRED EMBODIMENTS

Embodiment 1

Figure 1:
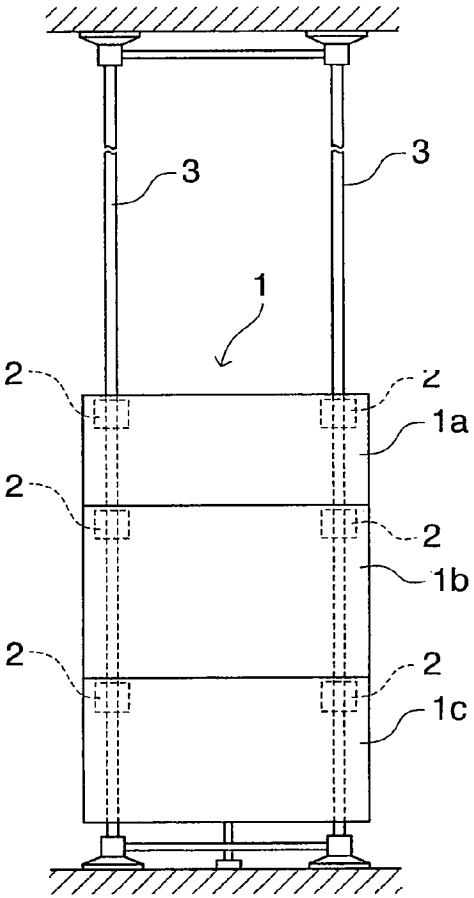
FIGS. 1(*a*) and 1(*b*) are a front view and a side view, respectively, illustrating Embodiment 1A of the present invention.
Figure 1:
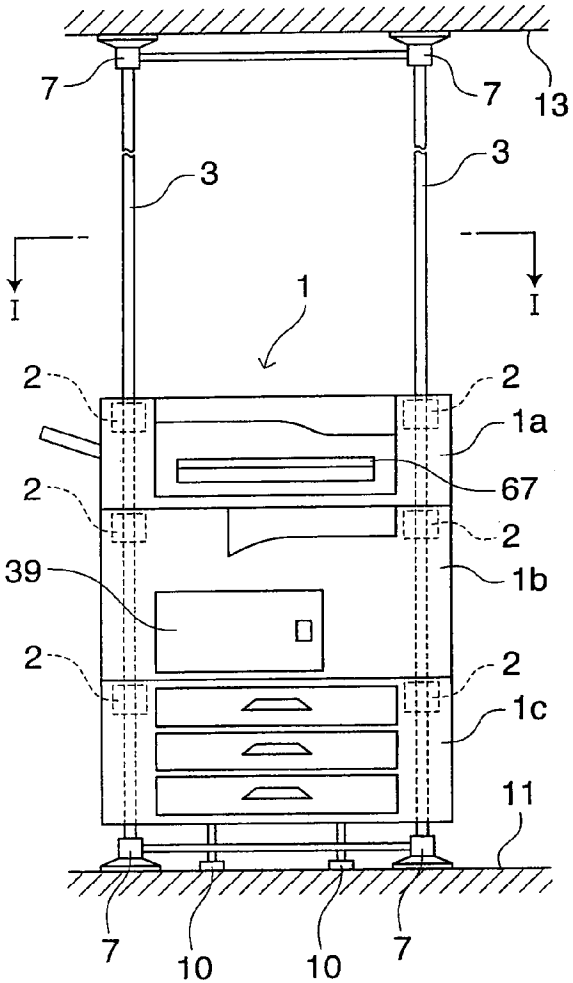

An image forming apparatus according to this embodiment includes a first processing unit which performs a part of an image recording process for recording an image on a recording medium based on image data, a second processing unit which performs the rest of the image recording process, a movement mechanism which moves the first and second processing units, a first control section which controls the image recording process performed by the first and second processing units, and a second control section which acquires the state of progress of the image recording process and controls the movement mechanism so as to move the first and second processing units to positions according to the progress state.

Examples of the image forming apparatus include an electrophotographic copier which records an image on a recording medium based on image data obtained by scanning a document original, and a laser printer and an ink jet printer which record an image on a recording medium based on image data inputted thereto.

Therefore, examples of the processing units according to the present invention include a scanner section which reads image data by optically scanning a document original, a printer section which records an image on a recording medium based on the image data, a sheet cassette section which contains recording media and feeds the recording media one by one to the printer section, and a finisher section which processes the recording media on which images are recorded.

A lift mechanism capable of individually lifting the first and second processing units is preferably used as the movement mechanism. The lift mechanism preferably includes, for example, a post disposed upright on a floor and having a male thread, a nut having a female thread meshed with the male thread of the post, and a drive source which rotates the nut.

The first and second control sections may each include a microprocessor including a CPU, a ROM and a RAM.

The first processing unit may be a unit which performs a process for reading the image data from a document original, and the second processing unit may be a unit which performs a process for recording the image on the recording medium based on the read image data.

Alternatively, the first processing unit may be a unit which performs a process for recording the image on the recording medium based on the image data, and the second processing unit may be a unit which processes the recording medium subjected to the process performed by the first processing unit.

The first and second processing units may be coupled to each other to perform the image recording process.

The movement mechanism preferably includes a mechanism which moves the first and second processing units independently.

The second control section may move one of the first and second processing units to a predetermined position upon completion of the image recording process performed by the first and second processing units. Alternatively, the second control section may start moving one of the first and second processing units to the predetermined position before the completion of the image recording process performed by the first and second processing units.

If one of the first and second processing units is interrupted during the image recording process, the second control section may move the interrupted processing unit to the predetermined position.

When the process once interrupted is restarted by the one processing unit, the second control section may move the one processing unit from the predetermined position to another predetermined position.

With reference to the attached drawings, Embodiment 1 of the present invention will be described in greater detail by way of Embodiments 1A and 1B. However, it should be understood that the invention be not limited to these embodiments. In the figures, like components will be denoted by like reference characters.

Embodiment 1A

Figure 2:
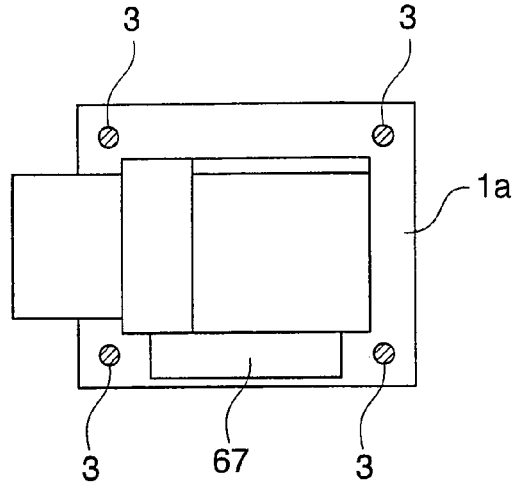
FIG. 2 is a sectional view as seen in an arrow direction I-I in FIG. 1(*a*).

FIGS. 1(*a*) and 1(*b*) are a front view and a side view, respectively, illustrating an electrophotographic copying apparatus (copier) according to Embodiment 1A, and FIG. 2 is a sectional view as seen in an arrow direction I-I in FIG. 1(*a*). As shown, a main body 1 of the copying apparatus includes a scanner section 1*a*, a printer section 1*b* and a sheet cassette section 1*c*. The scanner section 1*a* includes an operation panel 67. The scanner section 1*a*, the printer section 1*b* and the sheet cassette section 1*c* are stacked one on another, and four posts 3 respectively extend through four corners of each of these sections. The posts 3 each have a lower end and an upper end, which are respectively fixed to a floor 11 and a ceiling 13 via fixing members 7. The scanner section 1*a*, the printer section 1*b* and the sheet cassette section 1*c* each include lift mechanisms 2 respectively engaged with the posts 3, and are individually movable up and down along the posts 3.

Figure 3:
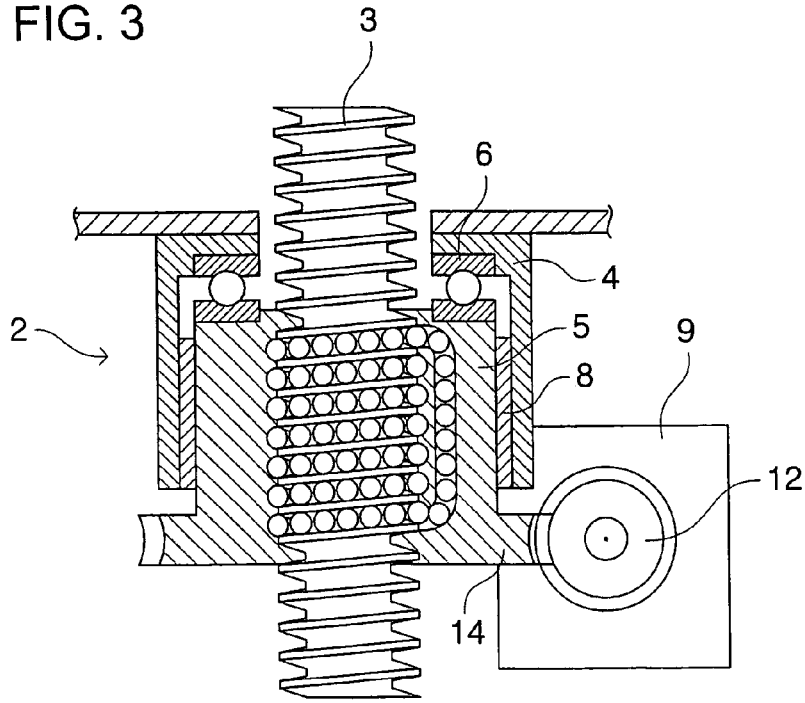
FIG. 3 is a sectional view illustrating a major portion of Embodiment 1A in detail.

FIG. 3 is a sectional view illustrating the lift mechanism 2.

As shown in FIG. 3, the posts 3 each have a male thread provided on a circumferential surface thereof. The male thread of the post 3 is meshed with a female thread of a nut 5. The lift mechanism 2 includes a so-called ball screw mechanism, in which bearing balls are aligned in a spiral thread space defined between a thread groove of the male thread of the post 3 and a thread groove of the female thread of the nut 5 and in a channel extending through the nut 5 from one end to the other end of the spiral thread space.

The nut 5 is rotatably supported by a support member 4 via a thrust bearing 6 and a radial bearing 8. A worm wheel 14 is provided integrally with a lower end portion of the nut 5, and a worm 12 is meshed with the worm wheel 14 and connected to a lift drive motor 9. When the worm 12 is rotated by the lift drive motor 9, the nut 5 is rotated, whereby the support member 4 is moved relative to the post 3. Therefore, the scanner section 1*a*, the printer section 1*b* and the sheet cassette section 1*c* each including the lift mechanisms 2 can be moved up and down along the posts 3 by driving the lift drive motors 9.

Figure 4:
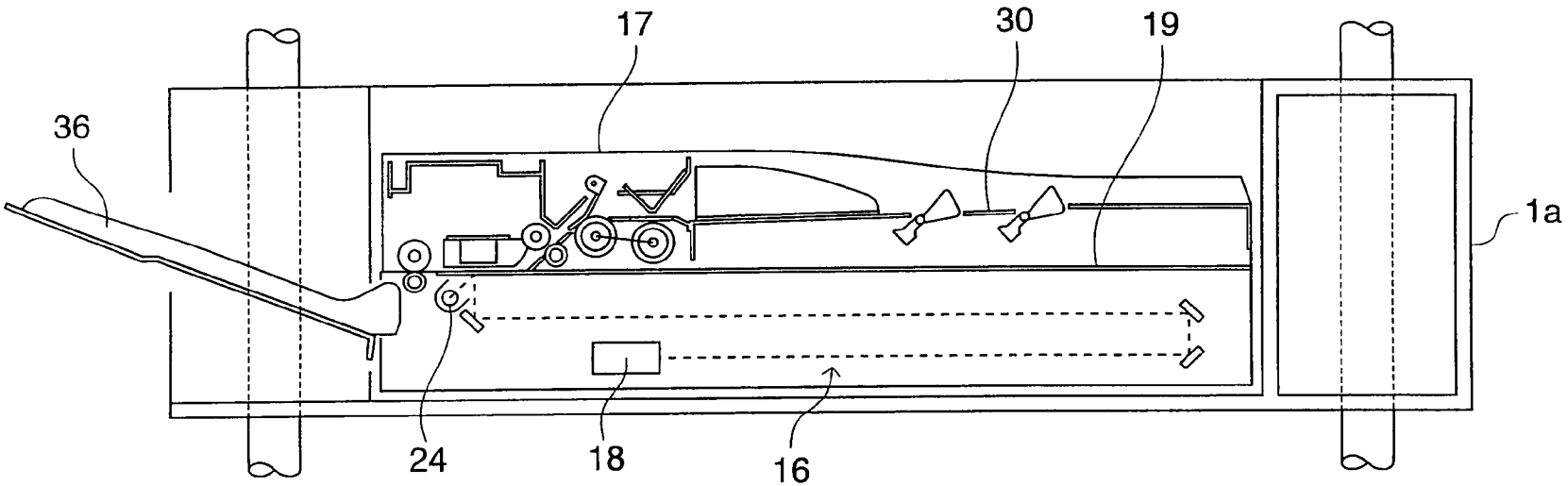
FIG. 4 is a diagram for explaining the construction of another major portion of Embodiment 1A.
Figure 5:
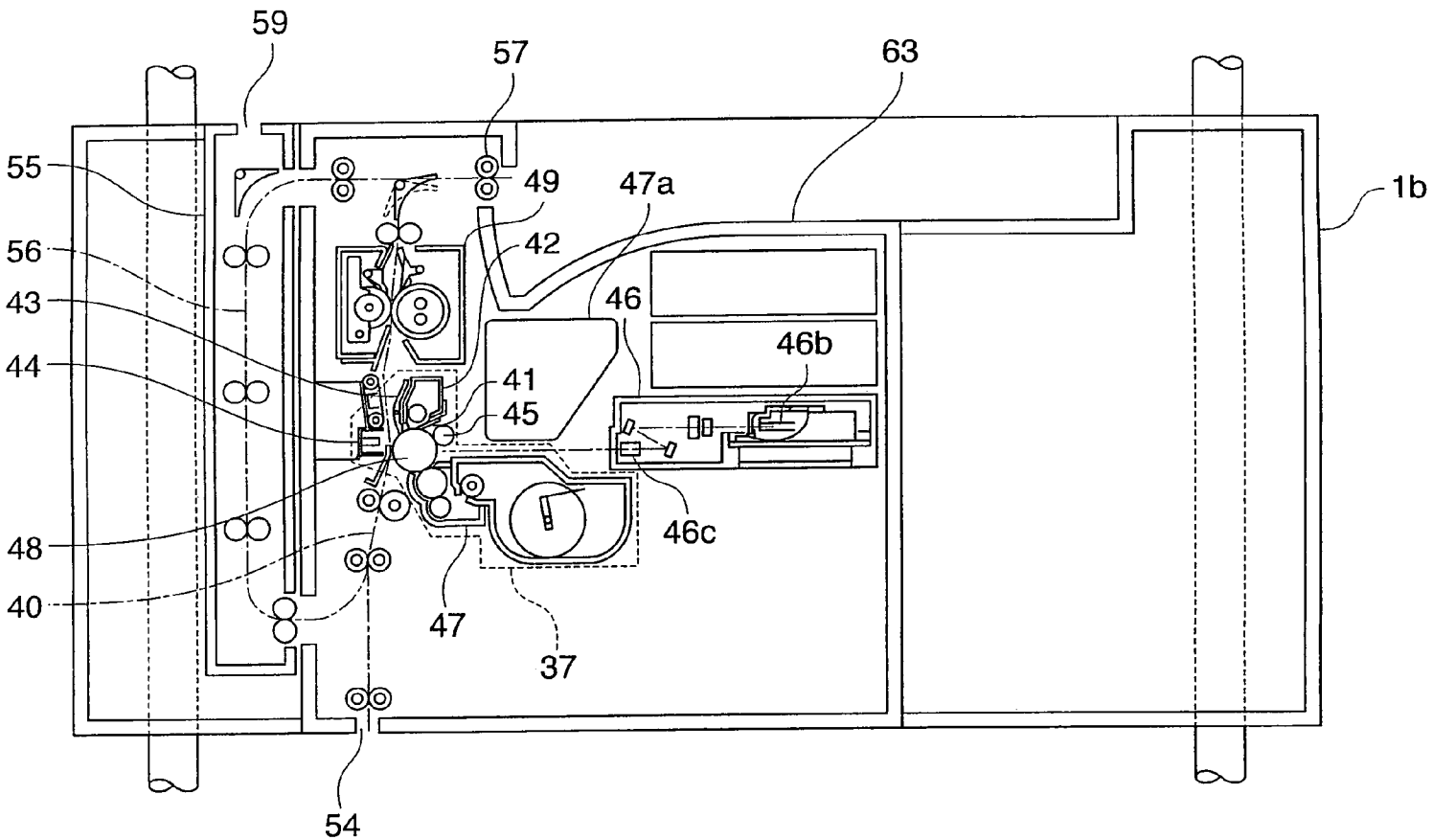
FIG. 5 is a diagram for explaining the construction of further another major portion of Embodiment 1A.
Figure 6:
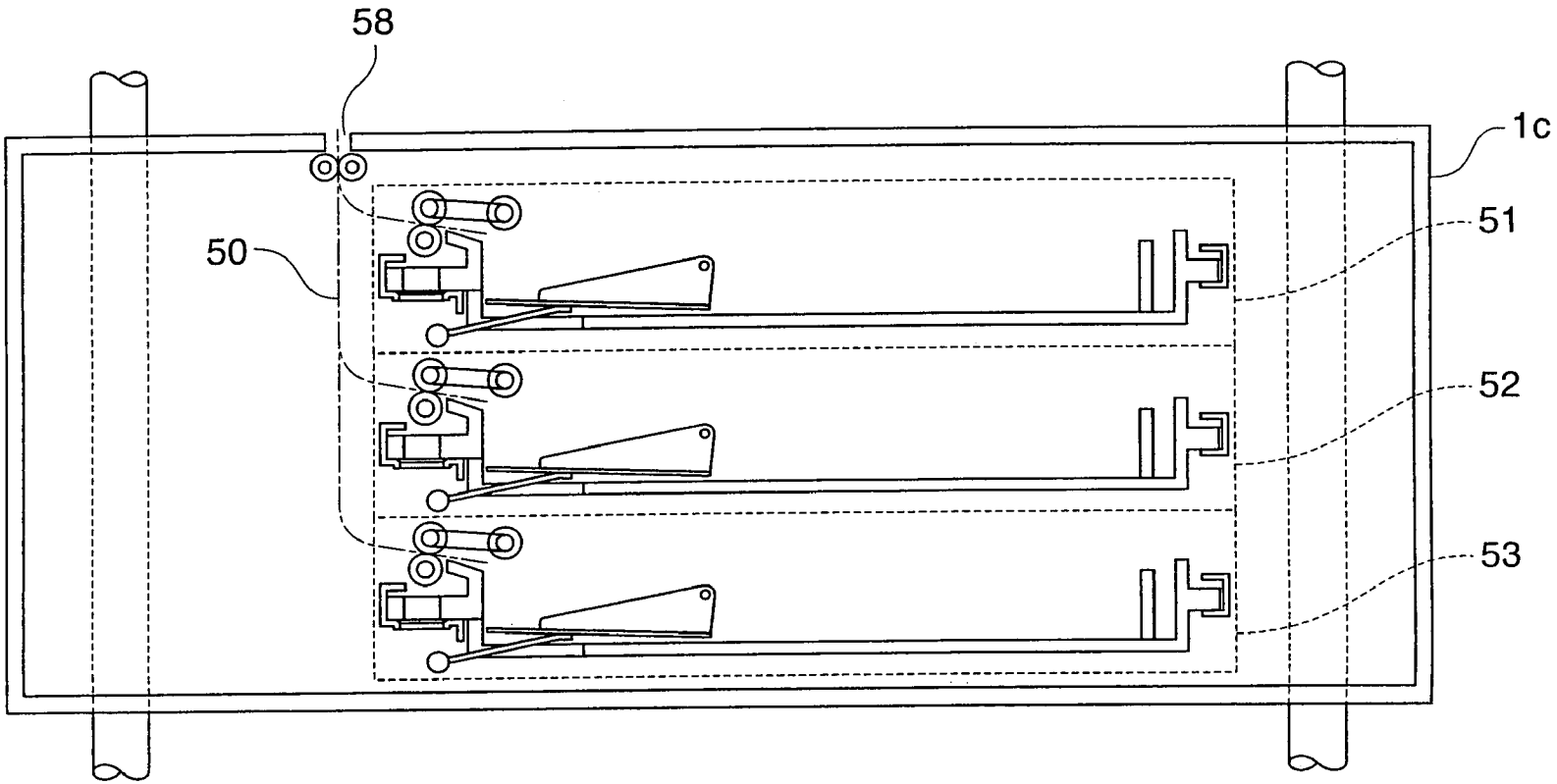
FIG. 6 is a diagram for explaining the construction of still another major portion of Embodiment 1A.

FIGS. 4, 5 and 6 are diagrams for explaining the constructions and functions of the scanner section 1*a*, the printer section 1*b* and the sheet cassette section 1*c*.

In the scanner section 1*a*, as shown in FIG. 4, a scanning optical system 16 includes a light source lamp 24 and a CCD reading unit 18 as image reading means. An image of a document original placed on a document platen (platen glass) 19 is scanned by a scanning optical system 16, and read by the CCD reading unit 18. The CCD reading unit 18 includes a focusing lens, a CCD image sensor and the like.

In the scanner section 1*a*, a document transport device 17 feeds document originals stacked on a document tray 30 on a one-by-one basis, then transports the fed document original to an end of the document platen 19 and ejects the document original to a document ejection tray 36. In the course of the transportation of the document original, an image on a lower surface of the document original is read by the CCD reading unit 18 of the scanning optical system 16. At the same time, an image on an upper surface of the document original is read by a contact image sensor 35 provided on an upper side of a document transport path.

The document transport device 17 is pivotal about a hinge (not shown) provided on an innermost side of the document platen 19, so that a front portion thereof can be lifted to open up an upper surface of the document platen 19. Where a document original such as a book which cannot be transported by the document transport device 17 is to be read, a user lifts the front portion of the document transport device 17 and places the document original on the document platen 19. Then, the scanning optical system 16 is moved below the document platen 19 to scan the document original and read a document image.

As shown in FIG. 5, the printer section 1*b* includes a transport system for transporting a sheet (paper sheet) as a recording medium on which an image is formed, a laser writing unit 46, and an electrophotographic processing section 37 for forming an image. The electrophotographic processing section 37 has a photosensitive drum 48 having a surface on which an electrostatic latent image is formed. The laser writing unit 46 includes a semiconductor laser light source which emits a laser beam according to image data, a polygon mirror 46*b* which deflects the laser beam, an fè lens 46*c* which corrects a light path of the laser beam so as to cause the deflected laser beam to scan the surface of the photosensitive drum 48 at an equiangular speed, and the like.

The electrophotographic processing section 37 includes an electric charger 45, a developing device 47, a toner container 47*a*, a transfer device 44, a sheet separator 43, a cleaning device 42 and a static eliminator 41 which are arranged around the photosensitive drum 48. The electric charger 45 uniformly electrically charges the surface of the photosensitive drum 48. Thereafter, the surface of the photosensitive drum 48 is irradiated with the laser beam by the laser writing unit 46, whereby an electrostatic latent image corresponding to a document image is formed on the surface of the photosensitive drum 48. The developing device 47 develops the formed electrostatic latent image by applying toner on the surface of the photosensitive drum 48. Thus, a toner image corresponding to the document image is formed on the surface of the photosensitive drum 48. The toner container 47*a* supplies the toner to the developing device 47.

In the printer section 1*b*, the sheet transport system has a sheet transport section 40, a fixing device 49 and a sheet re-feeding unit 55. Sheets are fed one by one into the sheet transport section 40 from the sheet cassette section 1*c* (FIG. 6) through a sheet inlet port 54. The sheet transport section 40 transports the fed sheet to a transfer position at which the transfer device 44 is disposed. At the transfer position, the toner image formed on the surface of the photosensitive drum 48 is transferred onto the sheet. The fixing device 49 fixes the transferred toner image on the sheet. The sheet having the toner image fixed thereon is ejected onto a sheet ejection tray 63 through sheet ejection rollers 57.

The sheet re-feeding unit 55 re-feeds the sheet to the transfer position through a sheet re-feeding transport path 56 for transferring an image onto the other side of the sheet for double side image formation. In Embodiment 2 to be described later, the sheet having the toner image fixed thereon is not ejected onto the sheet ejection tray 63, but transported out through a sheet outlet port 59. A maintenance door 39 (see FIG. 1(*a*)) is provided on a front face of the printer section 1*b*, so that the user can replenish the toner container 47*a* with toner or perform other maintenance operations with the maintenance door 39 being opened.

As shown in FIG. 6, the sheet cassette section 1*c* includes sheet cassettes 51, 52, 53. In operation, one of the sheet cassettes 51, 52, 53 is selected, and sheets are fed one by one from the selected sheet cassette. The fed sheets are transported into the sheet inlet port 54 of the printer section 1*b* (FIG. 5) from a sheet outlet port 58 through a sheet transport path 50. The sheet cassettes 51, 52, 53 can be each drawn forward so as to be replenished with sheets.

Figure 7:
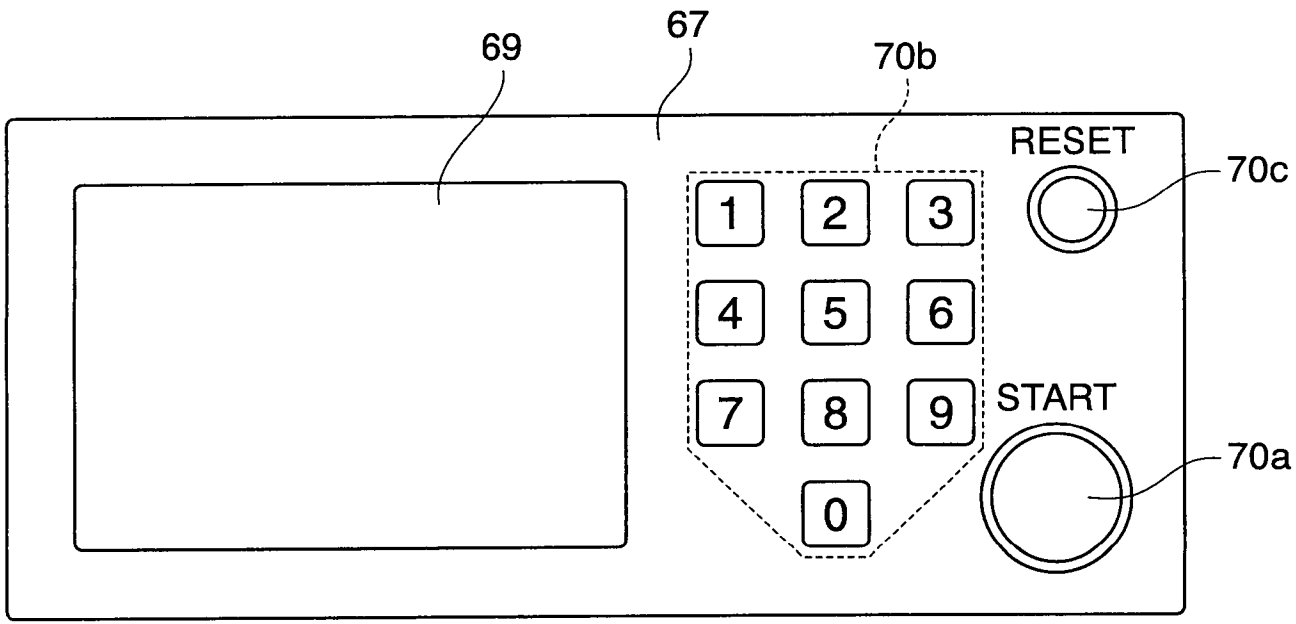
FIG. 7 is a top plan view of further another major portion of Embodiment 1A.

FIG. 7 is a front view of the operation panel 67. The operation panel 67 is attached to a front face of the scanner section 1*a* as shown in FIGS. 1(*a*) and 2. The operation panel 67 includes a liquid crystal display section 69 which displays the number of sheets to be printed, and messages indicating toner depletion, sheet depletion, sheet jamming and the like, a start key 70*a*, ten keys 70*b* to be used for setting the number of sheets to be printed, and a reset key 70*c* to be used for resetting the number of sheets to be printed.

Figure 8:
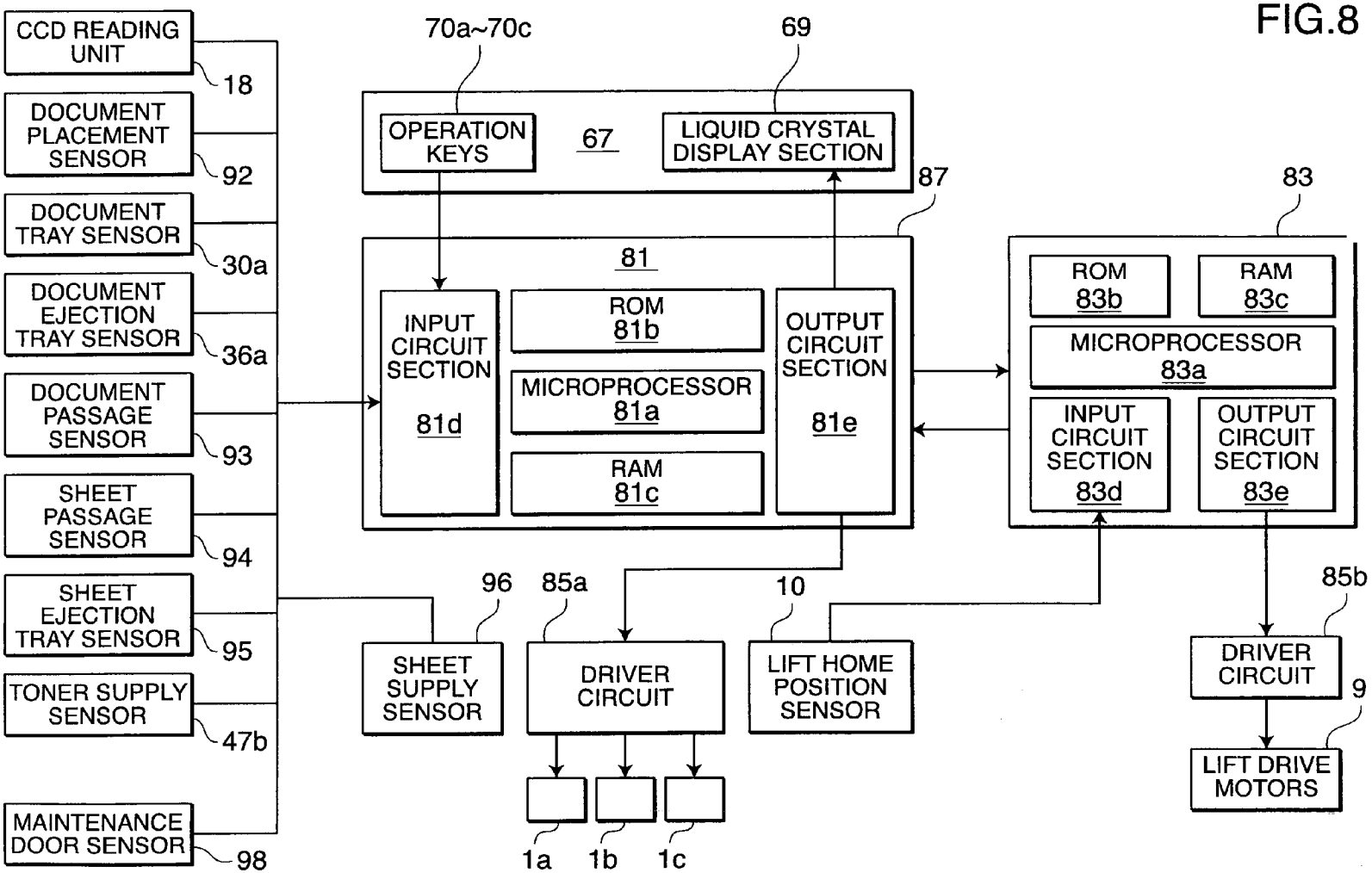
FIG. 8 is a diagram of a control circuit of Embodiment 1A.

FIG. 8 is a diagram illustrating a control circuit which controls the overall electrophotographic copying apparatus according to Embodiment 1A. As shown, the control circuit includes a main body control circuit 81 which controls the driving of the main body 1, i.e., the scanner section 1*a*, the printer section 1*b* and the sheet cassette section 1*c*, and a lift control circuit 83 which controls the driving of the lift drive motors 9.

The main body control circuit 81 includes a microprocessor 81*a*, a ROM 81*b*, a RAM 81*c*, and an input circuit section 81*d* and an output circuit section 81*e* for input to and output from the microprocessor 81*a*. The main body control circuit 81 receives signals outputted from operation keys (the start key 70*a*, the ten keys 70*b* and the reset key 70*c*) of the operation panel 67, the CCD reading unit 18, a document placement sensor 92, a document tray sensor 30*a*, a document ejection tray sensor 36*a*, a document passage sensor 93, a sheet passage sensor 94, a sheet ejection tray sensor 95, a toner supply sensor 47*b*, a maintenance door sensor 98 and a sheet supply sensor 96, and outputs signals to the liquid crystal display section 69 of the operation panel 67 and to a driver circuit 85*a* which drives the scanner section 1*a*, the printer section 1*b* and the sheet cassette section 1*c*.

Image data read by the CCD reading unit 18 is once stored in the RAM 81*c*, and outputted to the printer section 1*b*.

The document placement sensor 92 is provided in the scanner section 1*a* (FIG. 4) for determining whether a document original is placed on the document platen 19 with the document transport device 17 being lifted.

The document tray sensor 30*a* is provided on the document tray 30 (FIG. 4) for determining whether a document original is placed on the document tray 30.

The document ejection tray sensor 36*a* is provided on the document ejection tray 36 (FIG. 4) for determining whether the ejected document original is present on the document ejection tray 36.

The document passage sensor 93 is provided in the scanner section 1*a* (FIG. 4) for detecting a jam of a transported document original.

The sheet passage sensor 94 is provided in the printer section 1*b* (FIG. 5) for detecting a jam of a transported sheet.

The sheet ejection tray sensor 95 is provided in the sheet ejection tray 63 (FIG. 5) for determining whether a sheet is present on the sheet ejection tray 63.

The toner supply sensor 47*b* is provided in the toner container 47*a* (FIG. 5) for detecting toner depletion when the toner contained in the toner container 47*a* is used up.

The maintenance door sensor 98 detects the opening and closing of the maintenance door 39 (FIG. 1).

The sheet supply sensor 96 is provided in the sheet cassette section 1*c* (FIG. 6) for detecting the presence or absence of a sheet in each of the sheet cassettes 51 to 53.

On the other hand, the lift control circuit 83 shown in FIG. 8 includes a microprocessor 83*a*, a ROM 83*b*, a RAM 83*c*, and an input circuit section 83*d* and an output circuit section 83*e* for input to and output from the microprocessor 83*a*. The lift control circuit 83 receives a signal outputted from a lift home position sensor 10. Further, the lift control circuit 83 acquires the state of progress of the main body 1 (the scanner section 1*a*, the printer section 1*b* and the sheet cassette section 1*c*), and outputs signals to the driver circuit 85*b* which drives the lift drive motors 9. Here, the lift home position sensor 10 extends downward from a bottom of the sheet cassette section 1*c* as shown in FIG. 1.

The lift home position sensor 10 detects the approach of the sheet cassette section 1*c* to the floor 11, and outputs a signal before the sheet cassette section 1*c* reaches the floor 11. The lift control circuit 83 uses this signal to determine a reference position (lowermost position) for the vertical movement. Where the lift drive motors 9 each employ a stepping motor, the lift control circuit 83 constantly detects vertical positions of the scanner section 1*a* and the printer section 1*b* on the basis of the number of steps from the reference position for the positional control of the scanner section 1*a* and the printer section 1*b*. Alternatively, where the lift drive motors 9 each employ a motor with an encoder, the lift control circuit 83 constantly detects the vertical position of the main body 1 on the basis of the number of pulses of the encoder from the reference position for the positional control of the main body 1.

An operation to be performed by the apparatus having the aforementioned construction will be described with reference to a flow chart shown in FIG. 9.

Figure 10:
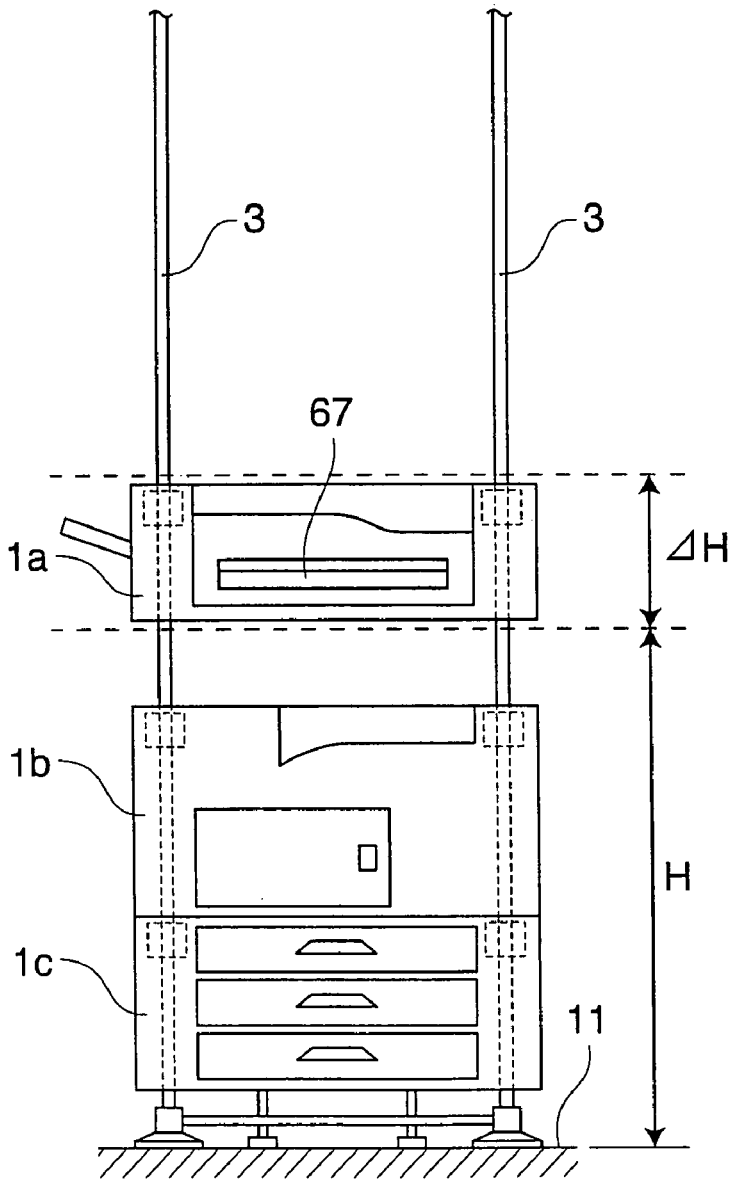
FIGS. 10 to 14 are diagrams for explaining the positions of respective sections shifted according to Embodiment 1A.

When the main body 1 is turned on at a position shown in FIGS. 1(*a*) and 1(*b*), an initializing operation such as warm-up of the printer section 1*b* is performed (Step S1). Upon completion of the initializing operation, the scanner section 1*a* having the operation panel 67 is moved to an operation area ΔH as shown in FIG. 10 (Step S2). The operation area is herein defined as an area at which the user can most easily perform an operation on the main body 1, and ranges from a height level H to a height level H+ΔH as measured from the floor 11. For example, H=100 cm and ΔH=30 cm.

Figure 11:
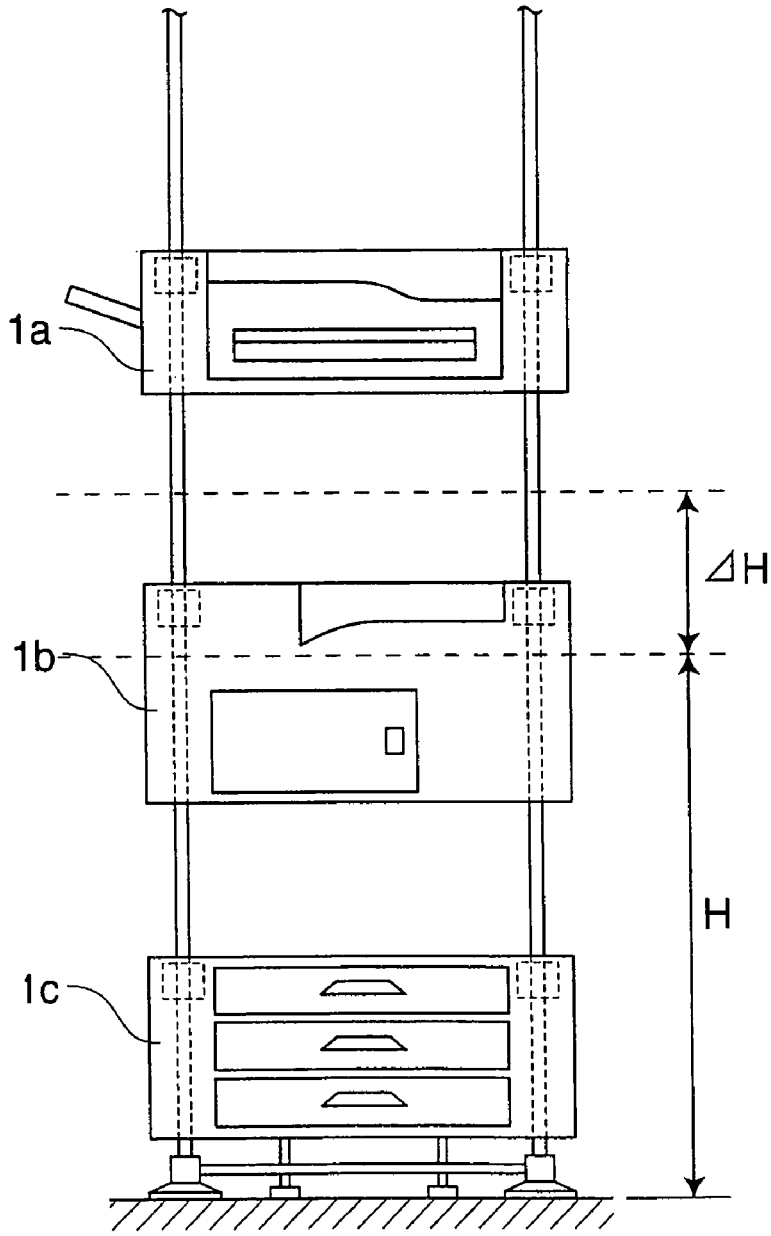

Then, a document original is set in the scanner section 1*a* (Step S3), and the number of sheets to be printed is inputted by the ten keys 70*b* of the operation panel 67 (Step S4). When the start key 70*a* is pressed (Step S5), a reading process is performed in the scanner section 1*a* (Step S6). When the document original is thereafter removed (Step S7), a printing process is started (Step S8). If the printing process is performed without interruption due to sheet depletion, toner depletion and sheet jamming (Steps S9 to S11) and the printing on the inputted number of sheets is completed (Step S12), an upper portion of the printer section 1*b* is moved to the operation area ΔH as shown in FIG. 11 (Step S13). If the printed sheets are taken out of the sheet ejection tray 63 of the printer section 1*b* (Step S14), the routine returns to Step S2, whereby the scanner section 1*a* is moved back to the operation area ΔH as shown in FIG. 10. Then, the scanner section 1*a* is kept in standby for the setting of the next document original (Step S3).

Figure 12:
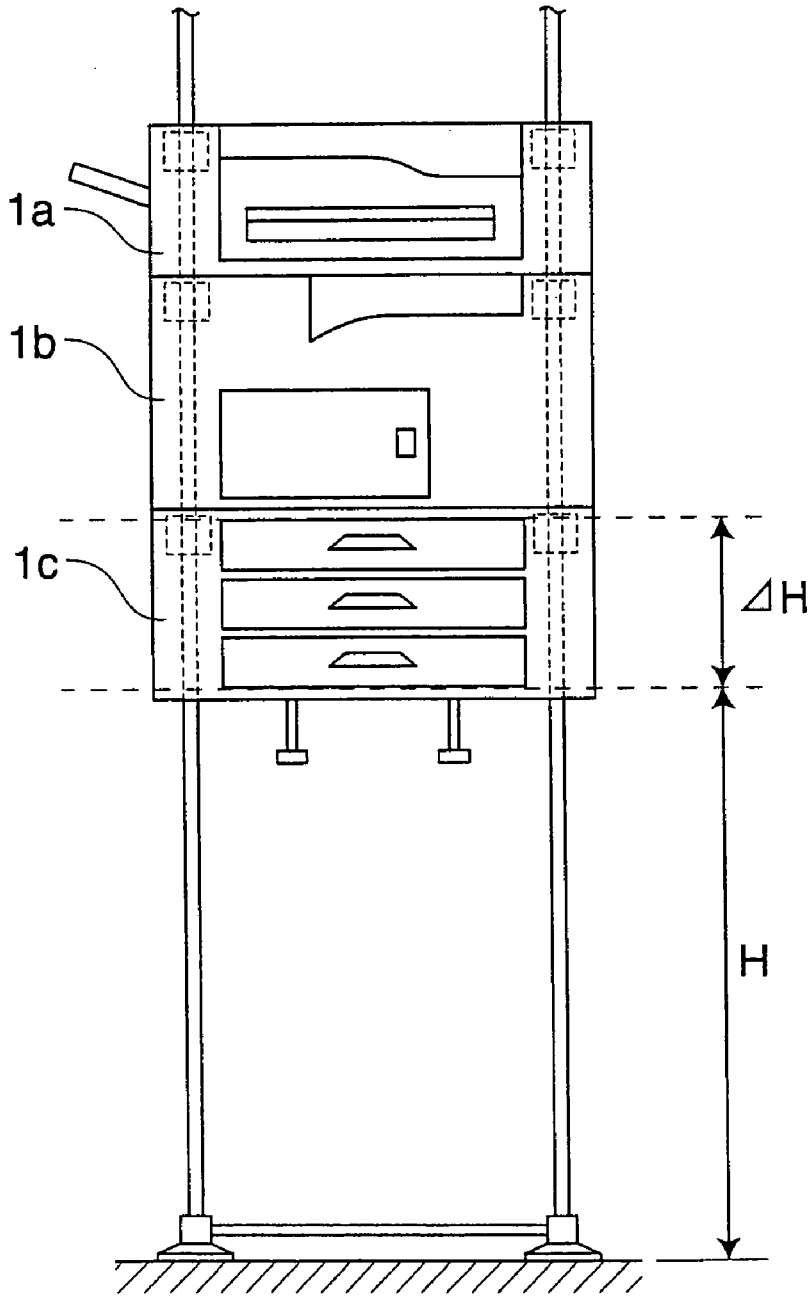

When the sheet depletion occurs in Step S9, the printing process is interrupted, and the sheet cassette section 1*c* is moved to the operation area ΔH as shown in FIG. 12 (Step S15). After the sheet cassette section 1*c* is replenished with sheets (Step S16), the routine returns to Step S8, whereby the printing process is restarted.

Figure 13:
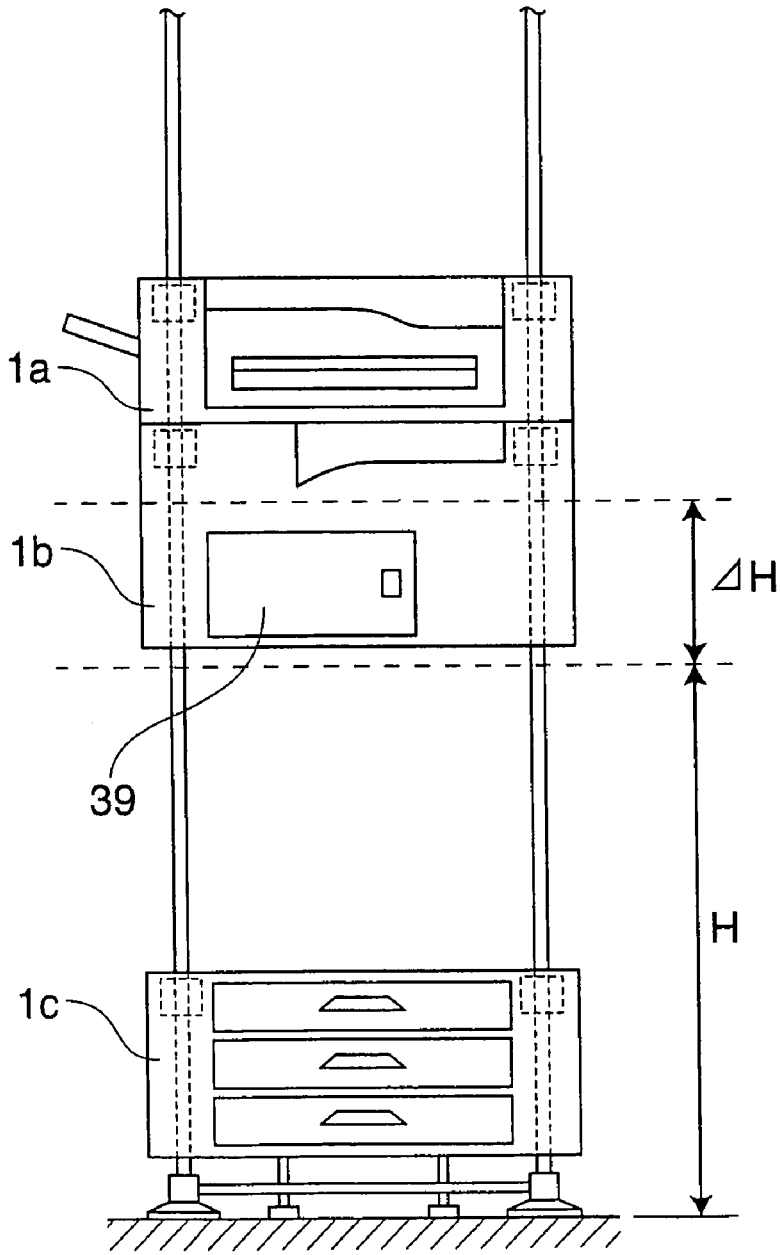

When the toner depletion occurs in Step S10, the printing process is interrupted, and the printer section 1*b* is moved to locate the maintenance door 39 in the operation area ΔH as shown in FIG. 13 (Step S17). After the toner container is replenished with toner through the maintenance door 39 (Step S18), the routine returns to Step S8.

Figure 14:
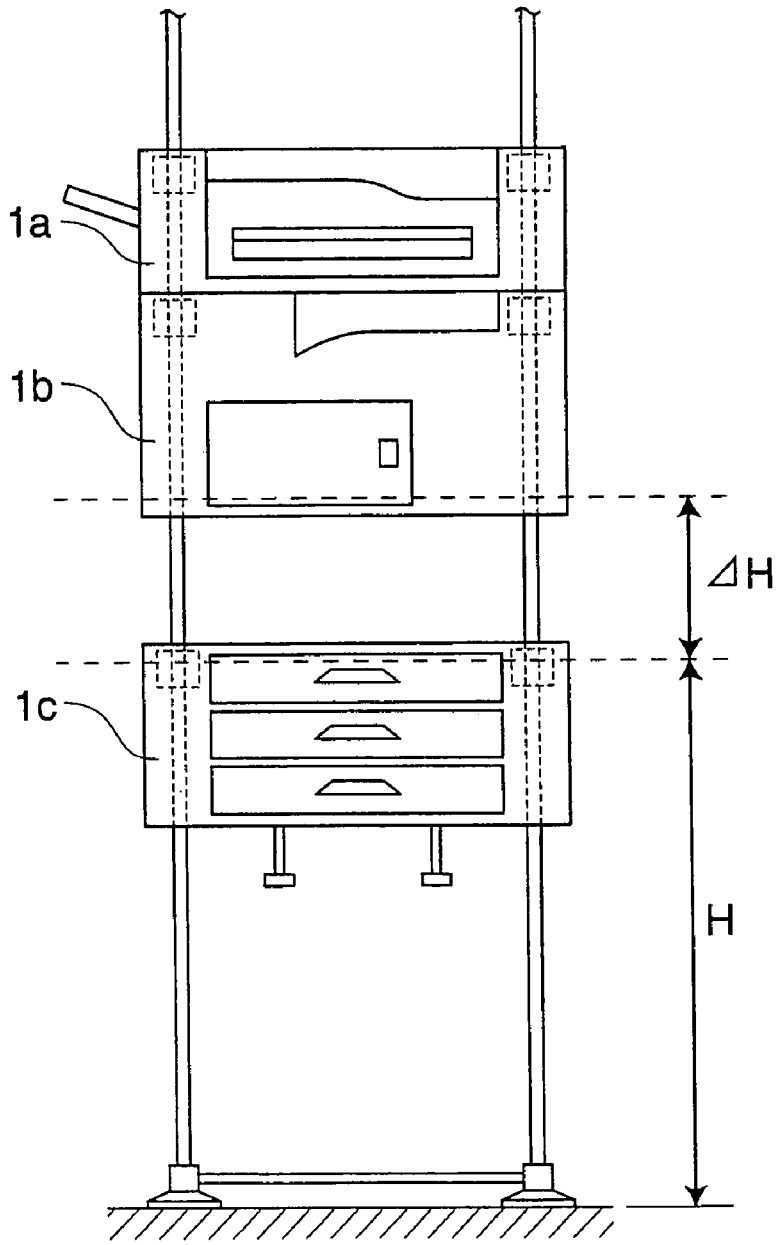

When a sheet jam occurs in Step S11, the printing process is interrupted, and an area of the apparatus suffering from the sheet jam is moved to the operation area ΔH as shown in FIG. 14 (Step S19). After a jammed sheet is removed (Step S20), the routine returns to Step S8.

Thus, the lift control circuit 83 acquires the progress state of the image recording process from the main body control circuit 81, and moves the scanner section 1*a*, the printer section 1*b* or the sheet cassette section 1*c* to a position which facilitates the user's operation according to the progress state.

Figure 9:
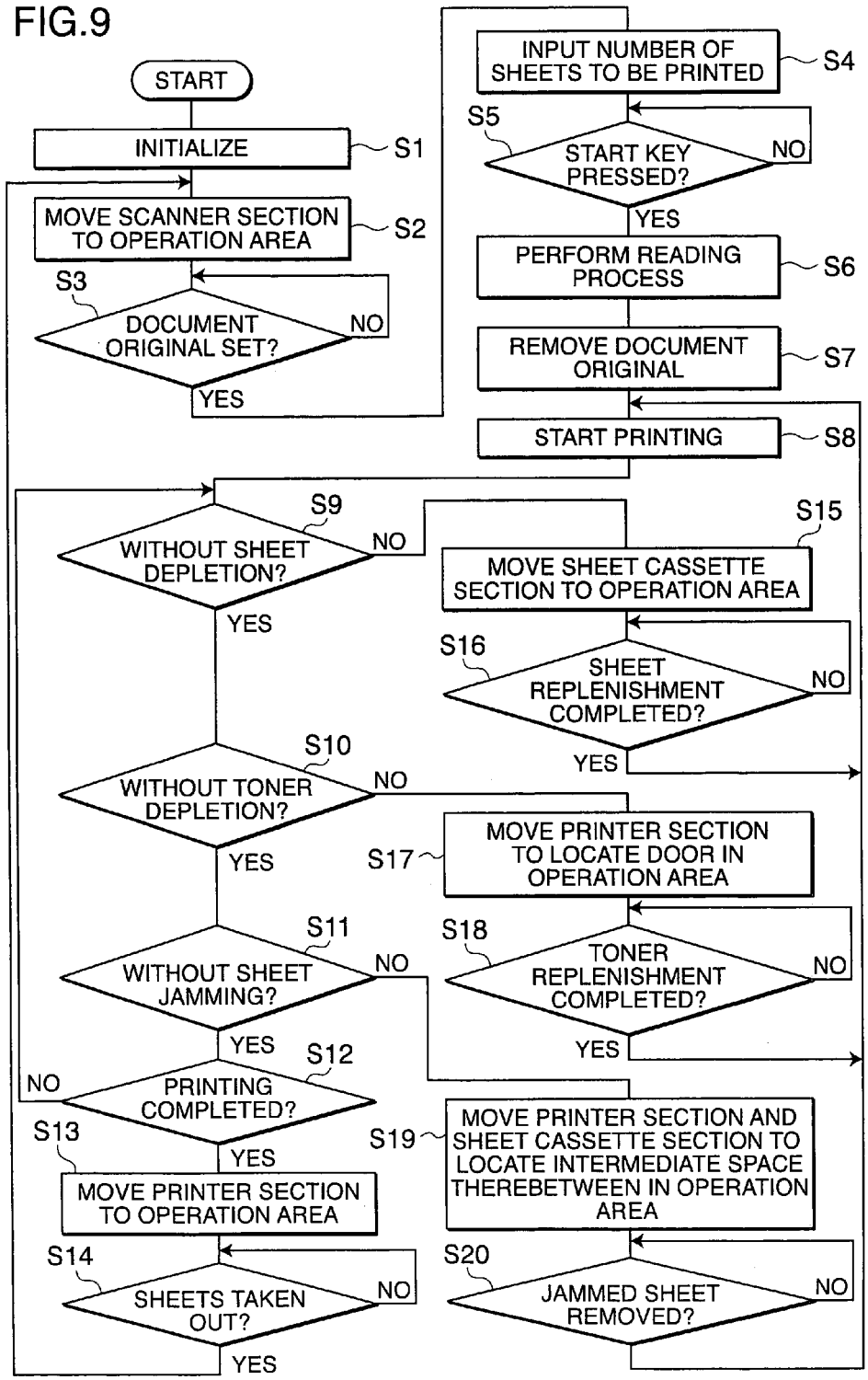
FIG. 9 is a flow chart showing an operation to be performed according to Embodiment 1A.
Figure 15:
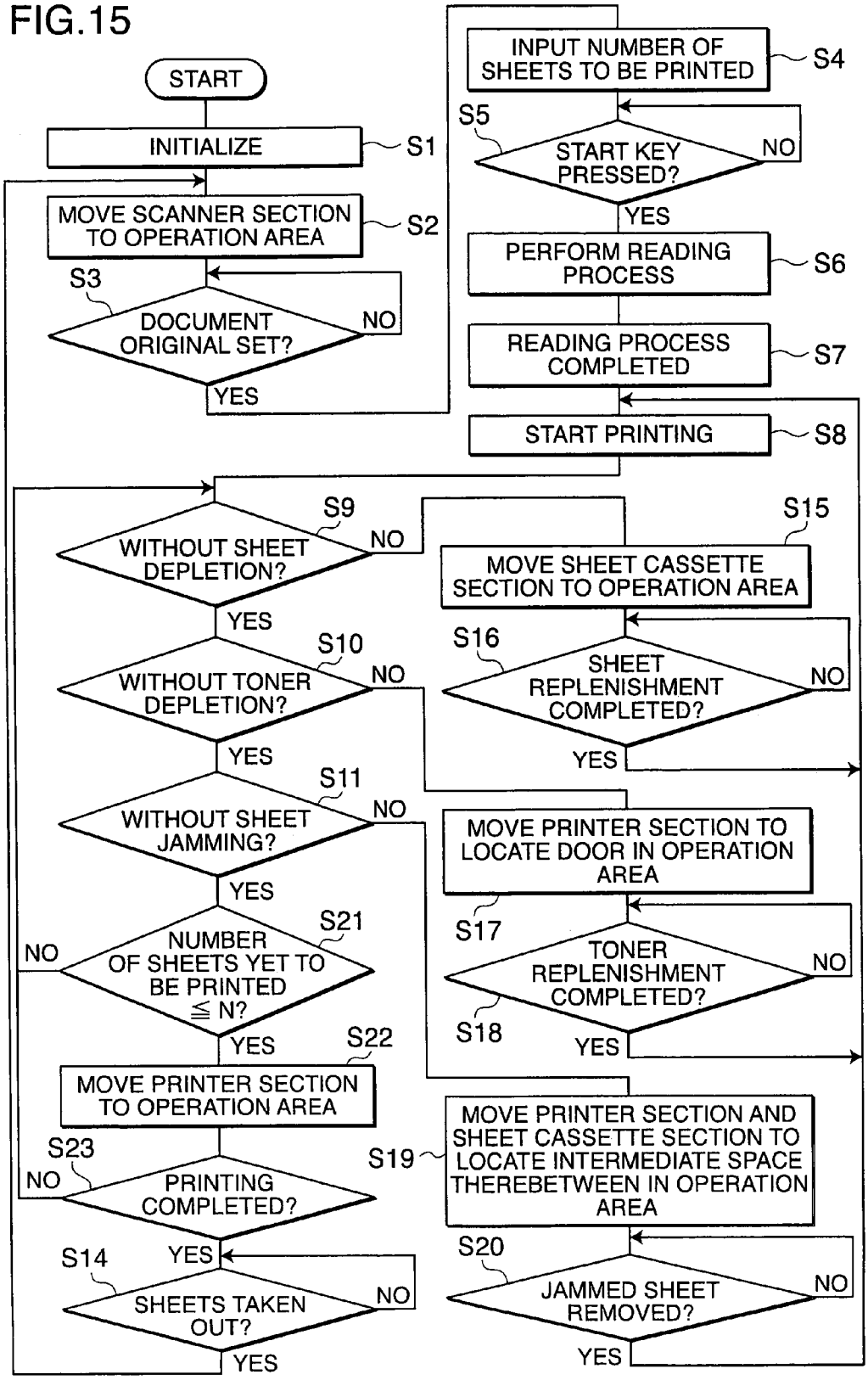
FIG. 15 is a flow chart showing a variation of the operation to be performed according to Embodiment 1A.

FIG. 15 is a flow chart showing a variation of the operation to be performed according to Embodiment 1A as corresponding to FIG. 9. In FIG. 15, Steps S21 to S23 are provided instead of Steps S12 and S13 shown in FIG. 9. Therefore, the operation shown in FIG. 15 is performed in substantially the same manner as in FIG. 9, except that the printer section 1*b* starts moving to the operation area ΔH (Step S22) when the number of sheets yet to be printed becomes N (Step S21) before the completion of the printing process (Step S23).

Figure 16:
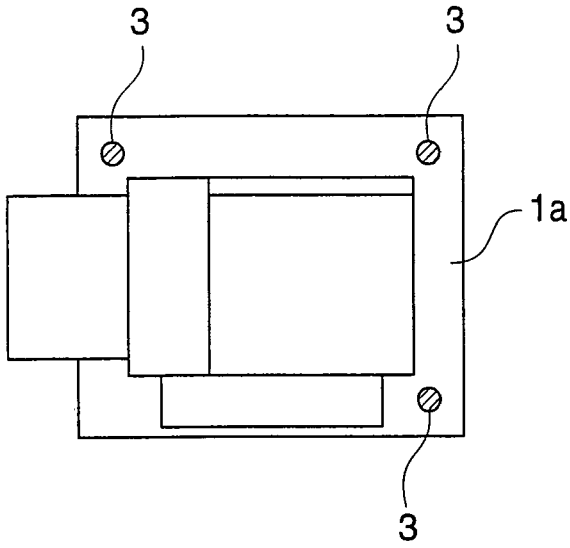
FIG. 16 is a diagram illustrating a variation of Embodiment 1A as corresponding to FIG. 2.
Figure 17:
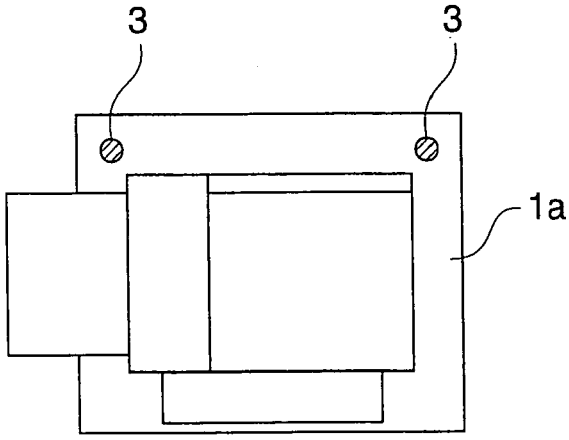
FIG. 17 is a diagram illustrating another variation of Embodiment 1A as corresponding to FIG. 2.

FIGS. 16 and 17 are diagrams illustrating structural variations of Embodiment 1A as corresponding to FIG. 2. Particularly, FIG. 16 illustrates a case in which three posts 3 are provided, and FIG. 17 illustrates a case in which two posts are provided.

Embodiment 1B

Figure 18:
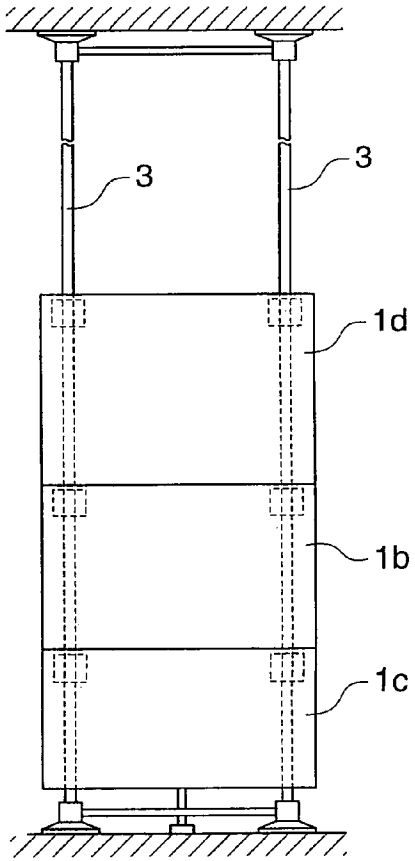
FIGS. 18(*a*) and 18(*b*) are a front view and a side view, respectively, illustrating Embodiment 1B of the present invention.
Figure 18:
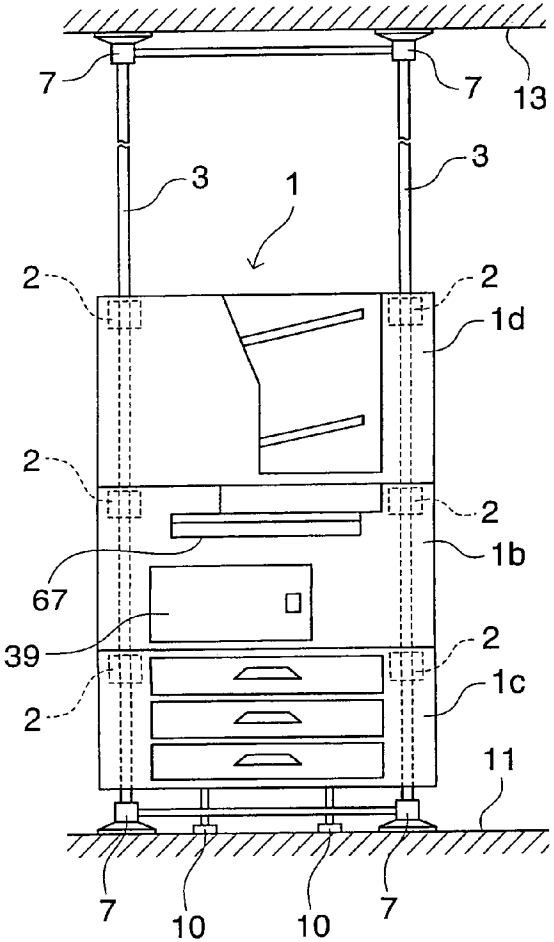

FIGS. 18(*a*) and 18(*b*) are a front view and a side view, respectively, illustrating a printing apparatus (printer) according to Embodiment 1B. As shown, a main body 1 of the printing apparatus includes a finisher (post-processing) section 1*d*, a printer section 1*b* and a sheet cassette section 1*c*. That is, Embodiment 1A is modified by replacing the scanner section 1*a* with the finisher section 1*d* to provide Embodiment 1B. An operation panel 67 is provided on the printer section 1*b*.

As in Embodiment 1A, the finisher section 1*d*, the printer section 1*b* and the sheet cassette section 1*c* are stacked one on another, and four posts 3 respectively extend through four corners of each of these sections. The posts 3 each have a lower end and an upper end which are respectively fixed to a floor 11 and a ceiling 13 via fixing members 7.

The finisher section 1*d*, the printer section 1*b* and the sheet cassette section 1*c* each include lift mechanisms 2 respectively engaged with the posts 3, and are individually movable up and down along the posts 3. The lift mechanisms 2 each have the same construction as in Embodiment 1A (FIG. 3).

Figure 19:
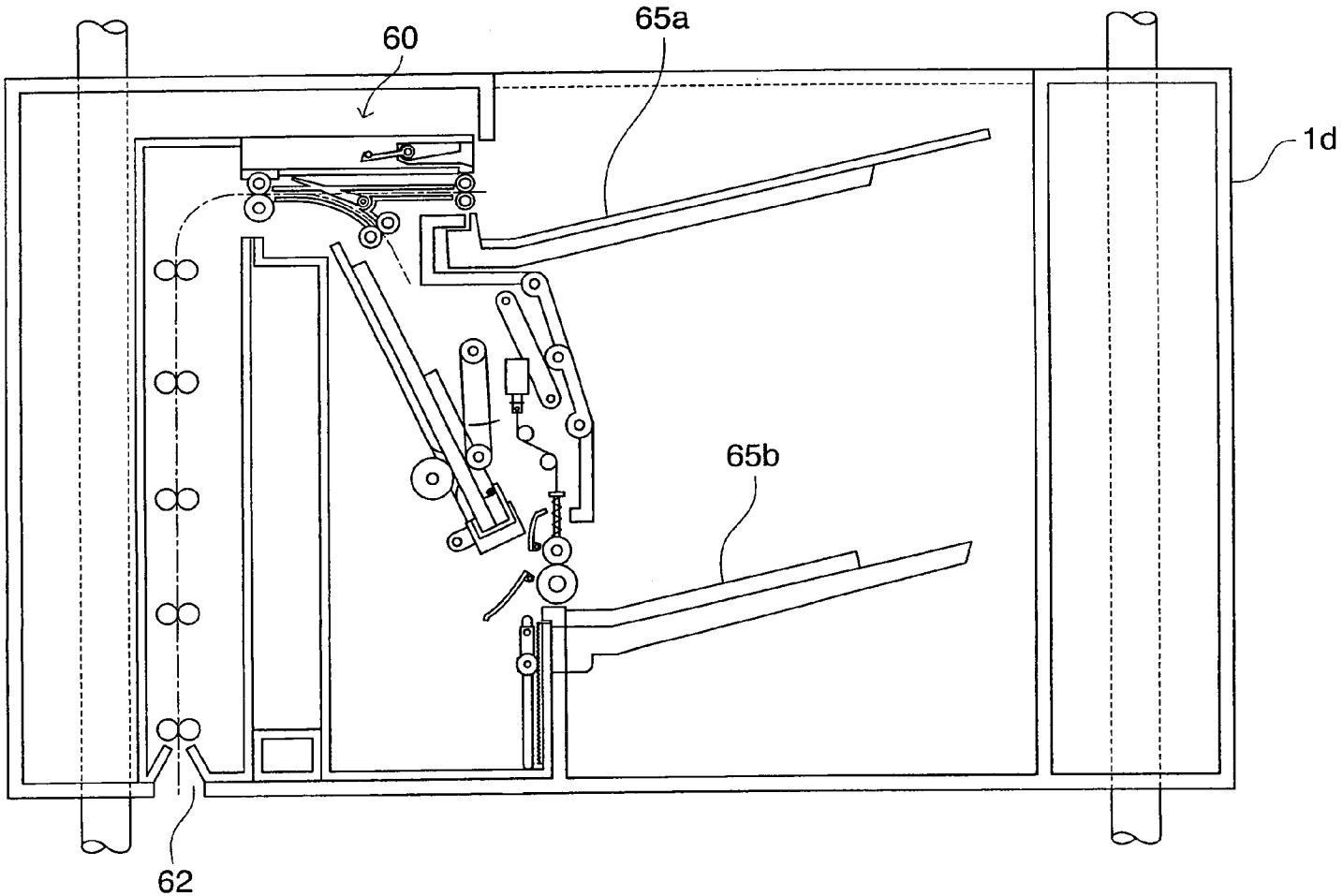
FIG. 19 is a diagram for explaining the construction of a major portion of Embodiment 1B.

FIG. 19 is a diagram for explaining the construction and functions of the finisher section 1*d*.

As shown in FIG. 19, the finisher section 1*d* has a sheet inlet port 62 at its bottom. A sheet printed in the printer section 1*b* (FIG. 18) is transported into the finisher section 1*d* through the sheet inlet port 62, then subjected to post-processing in a post-processing section 60, and ejected onto a sheet ejection tray 65*a* or a sheet ejection tray 65*b*. Examples of the post-processing include a sheet offset stacking process, a stapling process and a punching process.

The printer section 1*b* and the sheet cassette section 1*c* each have the same construction and functions as in Embodiment 1A (FIGS. 5 and 6) and, therefore, no explanation will be given thereto.

Figure 20:
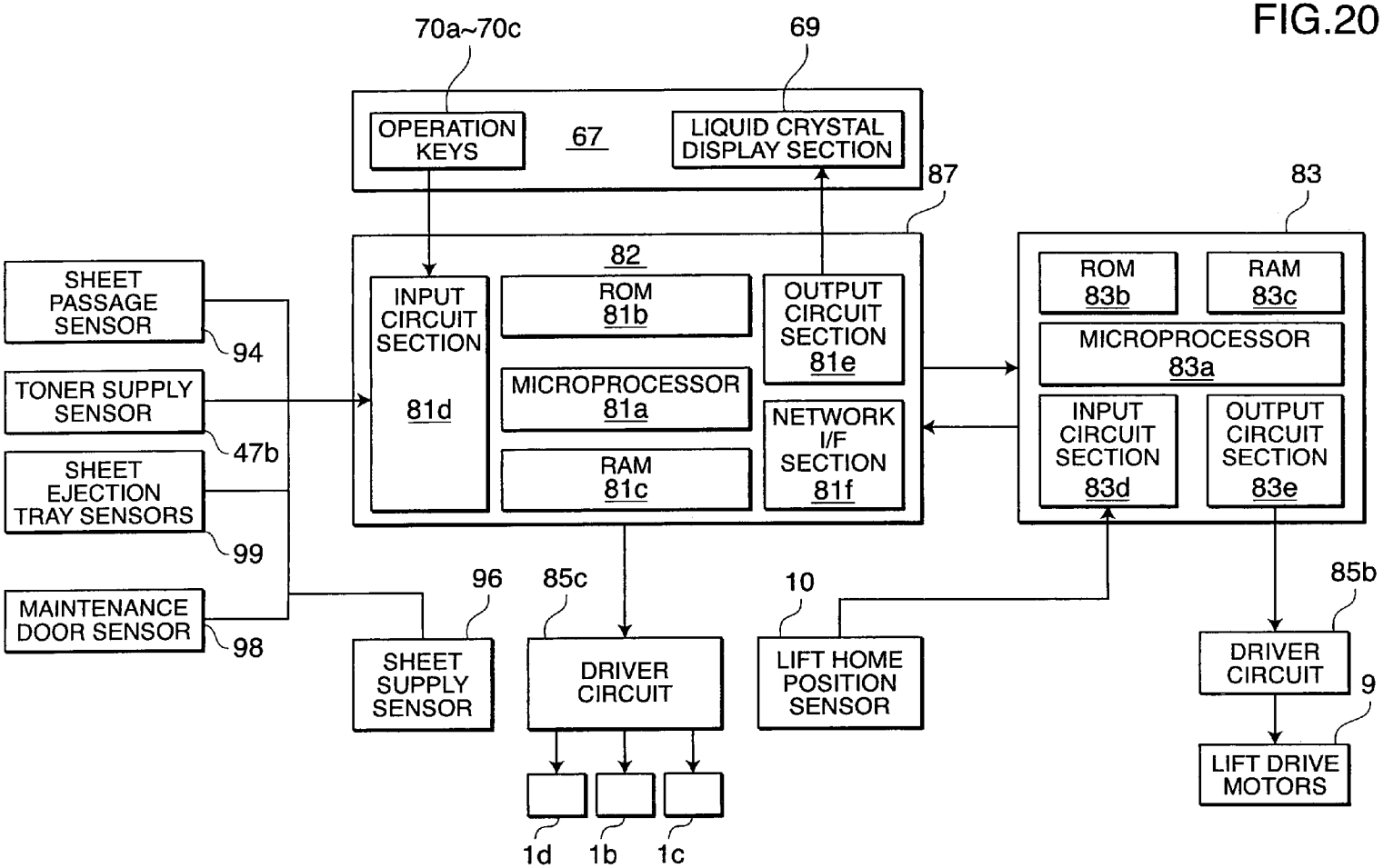
FIG. 20 is a diagram of a control circuit of Embodiment 1B.

FIG. 20 is a diagram illustrating a control circuit which controls the overall printing apparatus according to Embodiment 1B. As shown, the control circuit includes a main body control circuit 82 which controls the driving of the main body 1, i.e., the finisher section 1*d*, the printer section 1*b* and the sheet cassette section 1*c*, and a lift control circuit 83 which controls the driving of the lift drive motors 9.

The main body control circuit 82 includes a microprocessor 81*a*, a ROM 81*b*, a RAM 81*c*, an input circuit section 81*d* and an output circuit section 81*e* for input to and output from the microprocessor 81*a*, and a network interface section 81*f*. The main body control circuit 82 receives signals outputted from operation keys (a start key 70*a*, ten keys 70*b* and a reset key 70*c*) on the operation panel 67, a sheet passage sensor 94, sheet ejection tray sensors 99, a toner supply sensor 47*b*, a maintenance door sensor 98 and a sheet supply sensor 96, and outputs signals to a liquid crystal display section 69 of the operation panel 67 and to a driver circuit 85*c* which drives the finisher section 1*d*, the printer section 1*b* and the sheet cassette section 1*c*.

The main body control circuit 82 receives data of an image to be printed from the outside through the network interface section 81*f*. The image data is once stored in the RAM 81*c*, and outputted to the printer section 1*b*. When the image data is received, a massage indicating the reception of the image data is displayed on the liquid crystal display section 69.

The sheet ejection tray sensors 99 are respectively provided on the sheet ejection trays 65*a*, 65*b* (FIG. 19) for determining whether sheets are present on the sheet ejection trays 65*a*, 65*b*. The other sensors are located at the same positions and have the same sensor functions as in Embodiment 1A.

The operation panel 67 and the lift control circuit 83 shown in FIG. 20 are equivalent to those employed in Embodiment 1A.

An operation to be performed by the apparatus having the aforementioned construction will be described with reference to a flow chart shown in FIG. 21.

Figure 22:
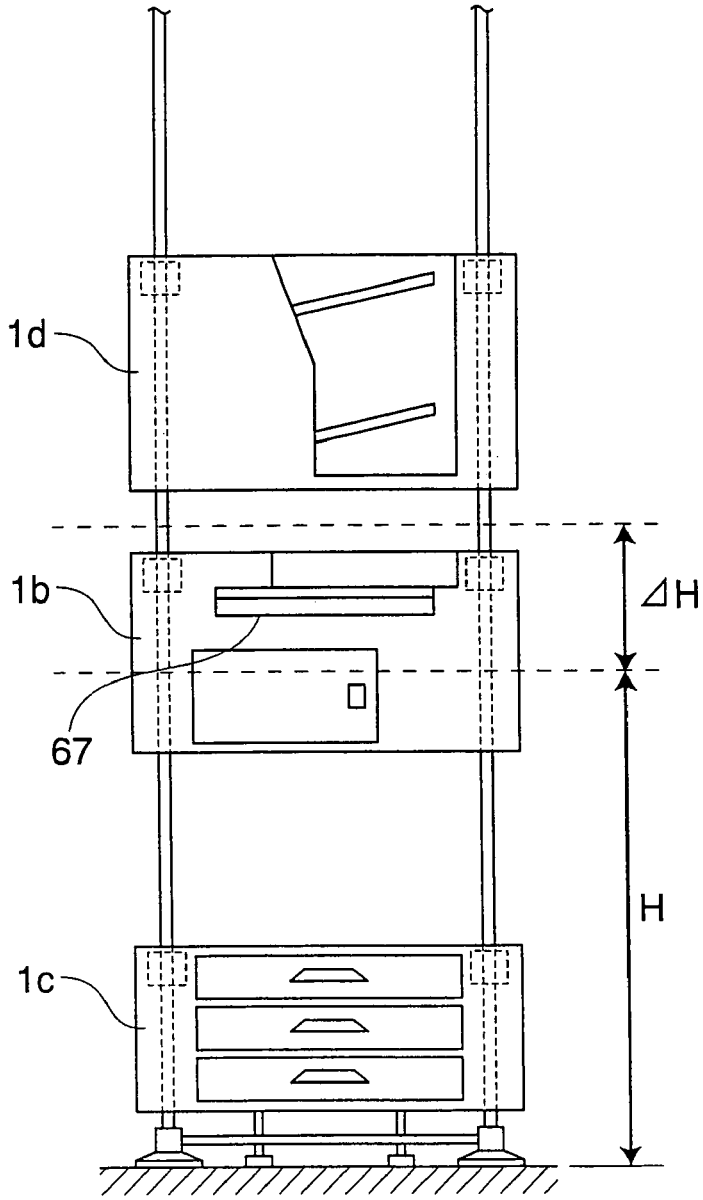
FIGS. 22 to 27 are diagrams for explaining the positions of respective sections shifted according to Embodiment 1B.

When the main body 1 is turned on at a position shown in FIGS. 18(*a*) and 18(*b*), an initializing operation such as warm-up of the printer section 1*b* is performed (Step S101). Upon completion of the initializing operation, the printer section 1*b* having the operation panel 67 is moved to an operation area ΔH as shown in FIG. 22 (Step S102). As in Embodiment 1A, the operation area is herein defined as an area at which the user can most easily perform an operation on the main body 1, and ranges from a height level H to a height level H+ΔH as measured from the floor 11. For example, H=100 cm and ΔH=30 cm.

Figure 23:
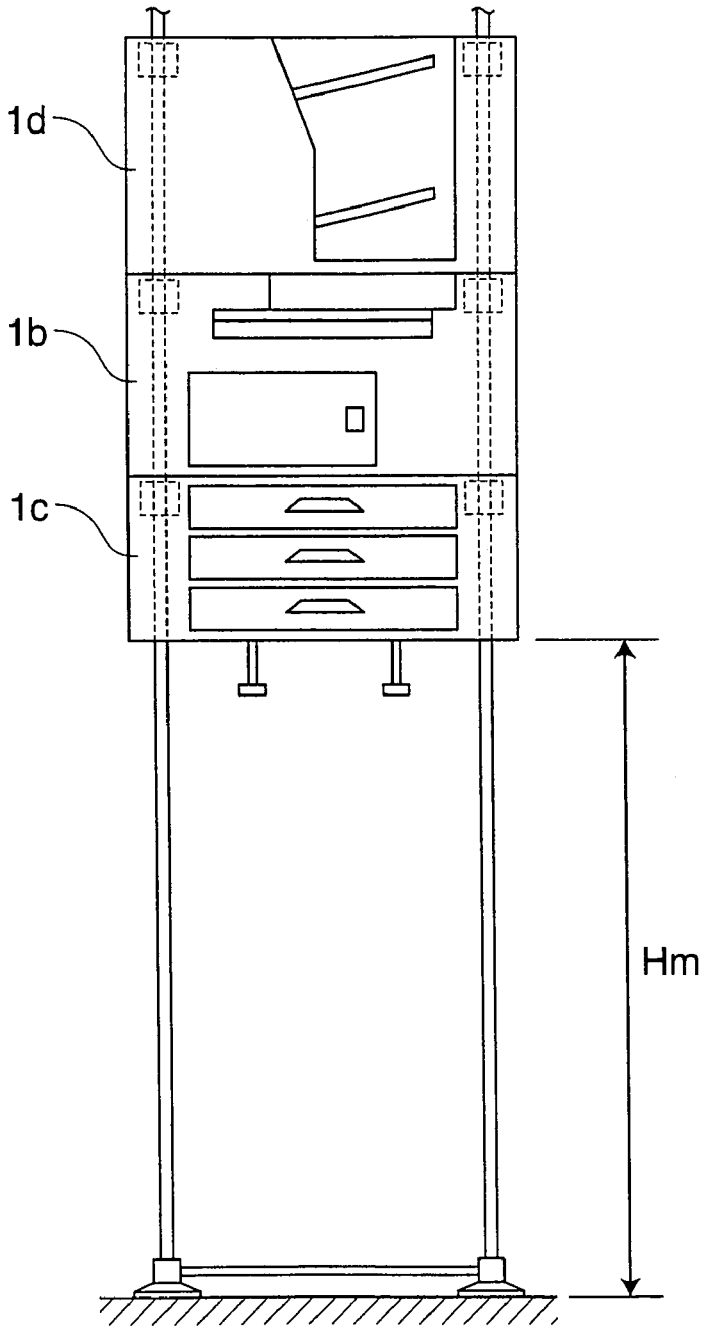

When an indication of reception of print data, i.e., data of an image to be printed, is displayed on the liquid crystal display section 69 of the operation panel 67 (Step S103), the number of sheets to be printed is inputted by the ten keys 70*b* of the operation panel 67 (Step S104). When the start key 70*a* is pressed (Step S105), the main body 1 is moved to an uppermost position Hm as shown in FIG. 23 (Step S106). The uppermost position Hm is herein set at Hm=150 cm, for example.

Figure 24:
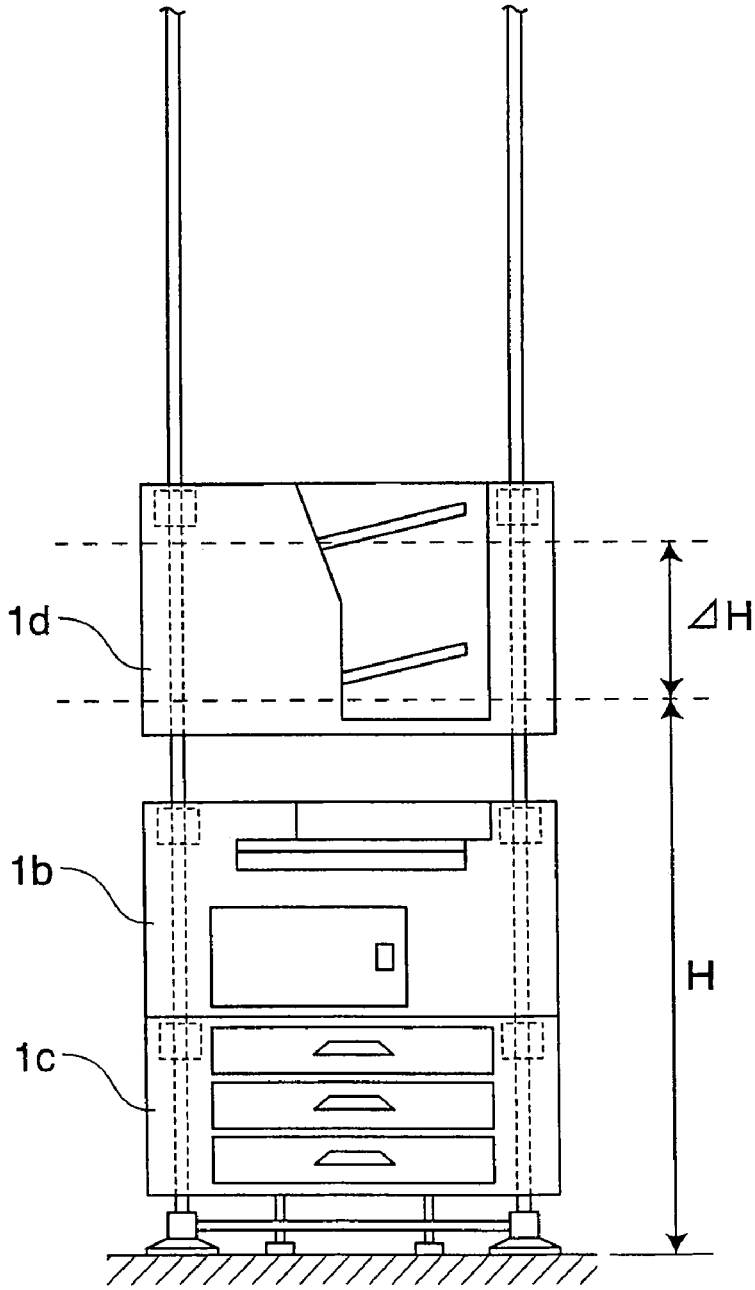

When the main body 1 reaches the uppermost position, a printing process is started (Step S107). Thus, the printing process can be stealthily performed. If the printing process is performed without interruption due to sheet depletion, toner depletion and sheet jamming (Steps S108 to S110) and the printed sheets are ejected into the sheet ejection tray 65*a* or 65*b* (FIG. 19) of the finisher section 1*d* (Step S111), the finisher section 1*d* is moved to the operation area ΔH as shown in FIG. 24 (Step S112). This movement notifies the user of the completion of the printing process. If the printed sheets are taken out (Step S113), the routine returns to Step S102, whereby the printer section 1*b* is moved to the operation area ΔH and kept in standby for the next printing process (Step S103).

Figure 25:
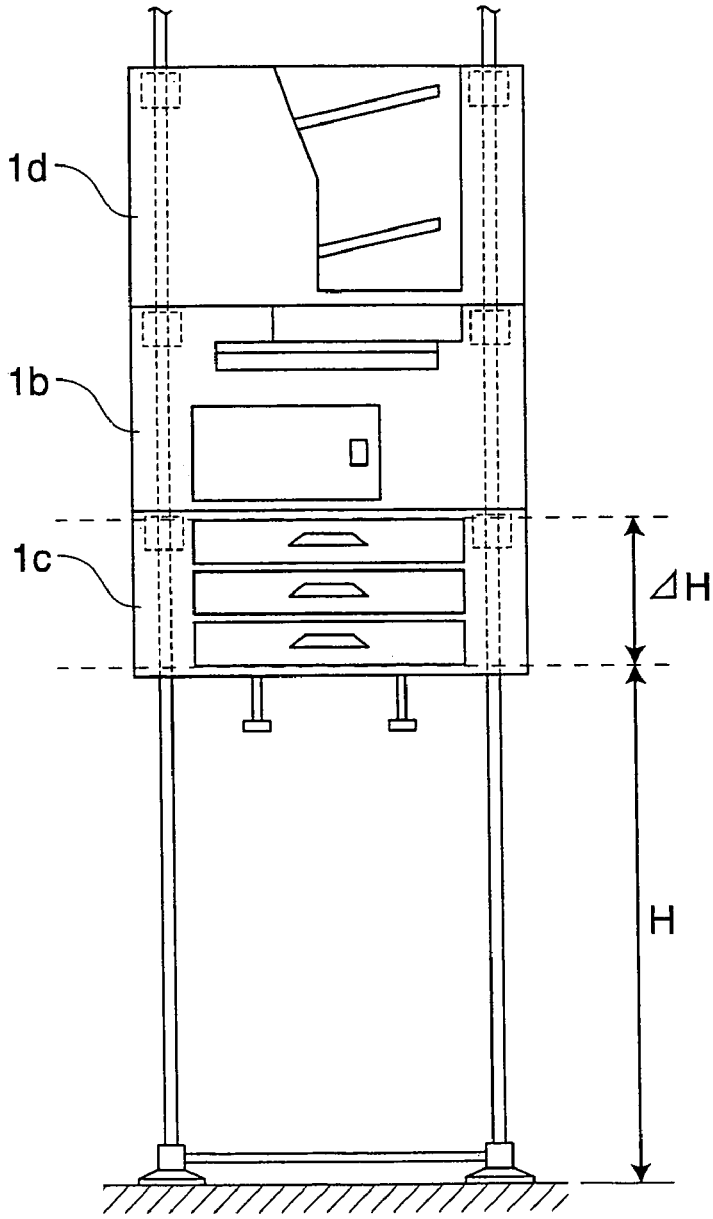

When the sheet depletion occurs in Step S108, the printing process is interrupted, and the sheet cassette section 1*c* is moved to the operation area ΔH as shown in FIG. 25 (Step S114). After the sheet cassette section 1*c* is replenished with sheets (Step S115), the routine returns to Step S106, whereby the main body 1 is moved to the uppermost position and the printing process is restarted (Step S107).

Figure 26:
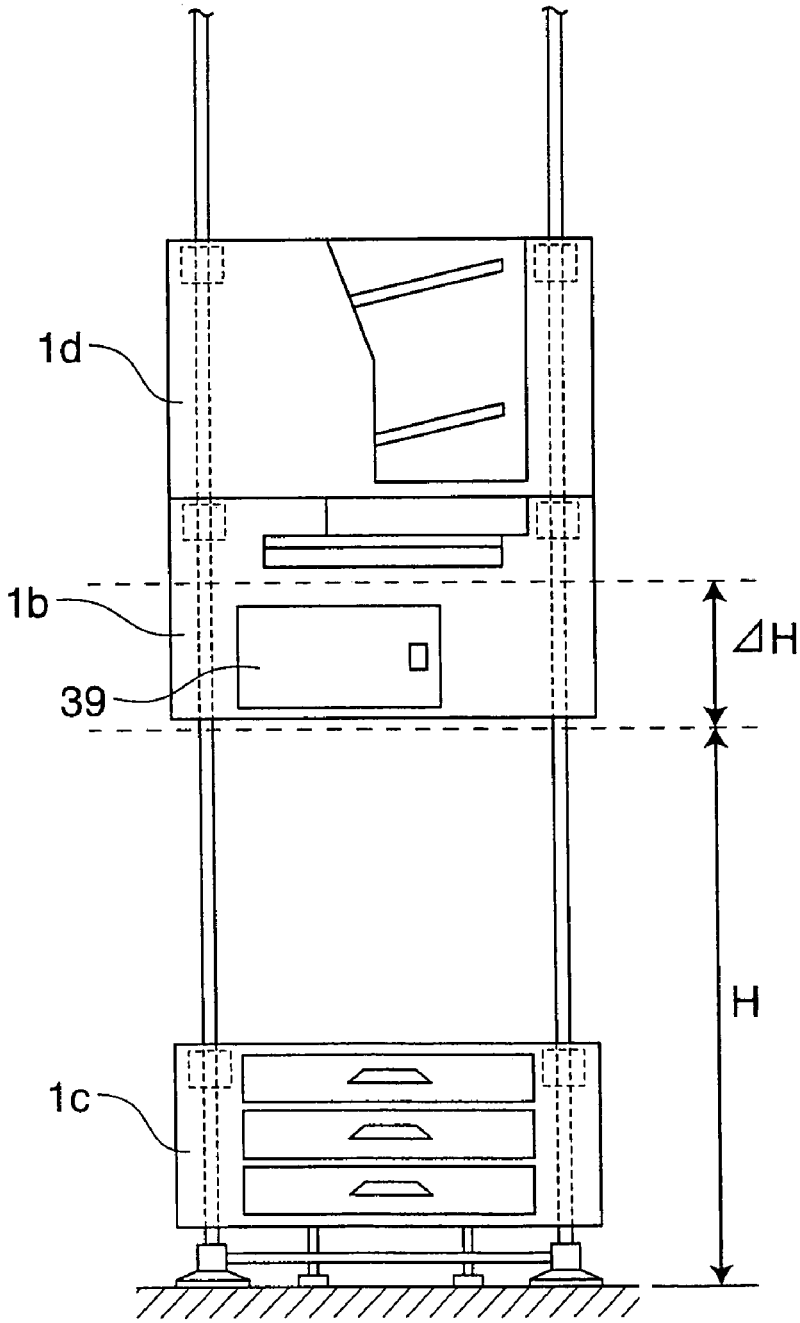

When the toner depletion occurs in Step S109, the printing process is interrupted, and the printer section 1*b* is moved to locate the maintenance door 39 in the operation area ΔH as shown in FIG. 26 (Step S116). After the toner container is replenished with toner (Step S117), the routine returns to Step S106.

Figure 27:
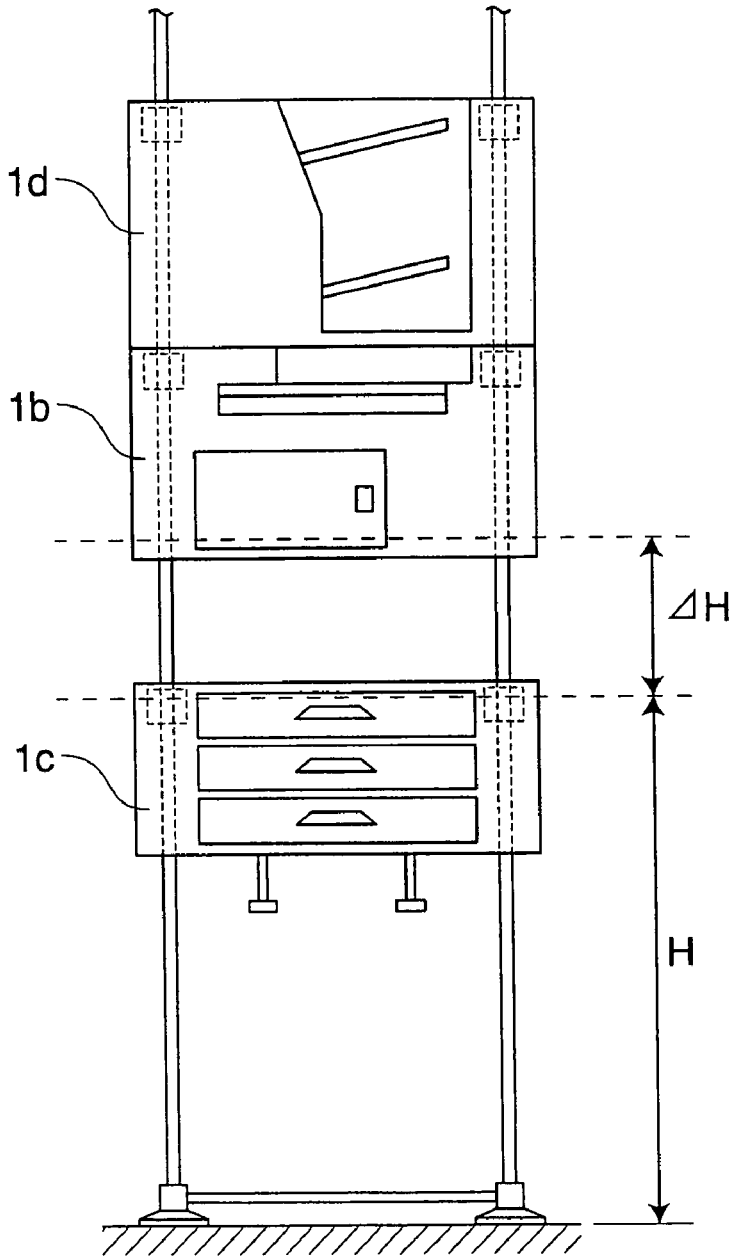

When a sheet jam occurs in Step S110, the printing process is interrupted, and an area of the apparatus suffering from the sheet jam is moved to the operation area ΔH as shown in FIG. 27 (Step S118). After a jammed sheet is removed, the routine returns to Step S106.

Thus, the lift control circuit 83 acquires the state of the progress of the image recording process from the main body control circuit 82, and moves the finisher section 1*d*, the printer section 1*b* and the sheet cassette section 1*c* according to the progress state. This facilitates the user's operation, and prevents a third person from looking at the printed sheets during the printing process.

Figure 21:
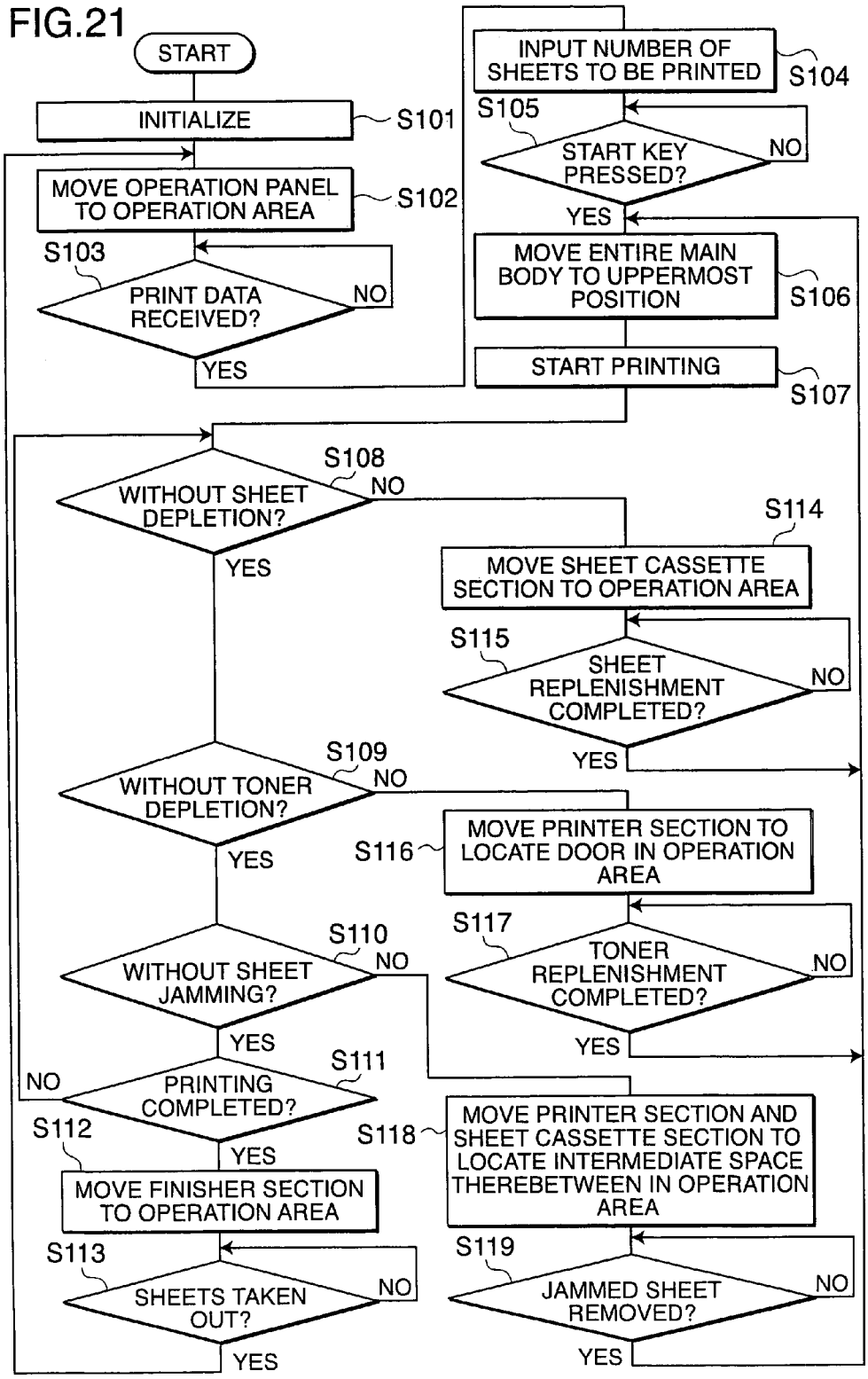
FIG. 21 is a flow chart showing an operation to be performed according to Embodiment 1B.
Figure 28:
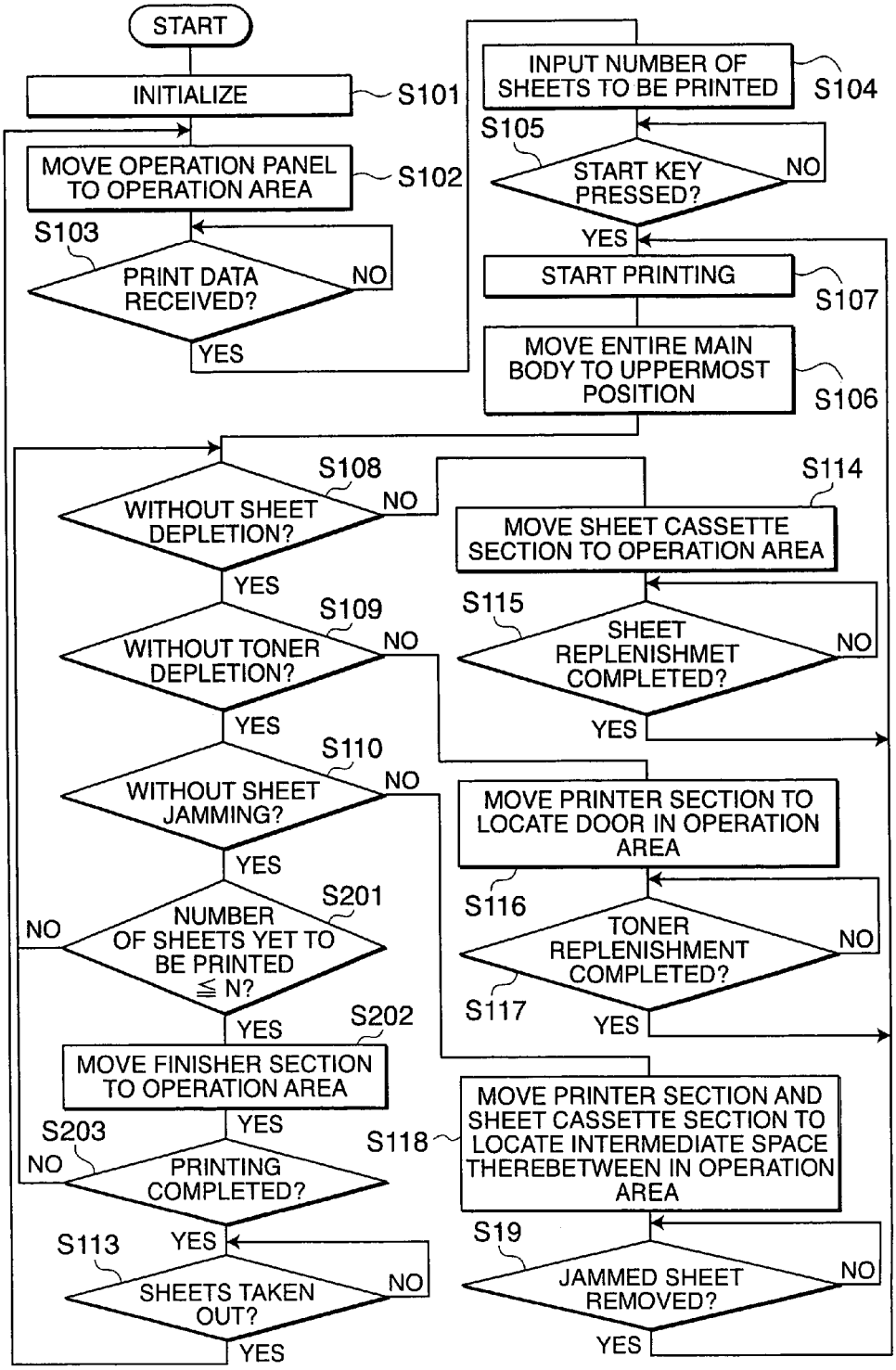
FIG. 28 is a flow chart showing a variation of the operation to be performed according to Embodiment 1B.

FIG. 28 is a flow chart showing a variation of the operation to be performed according to Embodiment 1B as corresponding to FIG. 21. In FIG. 28, Steps S106 and S107 shown in FIG. 21 are provided in reverse order, and Steps S201 to S203 are provided instead of Steps S111 and S112 shown in FIG. 21. In FIG. 28, when the start key 70*a* is pressed in Step S105, the printing process is started (Step S107), and then the printer section 1*b* is moved to the uppermost position (Step S106). Then, the finisher section 1*d* starts moving to the operation area ΔH (Step S202) when the number of sheets yet to be printed becomes N (Step S201) before the completion of the printing process (Step S203). The operation is performed in substantially the same manner as in FIG. 21 except for these steps.

Embodiment 2

An image forming apparatus according to this embodiment includes a first processing unit which performs a reading process for reading image data from a document original, a second processing unit which performs an image recording process for recording an image on a recording medium based on the read image data, a lift mechanism which holds the second processing unit at a higher level than the first processing unit and moves up and down the first and second processing units, a first control section which controls the processes performed by the first and second processing units, and a second control section which acquires the state of progress of the processes performed by the first and second processing units and controls the lift mechanism so as to move the first and second processing units to height levels according to the progress state.

The image forming apparatus is, for example, an electrophotographic copying apparatus which records an image on a recording medium based on image data obtained by scanning a document original.

Therefore, examples of the processing units according to this embodiment include a scanner section which reads image data by optically scanning a document original, a printer section which records an image on a recording medium based on the image data, a sheet cassette section which contains recording media and feeds the recording media to the printer section, and a finisher section which processes recording media subjected to the image recording process.

The lift mechanism is preferably capable of individually moving up the first and second processing units. The lift mechanism preferably includes, for example, a post disposed upright on a floor and having a male thread provided on a circumferential surface thereof, a nut having a female thread meshed with the male thread of the post, and a drive source which rotates the nut.

The first and second control sections may each include a microprocessor including a CPU, a ROM and a RAM.

The second control section may locate the second processing unit at a first position in standby during the reading process performed by the first processing unit.

The second control section may move the second processing unit to a second position which is lower than the first position upon completion of the image recording process performed by the second processing unit.

The second control section may start moving the second processing unit to the second position which is lower than the first position before the completion of the image recording process performed by the second processing unit.

When the second processing unit becomes unable to continue the image recording process or the image recording process is interrupted, the second control section may move the second processing unit to the second position which is lower than the first position.

When the second processing unit is in standby or performs the image recording process, the second control section may locate the second processing unit at the first position.

When the image recording process once interrupted is restarted by the second processing unit, the second control section may move the second processing unit to the first position.

The image forming apparatus may further include a manual operation section which causes the second control section to vertically move the second processing unit.

The image forming apparatus may further include an informing section which gives information on the vertical movement state of the second processing unit.

Embodiment 2 of the present invention will hereinafter be described in detail with reference to the attached drawings. However, it should be understood that the invention be not limited to this embodiment. In the figures, like components will be denoted by like reference characters.

Figure 29:
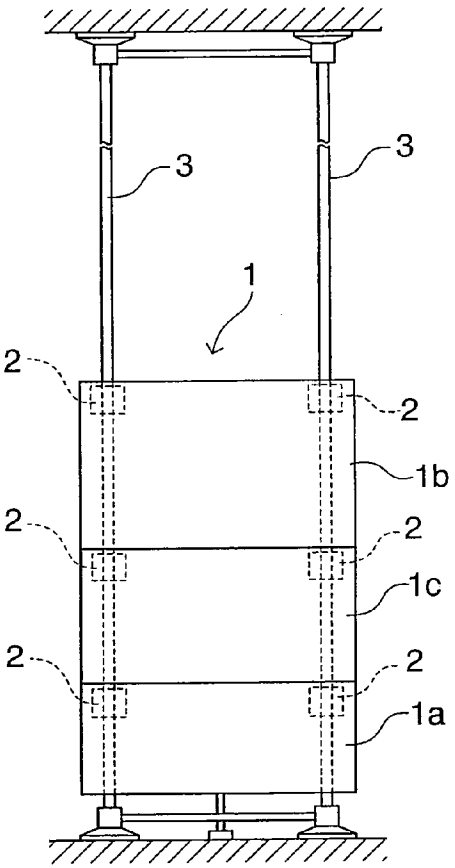
FIGS. 29(*a*) and 29(*b*) are a front view and a side view, respectively, illustrating Embodiment 2 of the present invention.
Figure 29:
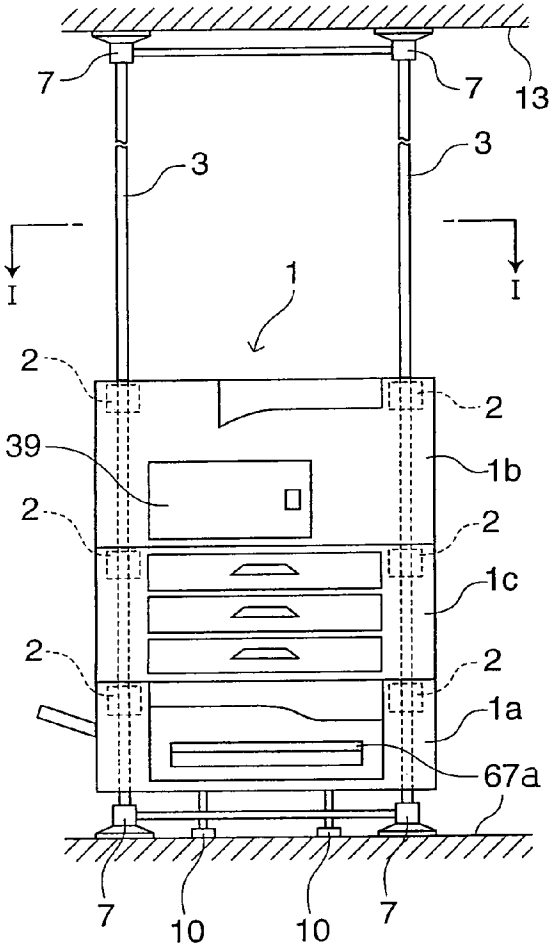
Figure 30:
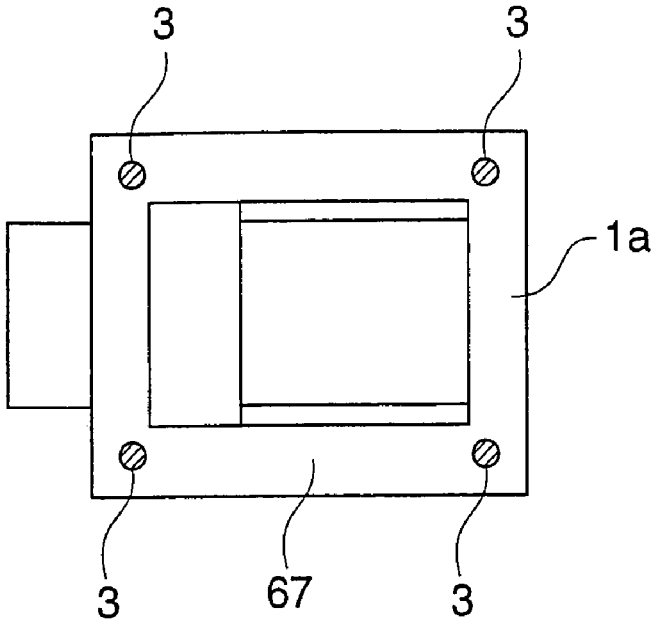
FIG. 30 is a sectional view as seen in an arrow direction I-I in FIG. 29(*a*).

FIGS. 29(*a*) and 29(*b*) are a front view and a side view, respectively, illustrating an electrophotographic copying apparatus (copier) according to Embodiment 2, and FIG. 30 is a sectional view as seen in an arrow direction I-I in FIG. 29(*a*). As shown, a main body 1 of the copying apparatus includes a scanner section 1*a*, a sheet cassette section 1*c* and a printer section 1*b*, which are stacked one on another in this order, and four posts 3 respectively extend through four corners of each of these sections. The posts 3 each have a lower end and an upper end, which are respectively fixed to a floor 11 and a ceiling 13 via fixing members 7. The scanner section 1*a*, the printer section 1*b* and the sheet cassette section 1*c* each include lift mechanisms 2 respectively engaged with the posts 3, and are individually movable up and down along the posts 3. The scanner section 1*a* includes an operation panel 67*a*. The lift mechanisms 2 each have the same construction as in Embodiment 1A (FIG. 3).

The scanner section 1*a*, the printer section 1*b* and the sheet cassette section 1*c* each have the same construction and functions as in Embodiment 1A (FIGS. 4, 5 and 6).

Figure 31:
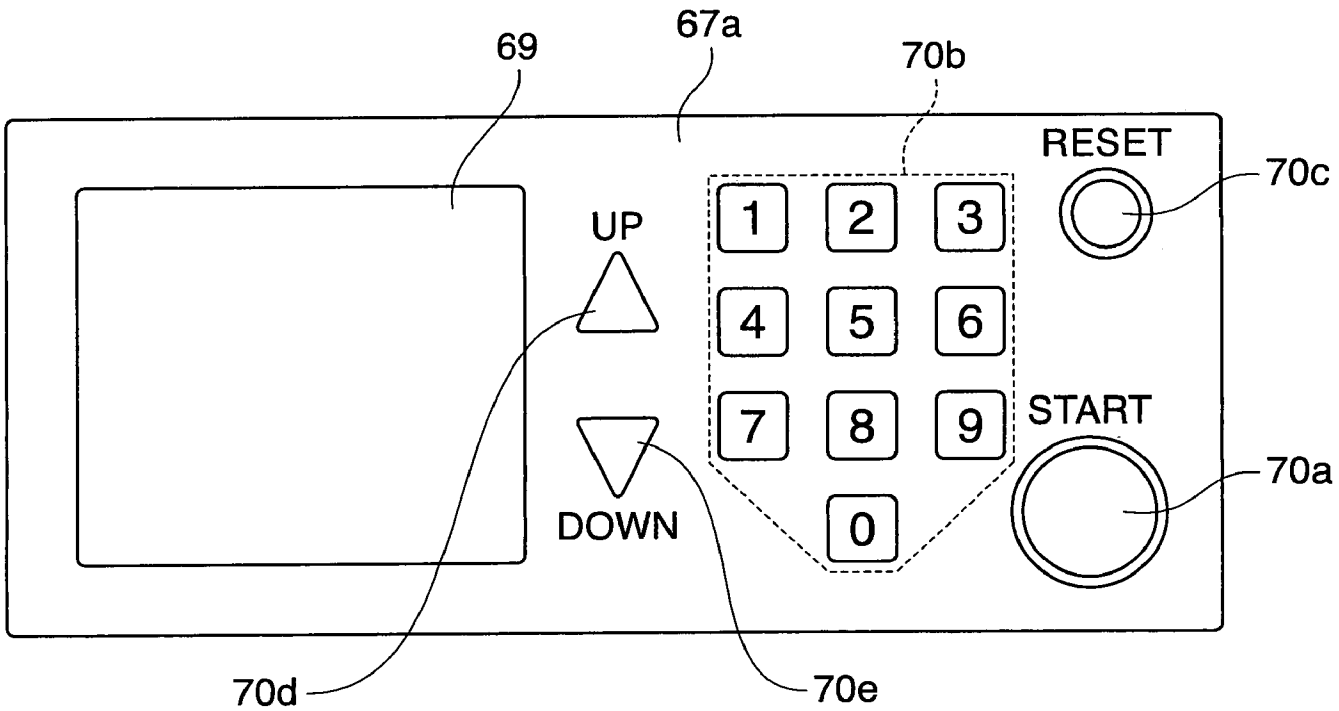
FIG. 31 is a top plan view of a major portion of Embodiment 2.

FIG. 31 is a front view of the operation panel 67*a*. The operation panel 67*a* is attached to a front face of the scanner section 1*a* as shown in FIG. 29(*a*). The operation panel 67*a* includes a liquid crystal display section 69 which displays the number of sheets to be printed and messages indicating toner depletion, sheet depletion, sheet jamming and the vertical movement state of the printer section 1*b*, a start key 70*a*, ten keys 70*b* to be used for inputting the number of sheets to be printed, a reset key 70*c* to be used for resetting the number of sheets to be printed, and an UP key 70*d* and a DOWN key 70*e* to be used for manually controlling the vertical movement of the printer section 1*b*.

Figure 32:
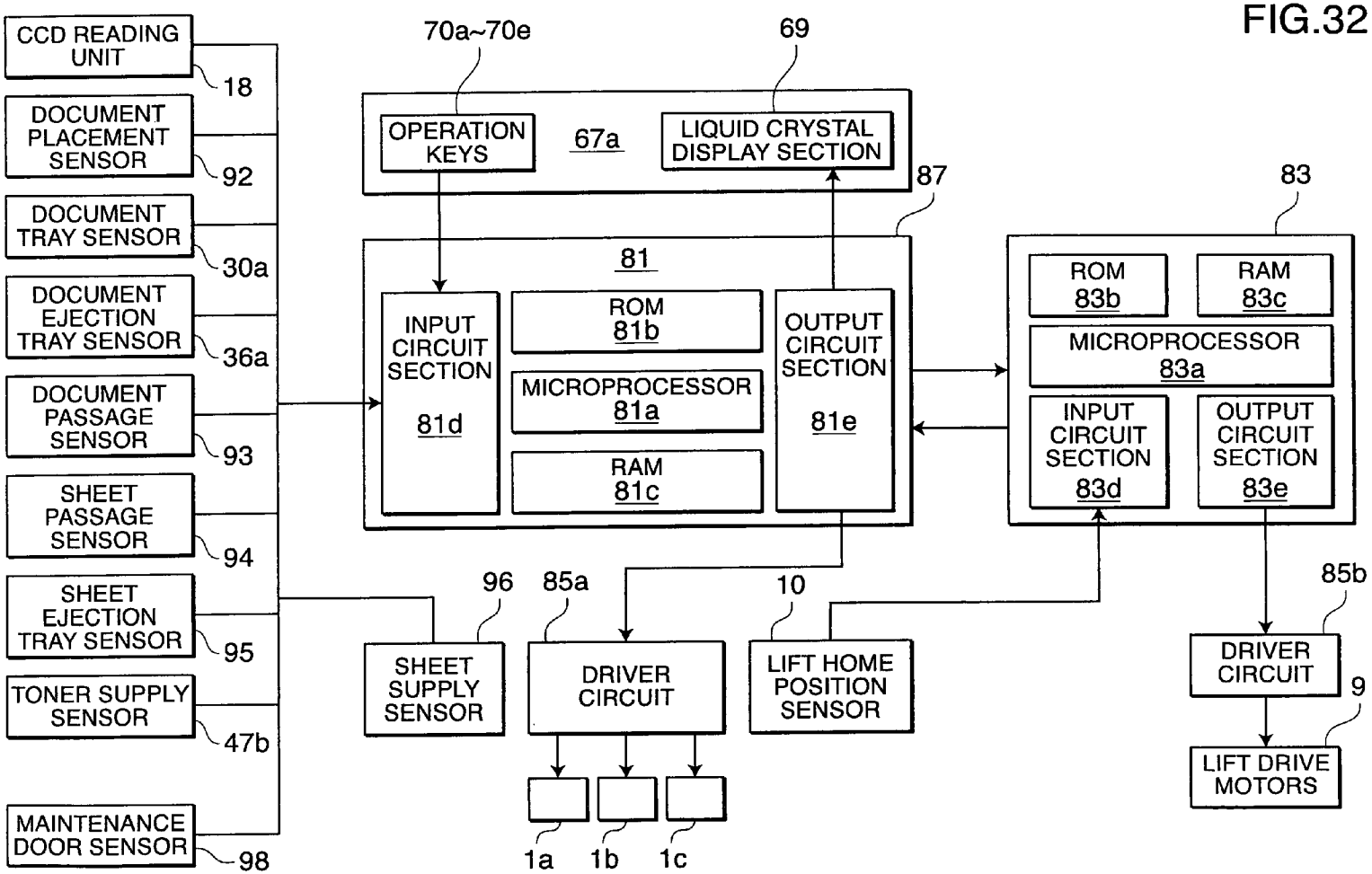
FIG. 32 is a diagram of a control circuit of Embodiment 2.

FIG. 32 is a diagram illustrating a control circuit which controls the overall electrophotographic copying apparatus according to Embodiment 2. As shown, the control circuit includes a main body control circuit 81 which controls the driving of the main body 1, i.e., the scanner section 1*a*, the printer section 1*b* and the sheet cassette section 1*c*, and a lift control circuit 83 which controls the driving of the lift drive motors 9. The control circuit shown in FIG. 32 has substantially the same circuit configuration as that shown in FIG. 8, except that the operation panel 67 is replaced with the operation panel 67*a*.

An operation to be performed by the apparatus having the aforementioned construction will be described with reference to a flow chart shown in FIG. 33.

Figure 34:
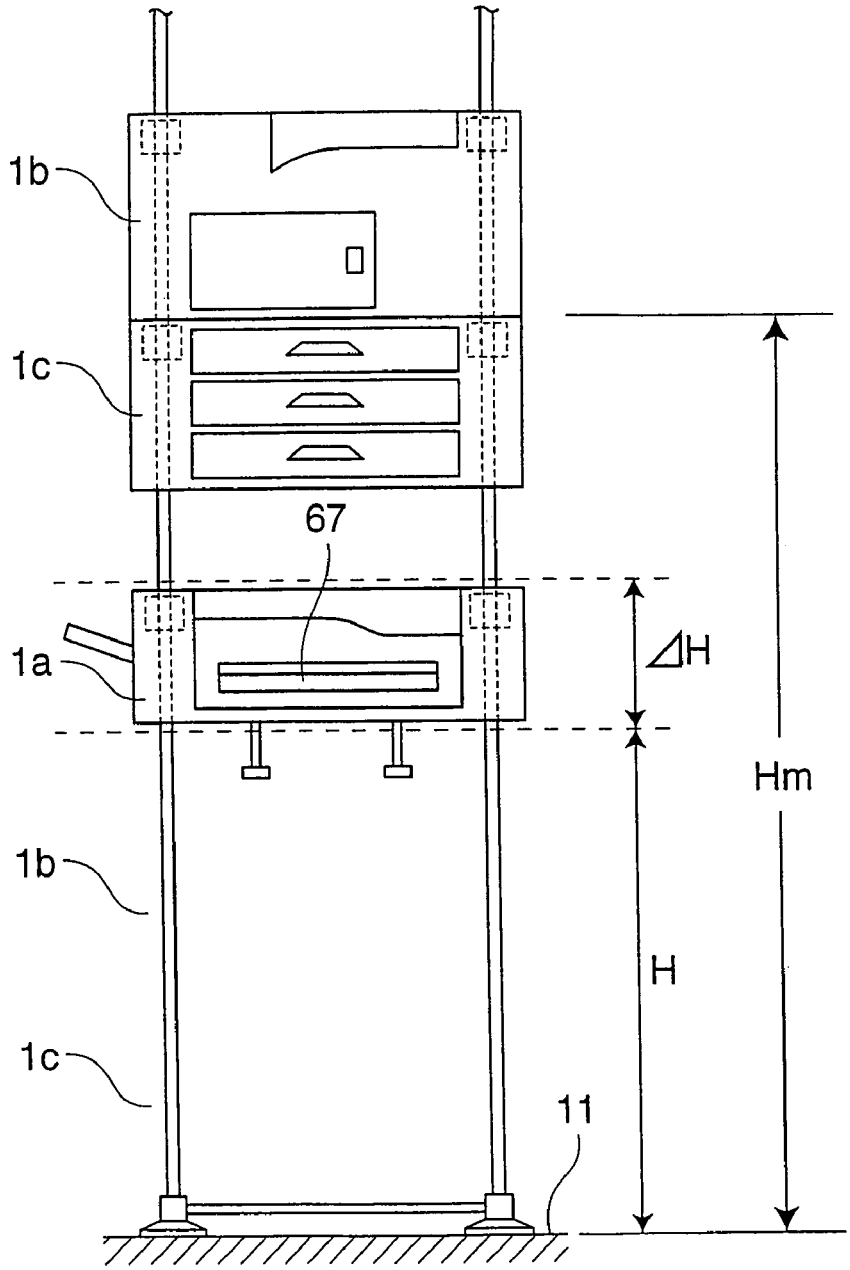
FIGS. 34 to 38 are diagrams for explaining the positions of respective sections shifted according to Embodiment 2.

When the main body 1 is turned on at a position shown in FIGS. 29(*a*) and 29(*b*), an initializing operation such as warm-up of the printer section 1*b* is performed (Step S1). Upon completion of the initializing operation, the scanner section 1*a* having the operation panel 67*a* is moved to an operation area ΔH as shown in FIG. 34, and the printer section 1*b* is moved up to a height level Hm (Step S2). At this time, the liquid crystal display section 69 (FIG. 31) of the operation panel 67*a* displays an indication that the printer section 1*b* is located at the height level Hm. The operation area is herein defined as an area at which the user can most easily perform an operation on the main body 1, and ranges from a height level H to a height level H+ΔH as measured from the floor 11. For example, H=100 cm, ΔH=30 cm, and Hm=150 cm. The height level Hm allows the user to recognize from a distance that the printer section 1*b* is performing the process, and prevents a third person from looking at the printed sheets.

Figure 35:
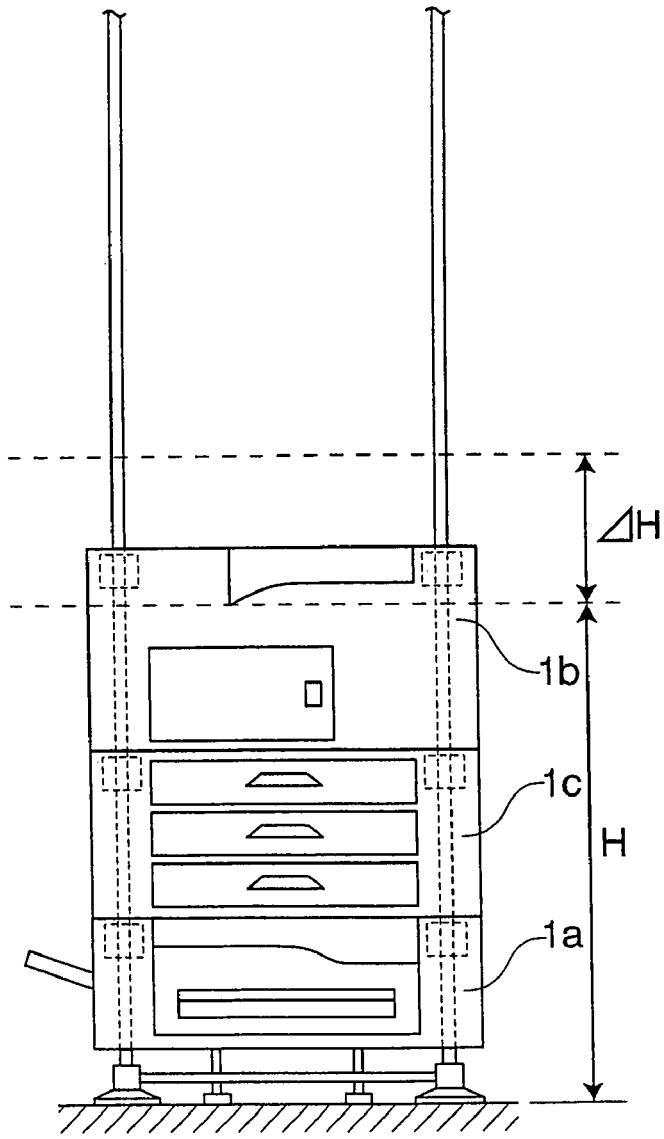

Then, a document original is set in the scanner section 1*a* (Step S3), and the number of sheets to be printed is inputted by the ten keys 70*b* of the operation panel 67*a* (Step S4). When the start key 70*a* is pressed (Step S5), a reading process is performed in the scanner section 1*a* (Step S6). When the document original is thereafter removed (Step S7), a printing process is started (Step S8). If the printing process is performed without interruption due to sheet depletion, toner depletion and sheet jamming (Steps S9 to S11) and the printing on the inputted number of sheets is completed (Step S12), the sheet ejection tray 63 provided in an upper portion of the printer section 1*b* is moved to the operation area ΔH as shown in FIG. 35 (Step S13). If the printed sheets are taken out of the sheet ejection tray 63 of the printer section 1*b* (Step S14), the routine returns to Step S2, whereby the scanner section 1*a* and the printer section 1*b* are moved back to the positions shown in FIG. 34 and kept in standby for the setting of the next document original (Step S3).

Figure 36:
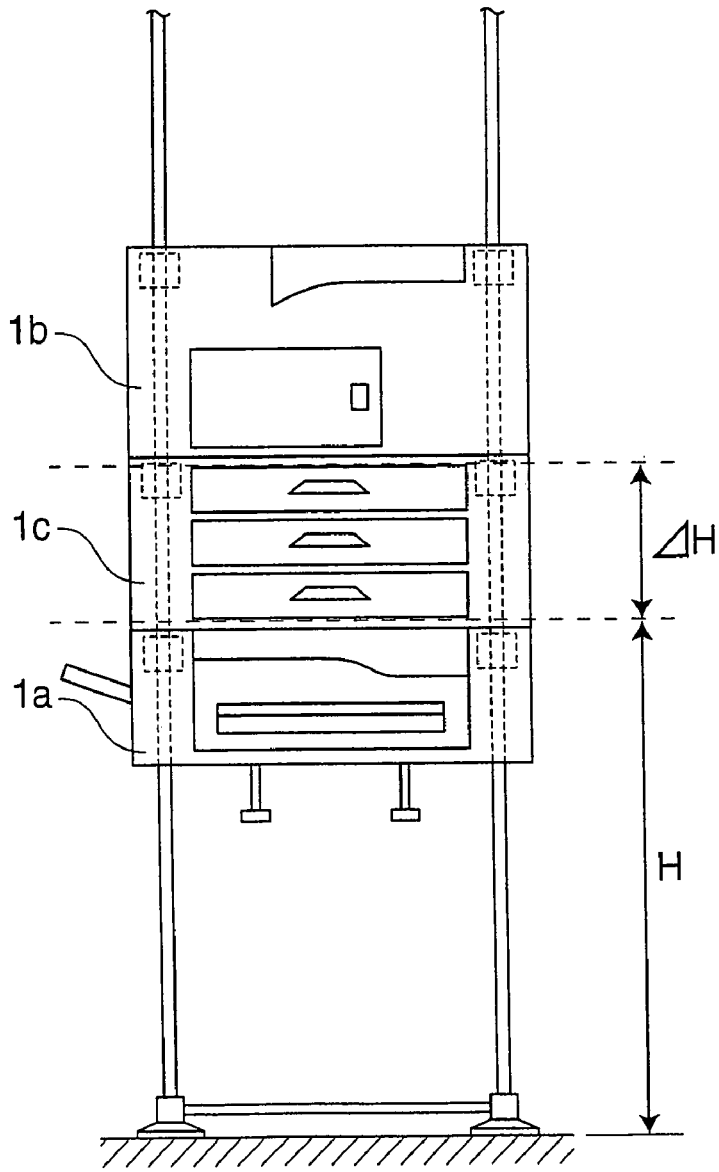

When the sheet depletion occurs to result in inability to continue the printing process in Step S9, the printing process is interrupted, and the sheet cassette section 1*c* is moved to the operation area ΔH as shown in FIG. 36 (Step S15). After the sheet cassette section 1*c* is replenished with sheets (Step S16), the routine returns to Step S8, whereby the printing process is restarted.

Figure 37:
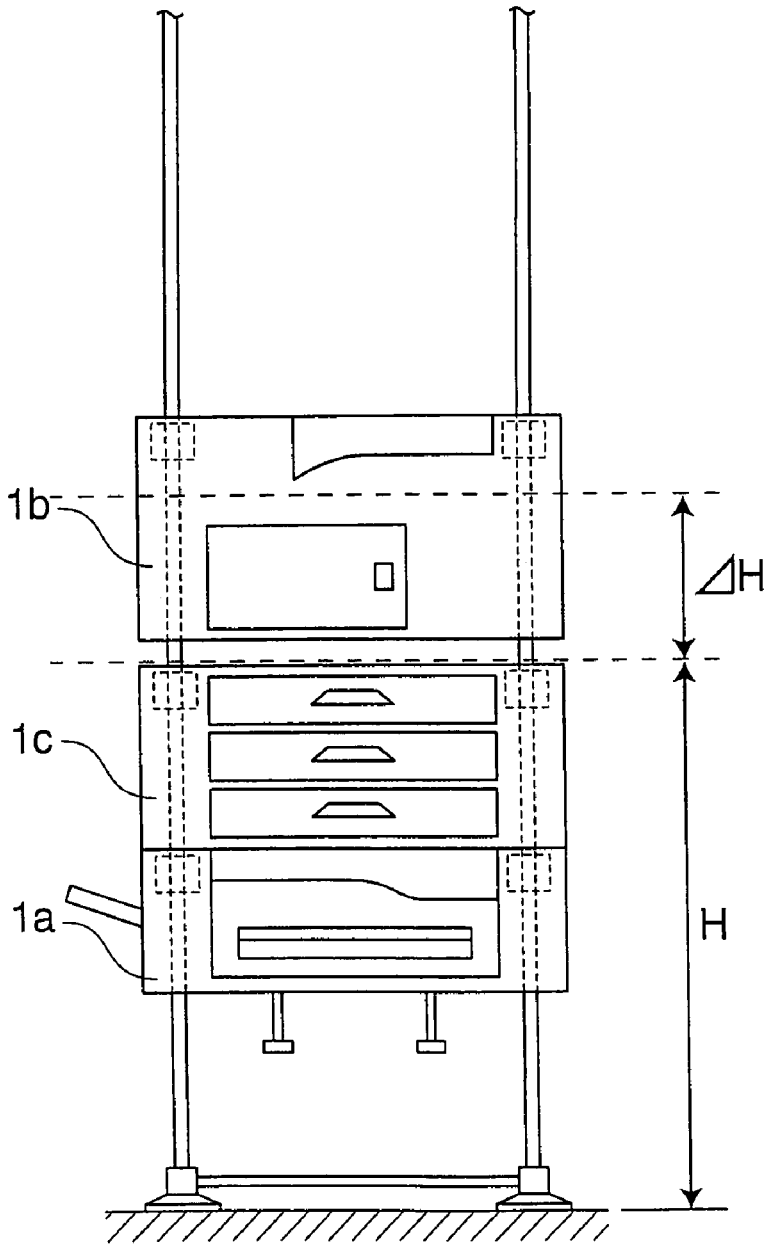

When the toner depletion occurs to result in inability to continue the printing process in Step S10, the printing process is interrupted, and the printer section 1*b* is moved to locate the maintenance door 39 in the operation area ΔH as shown in FIG. 37 (Step S17). After the toner container is replenished with toner through the maintenance door 39 (Step S18), the routine returns to Step S8.

Figure 38:
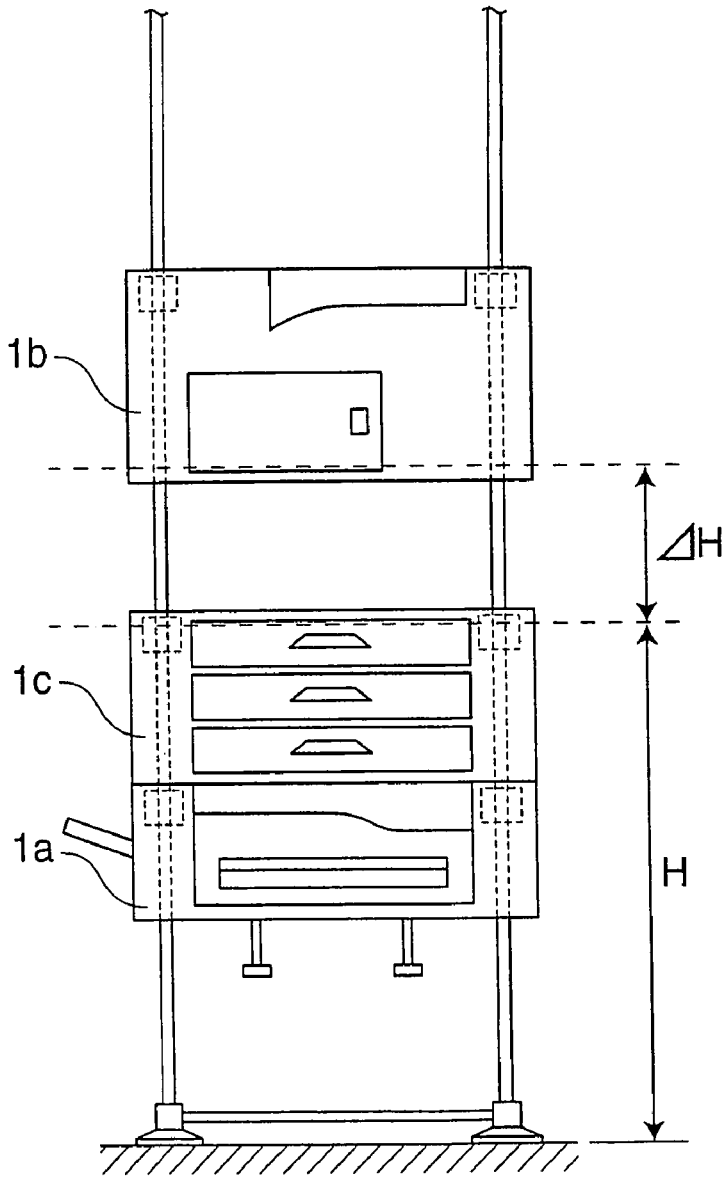

When a sheet jam occurs to result in inability to continue the printing process in Step S11, the printing process is interrupted, and an area of the apparatus suffering from the sheet jam is moved to the operation area ΔH as shown in FIG. 38 (Step S19). After a jammed sheet is removed (Step S20), the routine returns to Step S8.

Thus, the lift control circuit 83 acquires the state of the progress of the image recording process from the main body control circuit 81, and moves the scanner section 1*a*, the printer section 1*b* or the sheet cassette section 1*c* to a position which facilitates the user's operation according to the progress state.

Further, the printer section 1*b* can be manually moved up and down by operating the UP key 70*d* and the DOWN key 70*e* of the operation panel 67*a*. At this time, an indication of the upward and downward movement is displayed on the liquid crystal display section 69.

Figure 33:
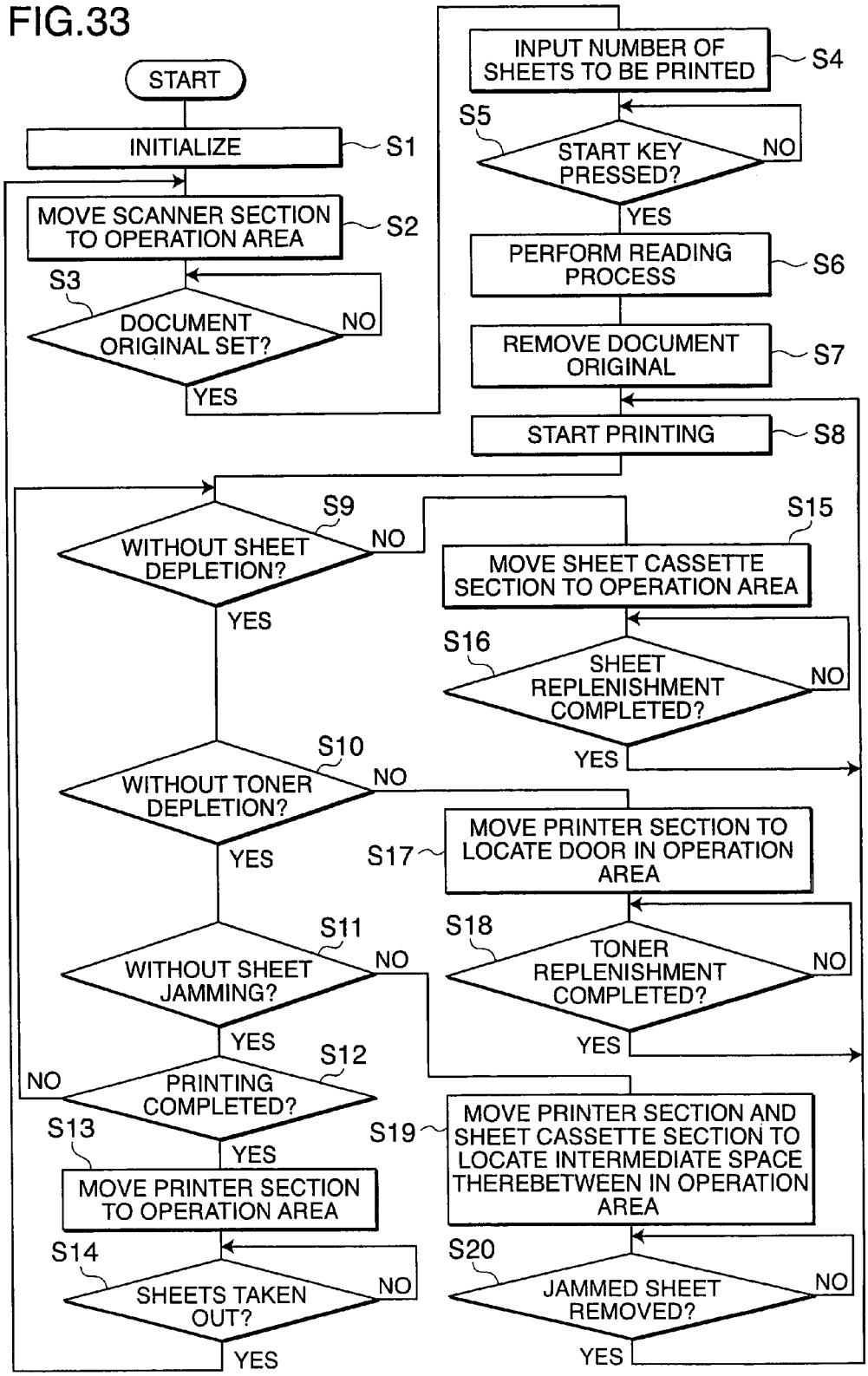
FIG. 33 is a flow chart showing an operation to be performed according to Embodiment 2.
Figure 39:
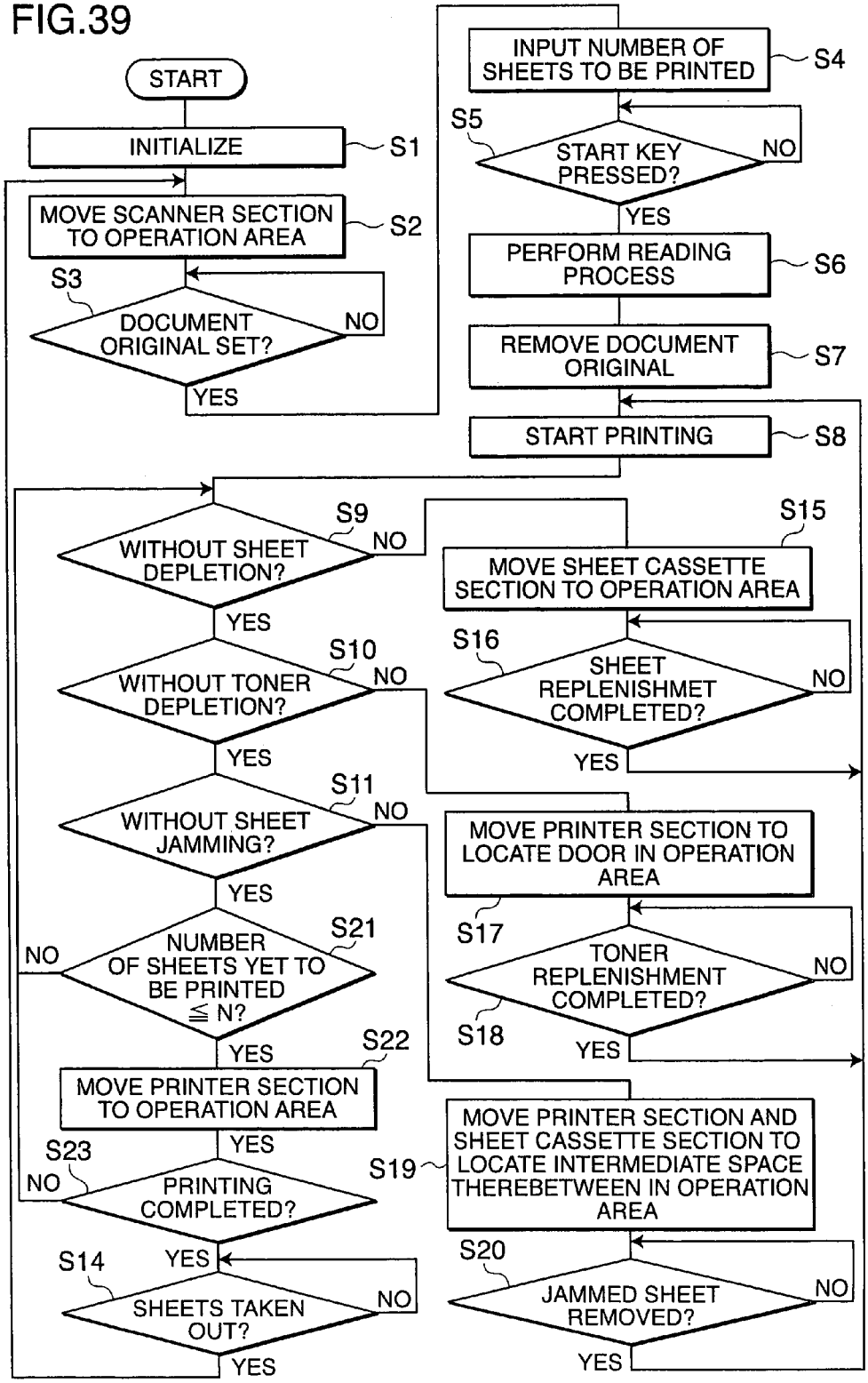
FIG. 39 is a flow chart showing a variation of the operation to be performed according to Embodiment 2.

FIG. 39 is a flow chart showing a variation of the operation to be performed according to Embodiment 2 as corresponding to FIG. 33. In FIG. 39, Steps S21 to S23 are provided instead of Steps S12 and S13 shown in FIG. 33. Therefore, the printer section 1*b* starts moving to the operation area ΔH (Step S22) when the number of sheets yet to be printed becomes N (Step S21) before the completion of the printing process (Step S23). The operation is performed in substantially the same manner as in FIG. 33 except for these steps.

Figure 40:
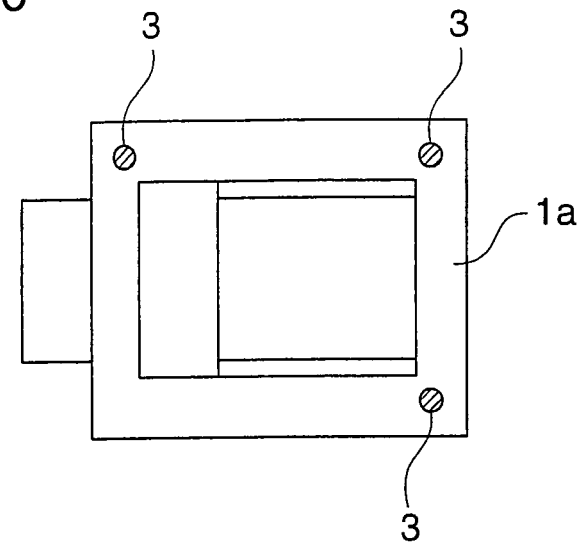
FIG. 40 is a diagram illustrating a variation of Embodiment 2 as corresponding to FIG. 30.
Figure 41:
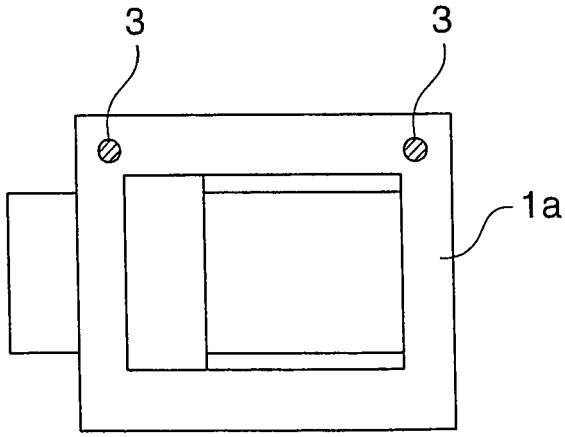
FIG. 41 is a diagram illustrating another variation of Embodiment 2 as corresponding to FIG. 30.

FIGS. 40 and 41 are diagrams illustrating structural variations of Embodiment 2 as corresponding to FIG. 30. Particularly, FIG. 40 illustrates a case in which three posts 3 are provided, and FIG. 41 illustrates a case in which two posts are provided.

Embodiment 3

An image forming apparatus according to this embodiment includes a processing unit which performs an image recording process for recording an image on a recording medium based on image data, a movement mechanism which moves the processing unit, a first control section which controls the image recording process performed by the processing unit, and a second control section which acquires the state of progress of the image recording process and controls the movement mechanism so as to move the processing unit to a position according to the progress state.

Examples of the image forming apparatus include an electrophotographic copying apparatus which records an image on a recording medium based on image data obtained by scanning a document original, and a laser printer and an ink jet printer which record an image on a recording medium based on image data applied thereto.

A lift mechanism capable of moving up and down the processing unit is preferably used as the movement mechanism. The lift mechanism preferably includes, for example, a post disposed upright on a floor and having a male thread provided on a circumferential surface thereof, a nut having a female thread meshed with the male thread of the post, and a drive source which rotates the nut.

The first and second control sections may each include a microprocessor including a CPU, a ROM and a RAM.

Examples of the processing unit include a scanner unit, a printer unit, a sheet supply unit and a finisher unit, which may be selectively employed in combination.

That is, a scanner unit which performs a reading process for reading image data from a document original and a printer unit which performs an image recording process for recording an image on a recording medium based on the read image data may be used in combination as the processing unit.

The printer unit and a finisher unit which processes recording media subjected to the recording process may be used in combination as the processing unit.

The printer unit and a sheet supply unit which supplies a recording medium to the printer unit may be used in combination as the processing unit.

The second control section may move the processing unit to a first position upon completion of the process performed by the processing unit, or may start moving the processing unit to the first position before the completion of the process performed by the processing unit.

When the processing unit becomes unable to continue the process or the process is interrupted, the second control section may move the processing unit to the first position.

The second control section may move the processing unit to a second position which is higher than the first position during the process performed by the processing unit.

When the process once interrupted is restarted by the processing unit, the second control section may move the processing unit to the second position which is higher than the first position.

Embodiment 3 of the present invention will hereinafter be described in detail with reference to the attached drawings. It should be understood that the invention be not limited to this embodiment. In the figures, like components will be denoted by like reference characters.

Figure 42:
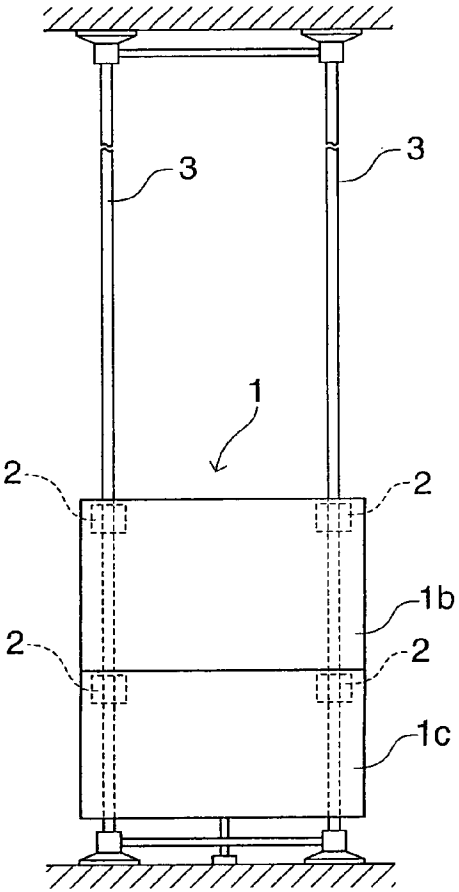
FIGS. 42(*a*) and 42(*b*) are a front view and a side view, respectively, illustrating Embodiment 3 of the present invention.
Figure 42:
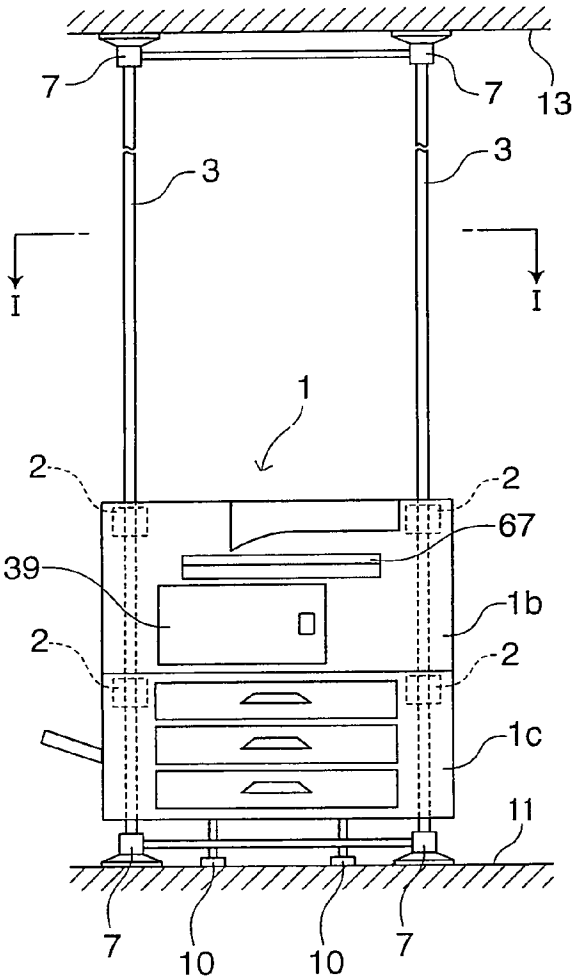
Figure 43:
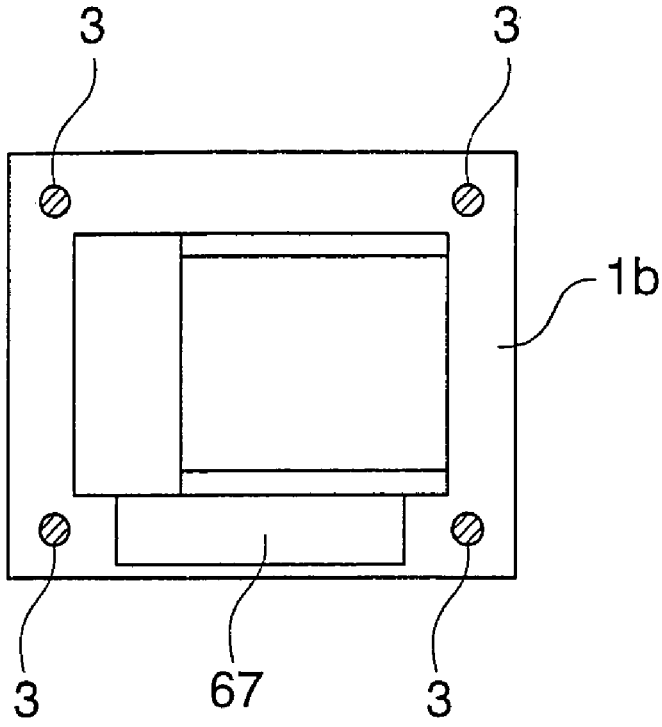
FIG. 43 is a sectional view as seen in an arrow direction I-I in FIG. 42(*a*).

FIGS. 42(*a*) and 42(*b*) are a front view and a side view, respectively, illustrating a printing apparatus (printer) according to Embodiment 3, and FIG. 43 is a sectional view as seen in an arrow direction I-I in FIG. 42(*a*). As shown, a main body 1 of the printing apparatus includes a printer section 1*b* and a sheet cassette section 1*c*. The printer section 1*b* includes an operation panel 67. The printer section 1*b* and the sheet cassette section 1*c* are stacked one on another, and four posts 3 respectively extend through four corners of each of these sections. The posts 3 each have a lower end and an upper end, which are respectively fixed to a floor 11 and a ceiling 13 via fixing members 7. The printer section 1*b* and the sheet cassette section 1*c* each include lift mechanisms 2 respectively engaged with the posts 3, and are individually movable up and down along the posts 3. The lift mechanisms 2 each have the same construction as in Embodiment 1A (FIG. 3).

The printer section 1*b* and the sheet cassette section 1*c* each have the same construction and functions as in Embodiment 1A (FIGS. 5 and 6).

The operation panel 67 is fixed to a front face of the printer section 1*b* as shown in FIGS. 42(*a*) and 43. The operation panel 67 has the same construction as that shown in FIG. 7.

Figure 44:
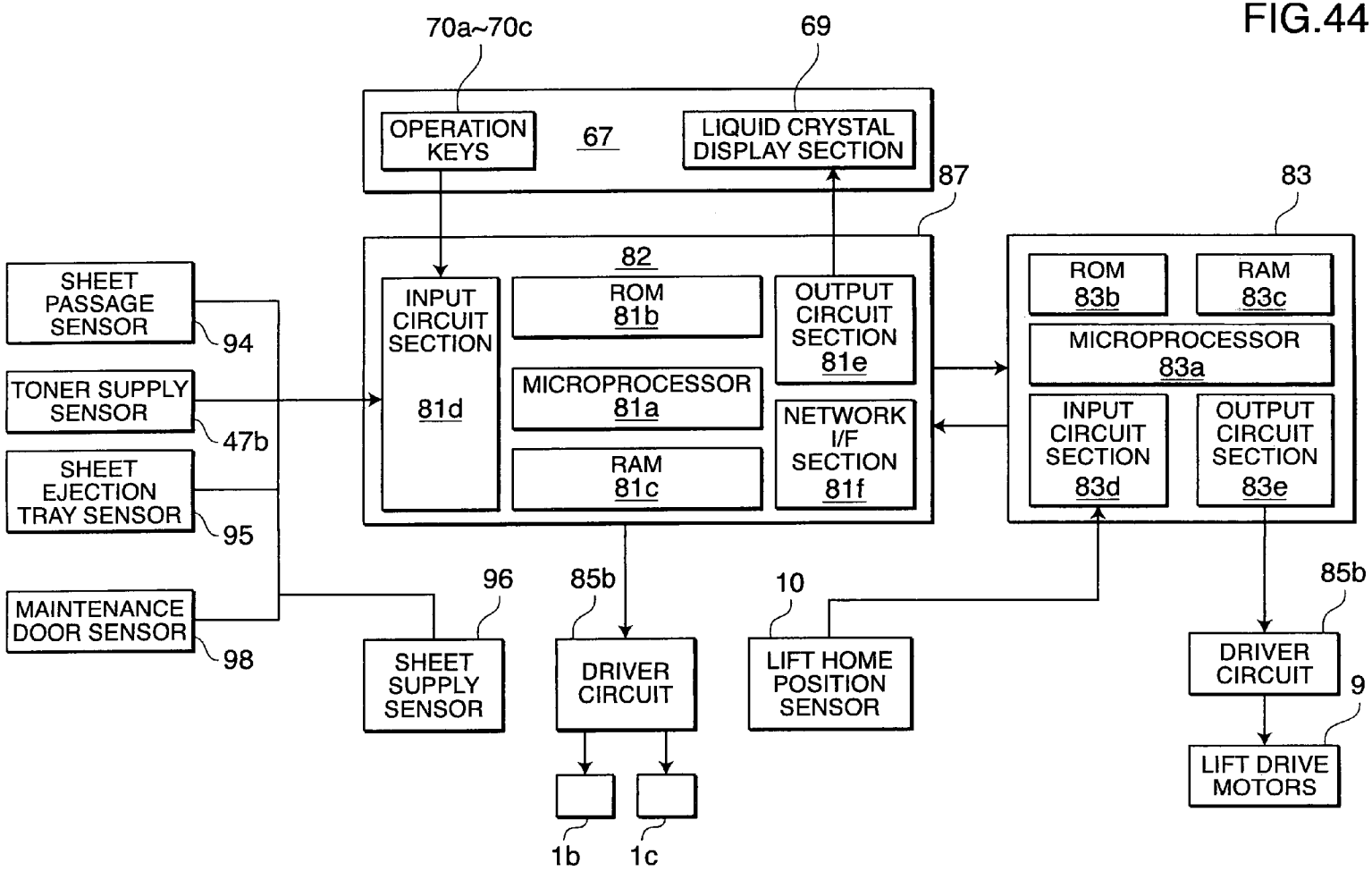
FIG. 44 is a diagram of a control circuit of Embodiment 3.

FIG. 44 is a diagram illustrating a control circuit which controls the overall printing apparatus according to this embodiment. As shown, the control circuit includes a main body control circuit 82 which controls the driving of the main body 1, i.e., the printer section 1*b* and the sheet cassette section 1*c*, and a lift control circuit 83 which controls the driving of the lift drive motors 9.

The control circuit shown in FIG. 44 has substantially the same circuit configuration as that shown in FIG. 8, except that the driver circuit 85*a* is replaced with a driver circuit 85*d* for driving only the printer section 1*b* and the sheet cassette section 1*c*, and the CCD reading unit 18, the document placement sensor 92, the document tray sensor 30*a*, the document ejection tray sensor 36*a* and the document passage sensor 93 are not provided. Further, the main body control circuit 82 is such that a network interface section 81*f* is added to the main body control circuit 81 shown in FIG. 8.

The main body control circuit 82 receives data of an image to be printed from the outside via the network interface section 81*f*. The image data is once stored in the RAM 81*c*, and outputted to the printer section 1*b*. When the image data is received, a message indicating the reception of the image data is displayed on the liquid crystal display section 69.

An operation to be performed by the apparatus having the aforementioned construction will be described with reference to a flow chart shown in FIG. 45.

Figure 46:
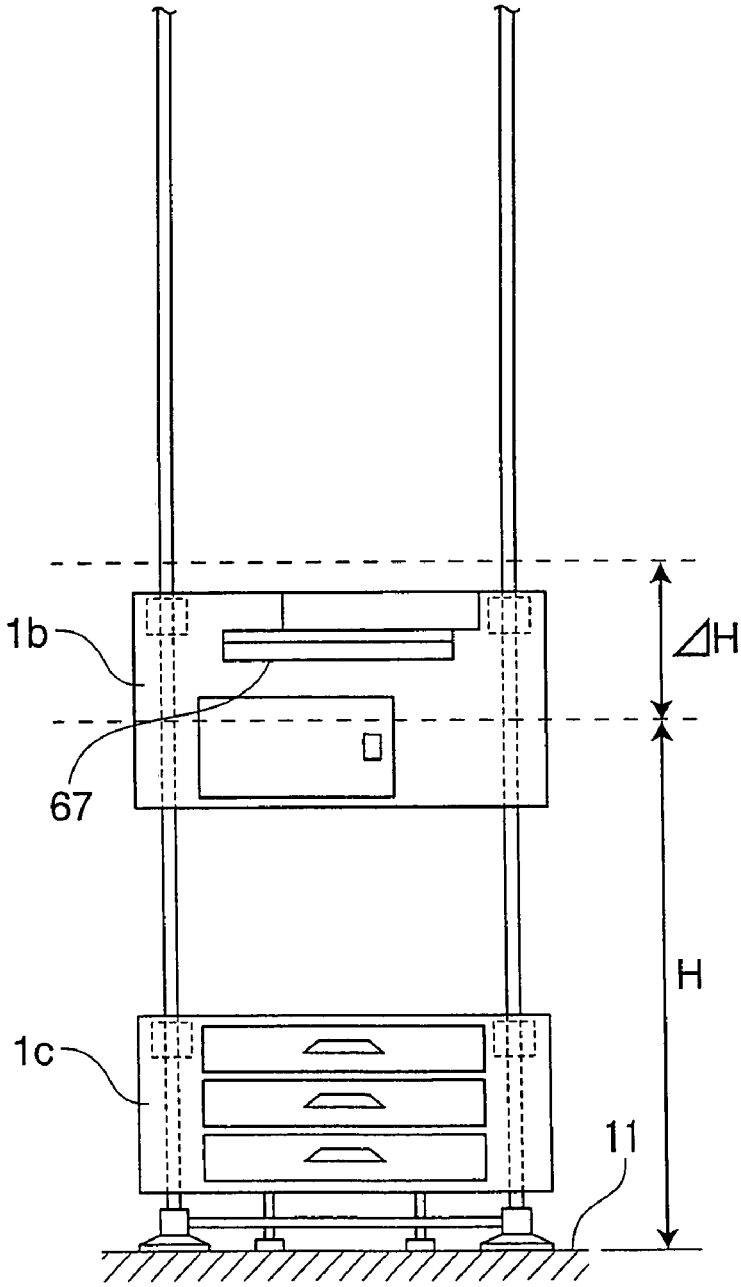
FIGS. 46 to 50 are diagrams for explaining the positions of respective sections shifted according to Embodiment 3.

When the main body 1 is turned on at a position shown in FIGS. 42(*a*) and 42(*b*), an initializing operation such as warm-up of the printer section 1*b* is performed (Step S101). Upon completion of the initializing operation, the printer section 1*b* having the operation panel 67 is moved to an operation area ΔH as shown in FIG. 46 (Step S102). The operation area is herein defined as an area at which the user can most easily perform an operation on the main body 1, and ranges from a height level H to a height level H+ΔH as measured from the floor 11. For example, H=100 cm and ΔH=30 cm.

Figure 47:
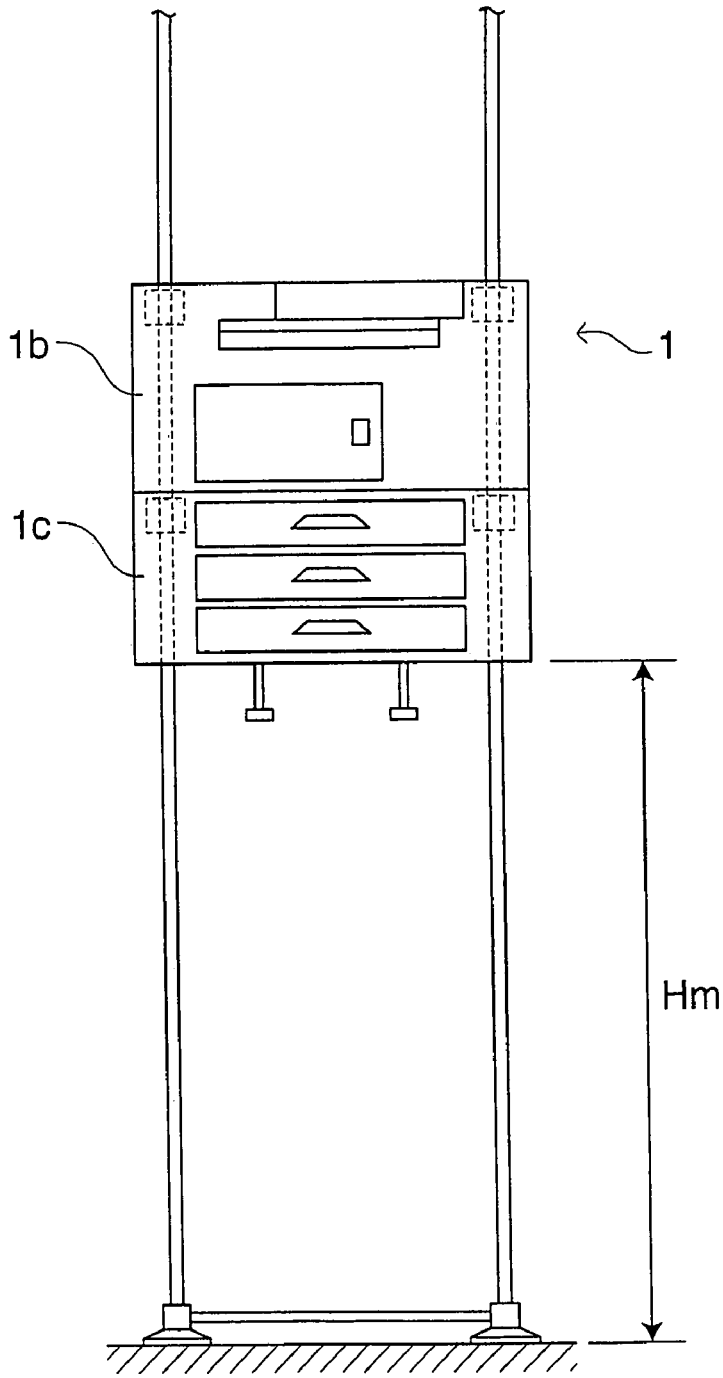

When an indication of reception of print data, i.e., data of an image to be printed, is displayed on the liquid crystal display section 69 of the operation panel 67 (Step S103), the number of sheets to be printed is inputted from the ten keys 70*b* of the operation panel 67 (Step S104). When the start key 70*a* is pressed (Step S105), the main body 1 is moved to an uppermost position Hm as shown in FIG. 47 (Step S106). The uppermost position Hm is herein set at Hm=150 cm, for example.

When the main body 1 reaches the uppermost position, a printing process is started (Step S107). Thus, the printing process can be stealthily performed. If the printing process is performed without interruption due to sheet depletion, toner depletion and sheet jamming (Steps S108 to S110) and the printed sheets are ejected into the sheet ejection tray 63 (FIG. 5) of the printer section 1*b* (Step S111), the printer section 1*b* is moved down to the operation area ΔH as shown in FIG. 46 (Step S112). This movement notifies the user of the completion of the printing process. When the printed sheets are taken out (Step S113), the routine returns to Step S103, whereby the printer section 1*b* is kept in standby for the next printing process.

Figure 48:
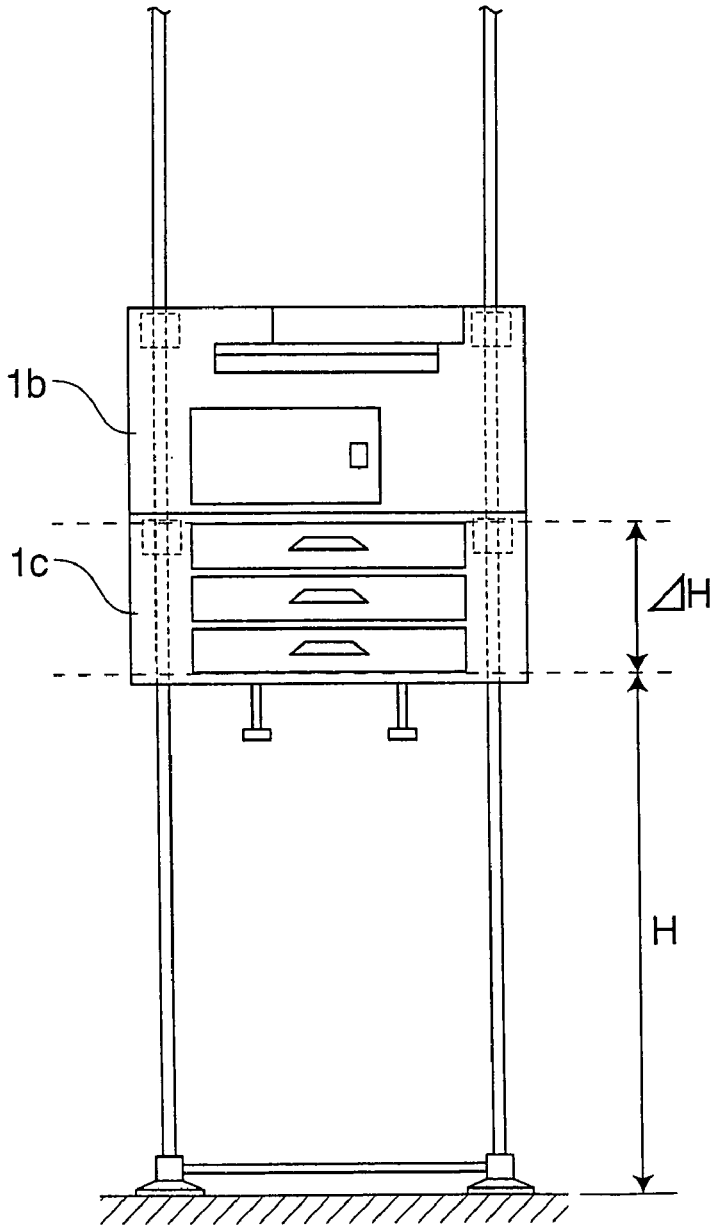

When the sheet depletion occurs to result in inability to continue the printing process in Step S108, the printing process is interrupted, and the sheet cassette section 1*c* is moved to the operation area ΔH as shown in FIG. 48 (Step S114). After the sheet cassette section 1*c* is replenished with sheets (Step S115), the routine returns to Step S106, whereby the main body 1 is moved to the uppermost position and the printing process is restarted (Step S107).

Figure 49:
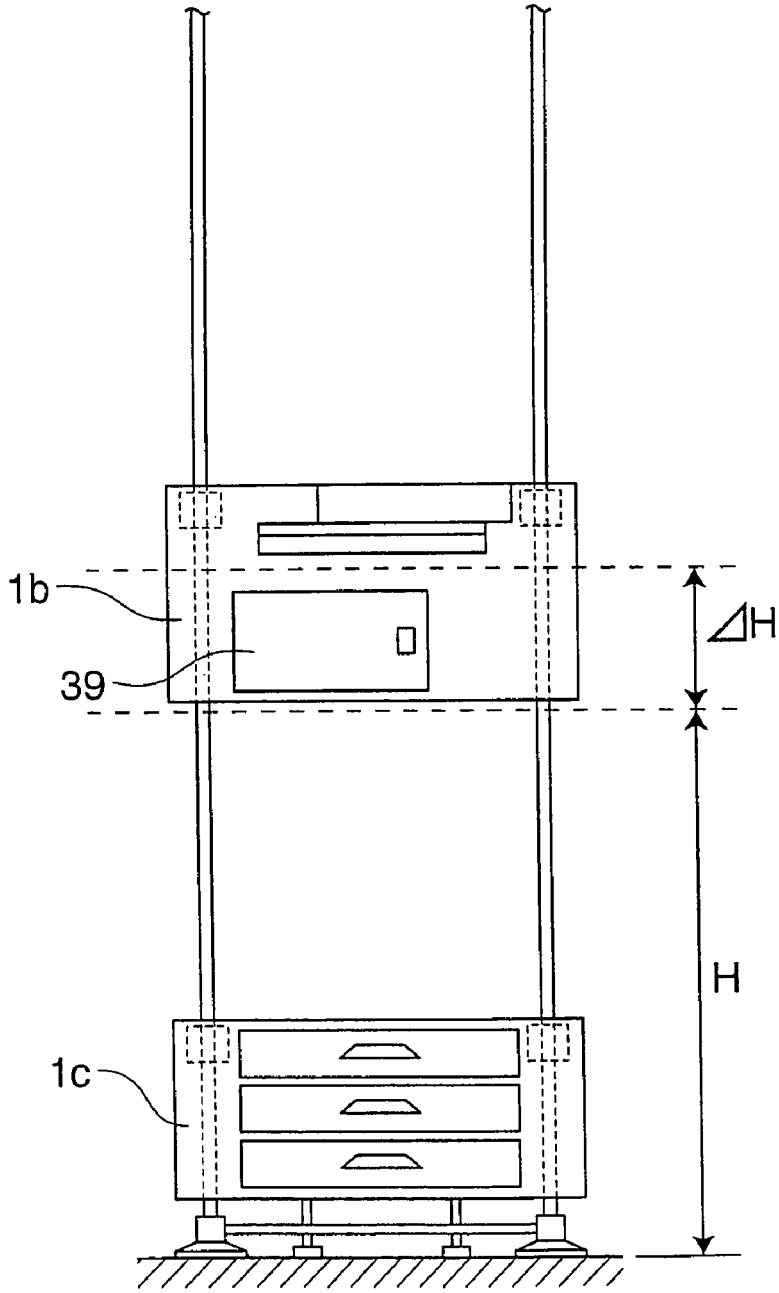

When the toner depletion occurs to result in inability to continue the printing process in Step S109, the printing process is interrupted, and the printer section 1*b* is moved to locate the maintenance door 39 in the operation area ΔH as shown in FIG. 49 (Step S116). After the toner container is replenished with toner (Step S117), the routine returns to Step S106.

Figure 50:
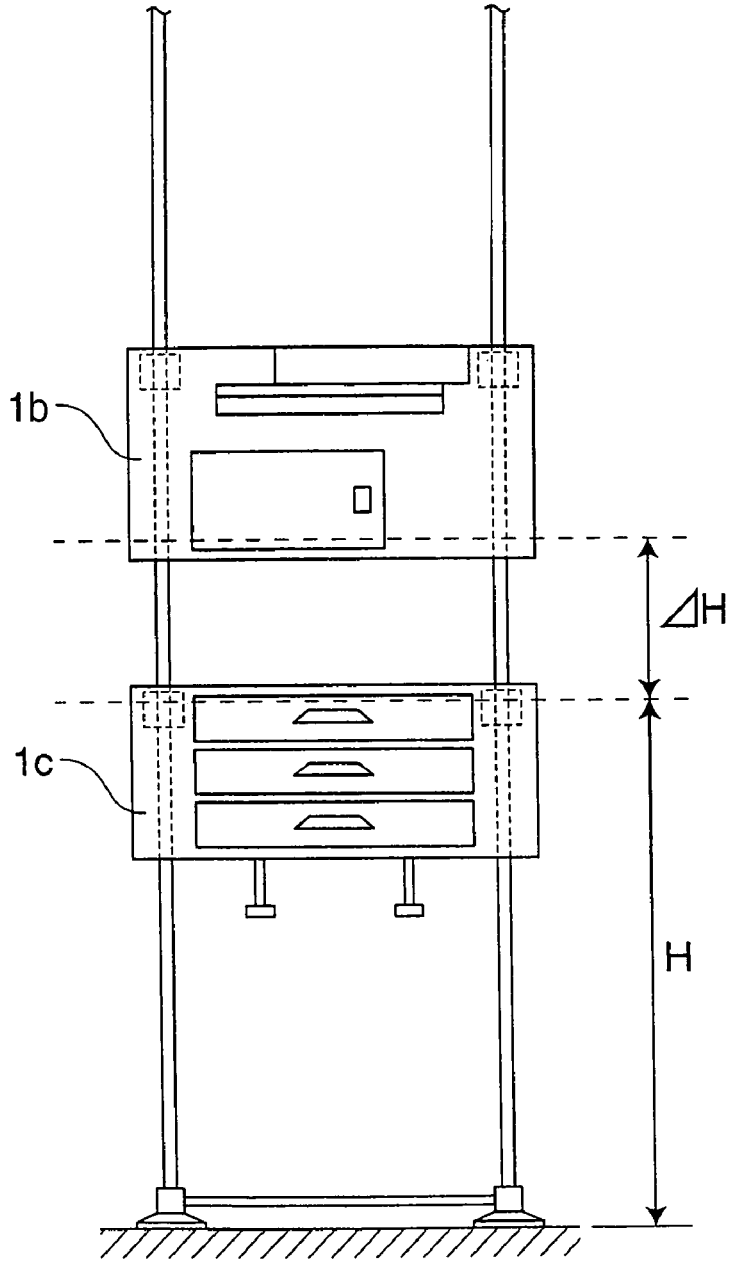

When a sheet jam occurs to result in inability to continue the printing process in Step S110, the printing process is interrupted, and an area of the apparatus suffering from the sheet jam is moved to the operation area ΔH as shown in FIG. 50 (Step S118). After a jammed sheet is removed, the routine returns to Step S106.

Thus, the lift control circuit 83 acquires the state of the progress of the image recording process from the main body control circuit 82, and moves the printer section 1*b* and the sheet cassette section 1*c* according to the progress state. This facilitates the user's operation, and prevents a third person from looking at the printed sheets during the printing process.

Figure 45:
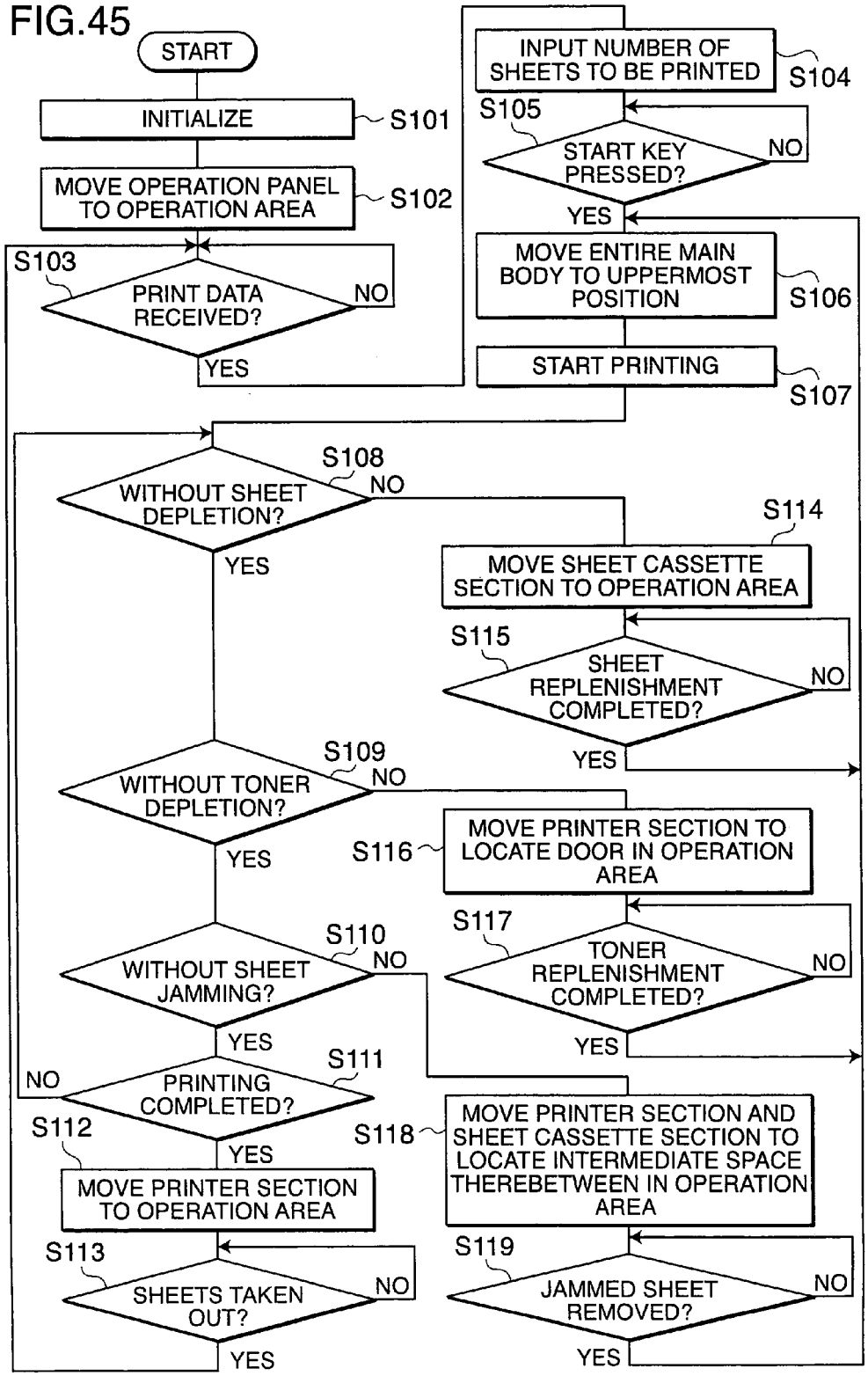
FIG. 45 is a flow chart showing an operation to be performed according to Embodiment 3.
Figure 51:
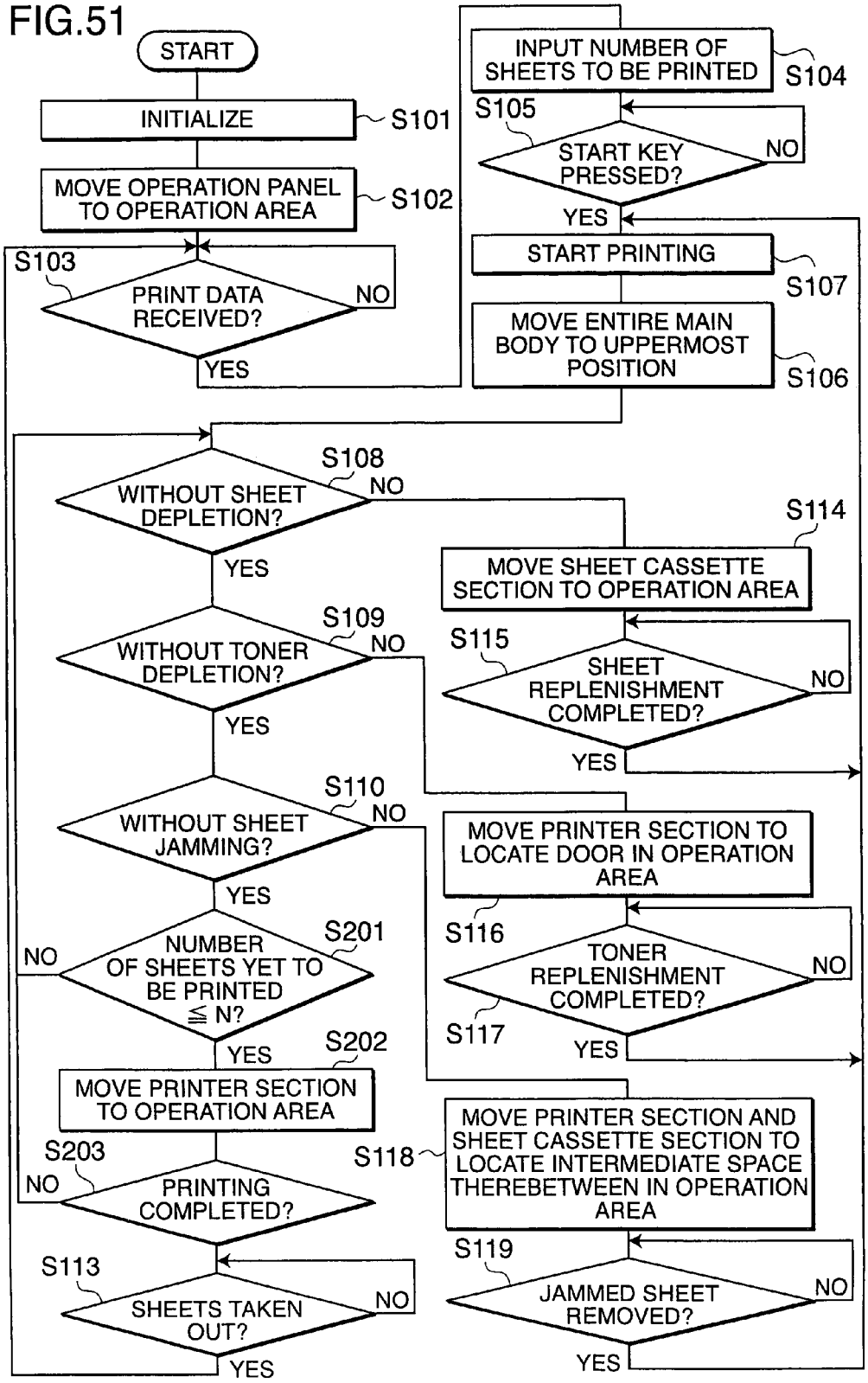
FIG. 51 is a flow chart showing a variation of the operation to be performed according to Embodiment 3.

FIG. 51 is a flow chart showing a variation of the operation to be performed according to this embodiment as corresponding to FIG. 45. In FIG. 51, Steps S106 and S107 shown in FIG. 45 are provided in reverse order, and Steps S201 to S203 are provided instead of Steps S111 and S112 shown in FIG. 45. In FIG. 51, when the start key 70*a* is pressed in Step S105, the printing process is started (Step S107), and then the main body 1 starts moving to the uppermost position (Step S106). Further, the printer section 1*b* starts moving to the operation area ΔH (Step S202) when the number of sheets yet to be printed becomes N (Step S201) before the completion of the printing process (Step S203). The operation is performed in substantially the same manner as in FIG. 45 except for these steps.

Figure 52:
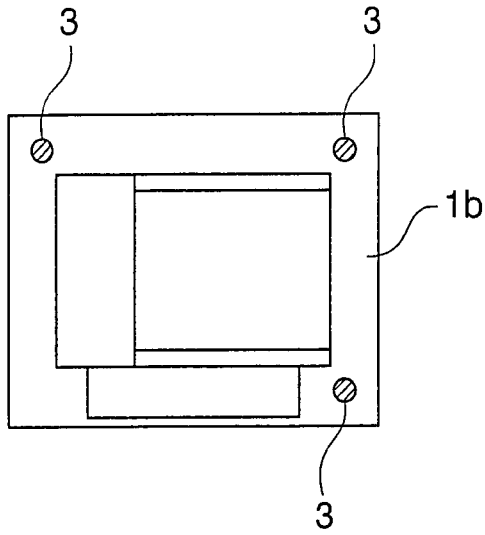
FIG. 52 is a diagram illustrating a variation of Embodiment 3 as corresponding to FIG. 43.
Figure 53:
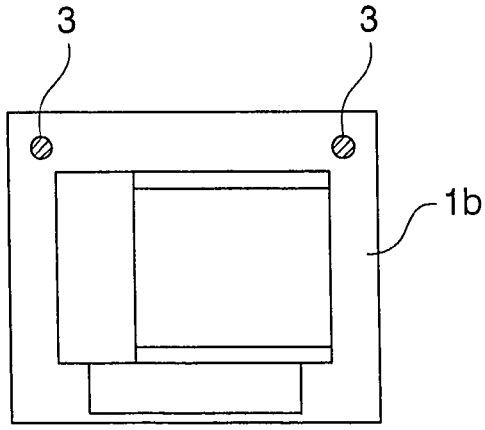
FIG. 53 is a diagram illustrating another variation of Embodiment 3 as corresponding to FIG. 43.

FIGS. 52 and 53 are diagrams illustrating structural variations of this embodiment as corresponding to FIG. 43. Particularly, FIG. 52 illustrates a case in which three posts 3 are provided, and FIG. 53 illustrates a case in which two posts are provided.

Embodiment 4

An image forming apparatus according to this embodiment includes a plurality of posts disposed upright perpendicularly to a floor, engagement members respectively engaged with the posts in a vertically movable manner, a main body which is supported by the engagement members and performs an image forming process according to an operation performed by a user, a lift drive section which moves up and down the main body together with the engagement members, and a lift control section which controls the lift drive section according to the operation performed by the user and/or the state of progress of the image forming process.

The main body may be supported by the engagement members with a peripheral portion thereof engaged with the engagement members.

The posts may each have a male thread portion provided on a circumferential surface thereof and having a male thread, and the engagement members may each have a female thread portion meshed with the male thread portion. The lift drive section may rotate the respective posts to move up and down the main body.

The lift drive section may independently rotate the posts to adjust the inclination of the main body.

The posts may each have a male thread portion provided on a circumferential surface thereof and having a male thread, and the engagement members may each have a female thread portion meshed with the male thread portion. The lift drive section may rotate the respective engagement members to move up and down the main body.

The lift drive section may independently rotate the engagement members.

The posts may be disposed in contact with a ceiling of a room. The image forming apparatus may further include a top support portion which supports upper end portions of the posts, and the top support portion may be fixed to the ceiling of the room.

The male thread portion of each of the posts may have a length which corresponds to a movement range of the main body.

The apparatus may further include a lower end connecting member which connects lower ends of the respective posts, and an upper end connecting member which connects upper ends of the respective posts. The lower end connecting member, the upper end connecting member and the posts may define a rack for holding the main body.

The main body may be adapted to perform a reading process for reading a document original and/or a printing process for printing an image on a sheet according to the operation performed by the user.

Another image forming apparatus according to this embodiment includes a plurality of posts disposed upright perpendicularly to a floor, engagement members respectively engaged with the posts in a vertically movable manner, a main body which is supported by the engagement members and performs a reading process for reading a document original and/or a printing process for printing an image on a sheet, an access detection section which detects access of a user to the main body, a lift drive section which moves up and down the main body via the engagement members, and a control section which controls the lift drive section in response to the detection of the access by the access detection section.

The main body may have an operation section which receives a process starting command from the user, and the control section may vertically move the main body to a predetermined height level in response to the detection of the access of the user to permit the user to easily operate the operation section.

The access detection section may further include a detection section which detects the stature of the accessing user, and the control section may determine the height level based on the detected stature.

The access detection section may be capable of detecting departure of the user from the operation section, and the control section may vertically move the main body to a predetermined standby height level in response to the detection of the departure of the user.

The apparatus may further include an identification section which identifies the accessing user, and a user information storage section which preliminarily registers user information including identification information to be used for the identification and information on a user-specific height level of the operation section for user registration. The identification section may determine based on the user information whether or not the accessing user is preliminarily registered and, if the accessing user is identified as a preliminarily registered user, the control section may vertically move the main body to a height level which permits the user to easily operate the operation section on the basis of the user information.

Embodiment 4 will hereinafter be described in greater detail with reference to the attached drawings.

Figure 54:
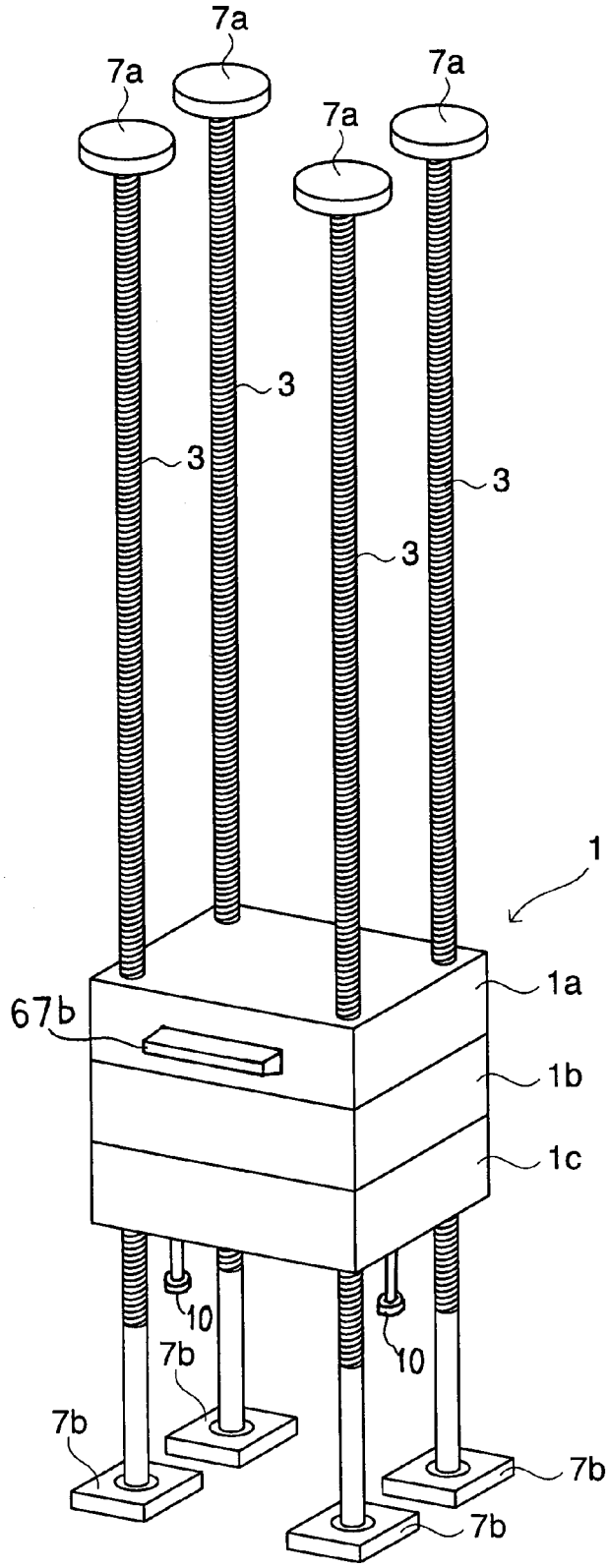
FIG. 54 is a perspective view illustrating Embodiment 4 of the present invention.

FIG. 54 is a perspective view illustrating an exemplary image forming apparatus according to Embodiment 4. As shown in FIG. 54, four vertical posts 3 respectively extend through four corners of a main body 1, and the main body 1 is vertically movable along the posts 3. The posts 3 each have a lower end disposed on a floor 11 (FIG. 55) via a foot portion 7*b*, and an upper end supported by a ceiling 13 (FIG. 55) via an upper support portion 7*a*.

The main body 1 includes a scanner section 1*a* (FIG. 4), a printer section 1*b* (FIG. 5) and a sheet cassette section 1C (FIG. 6).

Figure 55:
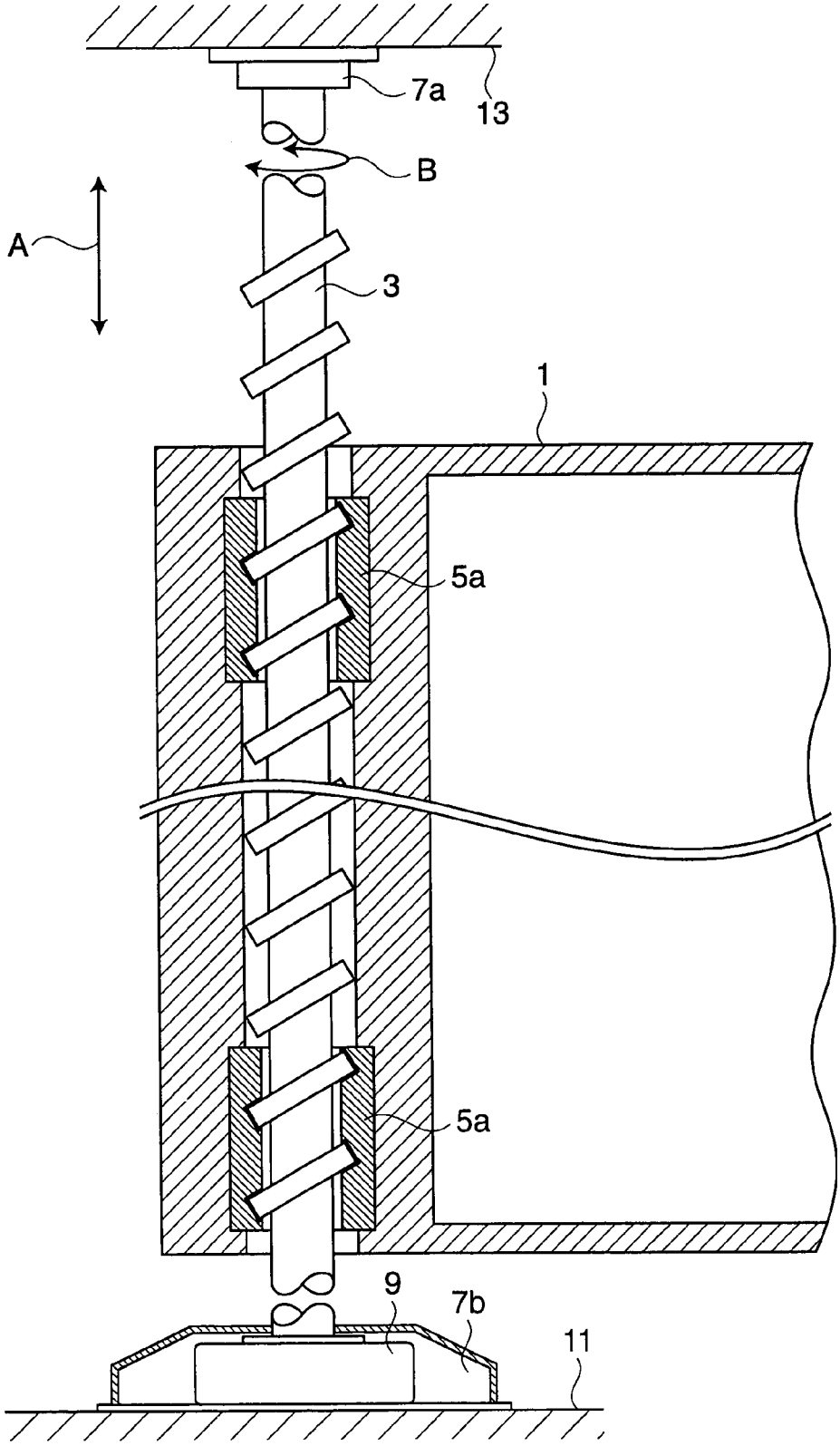
FIG. 55 is a sectional view of a major portion of Embodiment 4 shown in FIG. 54.

As shown in FIG. 55, the posts 3 each have a male thread formed on a circumferential surface thereof. A portion of the circumferential surface formed with the male thread is herein defined as a male thread portion. Nuts 5*a* each formed with a female thread (female thread portion) meshed with the male thread of the post 3 are provided in the main body 1. The posts 3 are rotated relative to the nuts 5*a*, whereby the nuts 5*a* are moved up and down in arrow directions A within the range of the male thread portion. The main body 1 is supported by the posts 3 via the nuts 5*a*.

Lift drive motors 9 are respectively provided in the four foot portions 7*b*. As the lift drive motors 9 are rotated, the posts 3 are each rotated in arrow directions B. Since the nuts 5*a* are fixed in the main body 1, the rotation of the posts 3 causes the main body 1 to move up and down together with the nuts 5*a*.

A driver circuit for the lift drive motors 9 is controlled by a control signal applied from a lift control circuit provided in the main body 1. The lift drive motors 9 are independently driven, so that the inclination of the main body 1 relative to the floor 1 can be controlled.

Figure 56:
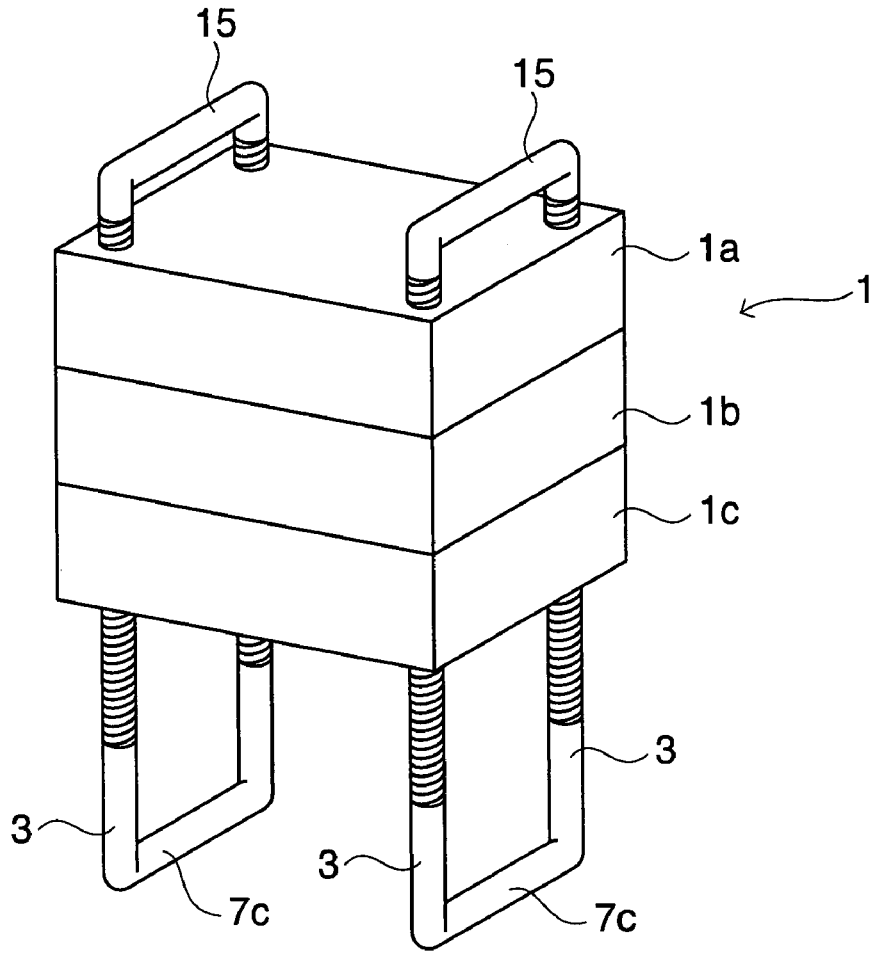
FIG. 56 is a perspective view illustrating a variation of Embodiment 4.

FIG. 56 is a perspective view illustrating a variation of the image forming apparatus of FIG. 54 according to Embodiment4. As shown in FIG. 56, lower ends of four posts 3 extending vertically through a main body 1 are paired to be connected to each other. Similarly, upper ends of the four posts 3 are paired to be connected to each other. The paired lower ends are connected by a foot portion 7C, and the paired upper ends are connected by a connection member 15. The posts 3 respectively extend through four corners of the main body 1, and the main body 1 is movable up and down along the posts 3. The main body 1 includes a scanner section 1*a* (FIG. 4), a printer section 1*b* (FIG. 5) and a sheet cassette section 1C (FIG. 6).

Figure 57:
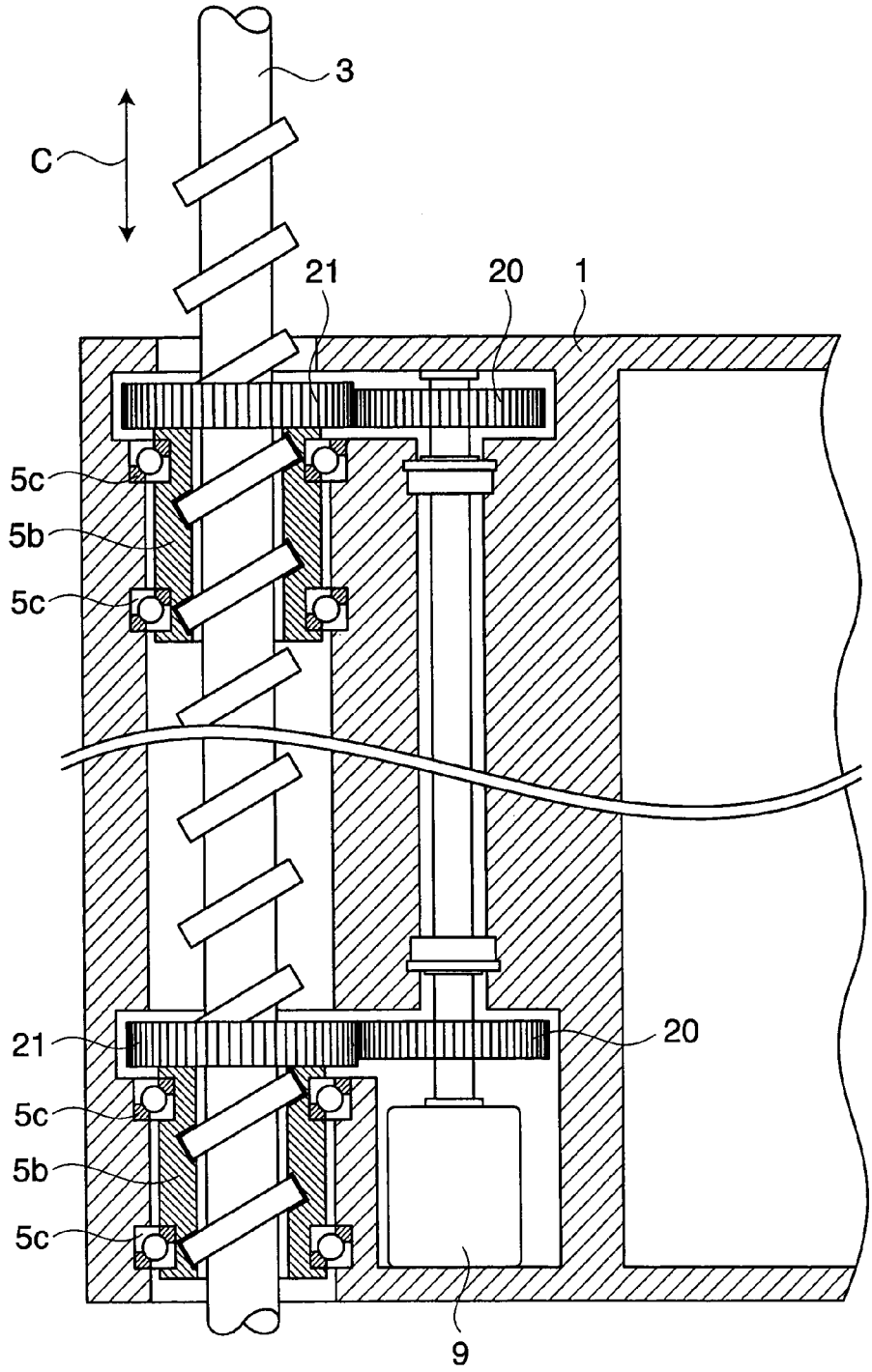
FIG. 57 is a sectional view illustrating a major portion of the variation shown in FIG. 56.

The posts 3 each have a male thread portion provided on a circumferential surface thereof and having a male thread. As shown in FIG. 57, nuts 5*b* each having a female thread (female thread portion) meshed with the male thread of the post 3 are provided in the main body 1. The nuts 5*b* are each supported by the main body 1 via radial/thrust bearings 5*c*. In other words, the main body 1 is supported by the respective posts 3 via the nuts 5*b*. Therefore, the main body 1 is moved up and down in arrow directions C within the range of the male thread portion by rotating the nuts 5*b* relative to the posts 3.

Lift drive motors 9 and a driver circuit for driving the lift drive motors 9 are provided in the main body 1. The rotation of each of the lift drive motors 9 is transmitted to the nuts 5*b* via gears 20, 21. As the lift drive motors 9 are rotated, the nuts 5*b* are rotated, whereby the nuts 5*b* are moved along the male threads formed on the posts 3. Thus, the main body 1 which rotatably supports the nuts 5*b* is movable up and down in the arrow directions C along the posts 3. The lift drive motors 9 are driven by a driver circuit to be described later.

In Embodiment 4, a lift home position sensor 10 is provided on a bottom of the sheet cassette portion 1C as shown in FIG. 54. The lift home position sensor 10 detects the approach of the sheet cassette section 1C to the floor 11 before the sheet cassette section 1C reaches the floor 11, and outputs a signal. The lift control circuit uses this signal to define a reference position (lowermost position) for the vertical movement. Where the lift drive motors 9 each employ a stepping motor, the lift control circuit constantly detects the vertical position of the main body 1 on the basis of the number of steps from the reference position for the positional control of the main body 1. Alternatively, where the lift drive motors 9 each employ a motor with an encoder rather than the stepping motor, the lift control circuit constantly detects the vertical position of the main body 1 on the basis of the number of pulses of the encoder from the reference position for the positional control of the main body 1.

Figure 58:
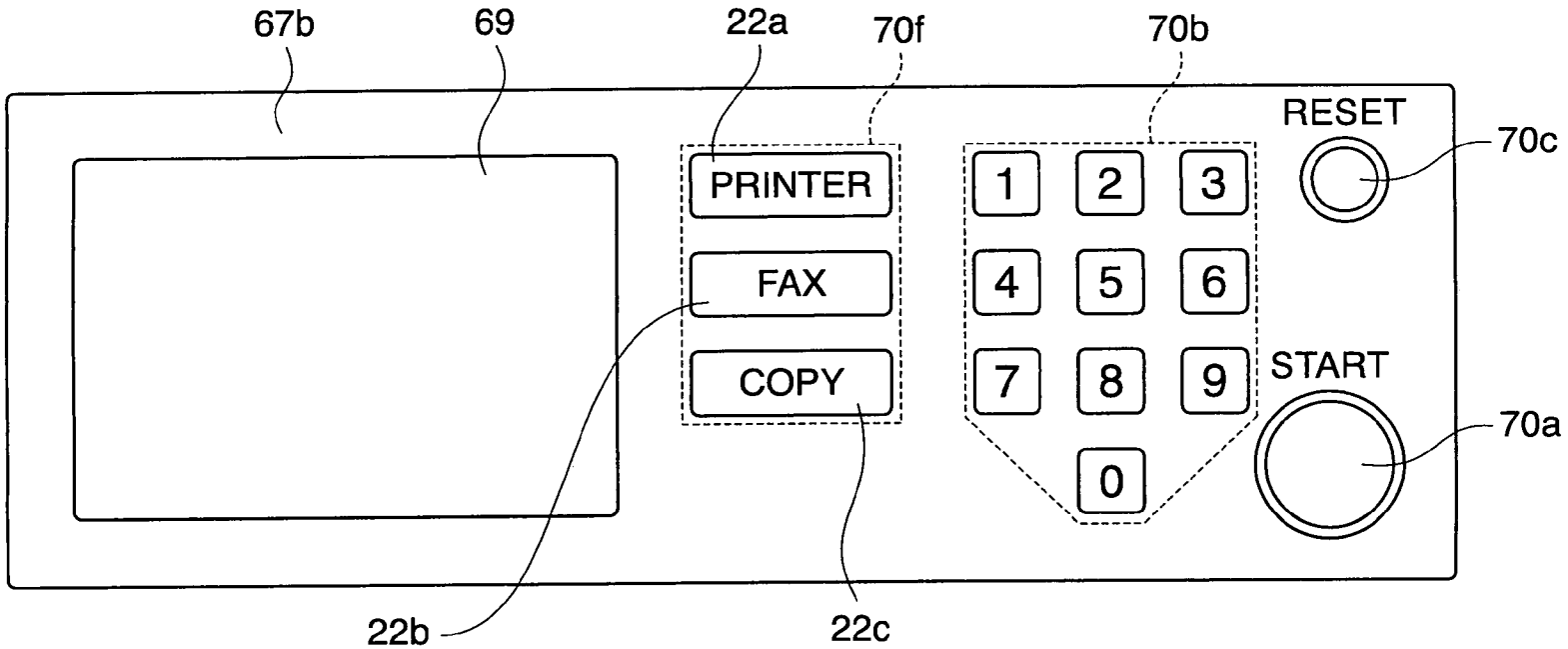
FIG. 58 is a top plan view of another major portion of Embodiment 4.

FIG. 58 is a front view of an operation panel 67*b* according to Embodiment 4.

The operation panel 67*b* is attached to a front face of the scanner section 1*a* shown in FIG. 54. The operation panel 67*b* has substantially the same construction as the operation panel 67 shown in FIG. 7, except that job selection keys 70*f*, i.e., a print job key 22*a*, a fax job key 22*b* and a copy job key 22*c*, are provided in addition to those shown in FIG. 7.

The main body 1 further includes an access sensor 99 which detects the access of the user to the main body 1. A known reflective light sensor, for example, may be used as the access sensor 99. The access sensor 99 is disposed on a front side of the operation panel 67*b* for detecting a user accessing the operation panel 67*b*.

Figure 59:
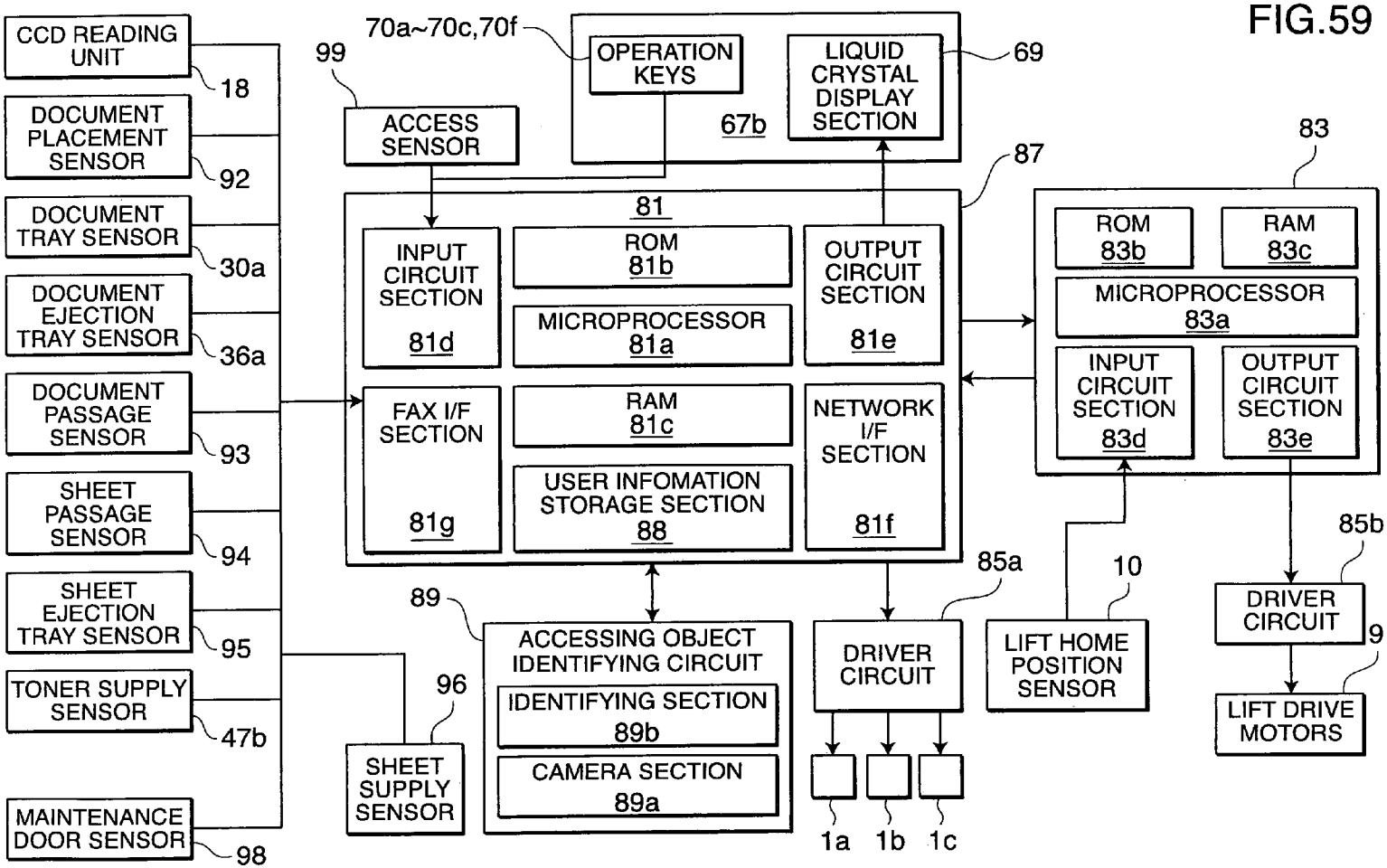
FIG. 59 is a diagram of a control circuit of Embodiment 4.

FIG. 59 illustrates a control circuit which controls the overall image forming apparatus according to Embodiment 4. The control circuit has substantially the same circuit configuration as that shown in FIG. 8, except that the access sensor 99 is additionally provided and the operation panel 67 is replaced with the operation panel 67*b*. Further, a network interface section 81*f*, a fax interface section 81*g* and a user information storage section 87 are additionally provided in the main body control circuit 81.

The access sensor 99 detects a user accessing the main body 1. The user accesses the operation panel 67*b* of the main body 1 to cause the main body 1 to perform jobs such as a copy job, a scan job and a fax transmission job. The microprocessor 81*a* vertically moves the main body 1 in response to a detection signal from the access sensor 99. More specifically, the main body 1 is vertically moved from a predetermined standby height level to a height level which permits the user to easily operate the operation panel 67*b*. The height level which permits the user to easily operate the operation panel 67*b* may be preliminarily determined for a user of an average stature, or may be determined according to the stature of each user as will be described later. Here, the standby height level is a predetermined height level. For example, the standby height level is the uppermost level of the vertical movement range of the main body 1, which permits the user to visually recognize the main body 1 from anywhere on the floor.

The access sensor 99 may detect the stature of the accessing user. For example, the access sensor may include a CCD camera, which detects approach of the user to a predetermined distance from the main body 1 and provides an image captured at this time. The microprocessor 81*a* determines the stature of the user based on the captured image. The detection of the approach of the user to the predetermined distance from the main body 1 may be achieved by employing an auto-focus controlling technique known in the field of camera technology. The stature of the user may be determined by extracting the feet and the head of the user from the captured image through a known pattern recognition technique and calculating the ratio of a body area between the toe and the top of the user to the area of the entire image frame. The microprocessor 81*a* may determine the height level to which the main body 1 is vertically moved according to the stature thus determined.

According to this embodiment, the main body 1 has an accessing object identifying circuit 89 which identifies an accessing object, and the main body control circuit 81 has a user information storage section 87 which stores information on a multiplicity of users as shown in FIG. 59. The accessing object identifying circuit 89 includes a camera section 89*a* having an image pickup device such as a CCD, and an identifying section 89*b* which compares the image captured by the camera section 89*a* with preliminarily registered patterns to identify the accessing object. The identifying section 89*b* may be constituted by the microprocessor 81*a* and a ROM which stores an identification program to be executed by the microprocessor 81*a*. The user information storage section 87 is provided as a nonvolatile RAM in the main body control circuit 81 as shown in FIG. 59. However, the user information storage section 87 is not limited to the nonvolatile RAM, but may be a hard disk.

The user information storage section 87 stores user information which is preliminarily registered for the multiplicity of users. The user information includes user pattern data to be employed for the identification by the identifying section 89*b*. When the access sensor 99 detects an accessing object, the camera section 89*a* of the accessing object identifying circuit 89 captures the accessing object. The identifying section 89*b* compares the captured image with the pattern data registered as the user information in the user information storage section 87, and identifies the accessing object by determining whether the accessing object matches any of the registered users. Then, the identification result is applied to the main body control circuit 81. A known pattern matching technique is employed for the identification. Where the captured object is identified as one of the registered users, the microprocessor 81*a* controls the vertical movement of the main body 1 by employing the user information of the identified user.

The user information to be stored in the user information storage section 87 includes, for example, user-specific counter data indicating the number of sheets printed by each user and user-specific process prohibition data for prohibiting a user from performing a particular process. Examples of the process to be prohibited include a full color copying process and a full color printing process. The user information further includes user-specific height level information indicating a height level which permits the user to easily perform an operation on the main body 1. For example, the user-specific height level information may indicate a height level which permits the user to easily operate the operation panel 67*b*. The height level information to be registered is inputted from the ten keys 70*b* of the operation panel 67*b* by the user.

The user information may be correlated with a user-specific terminal. The terminal is connected to the image forming apparatus via a network. When the microprocessor 81*a* receives a request for a print job from the terminal, the microprocessor 81*a* judges that the request is applied from a user corresponding to that terminal.

Alternatively, the user information may be correlated with a user-specific identification code. When a user requests a print job, the user first inputs an identification code on a screen of the terminal for the print job. The inputted identification code is added to the print job request, and transmitted to the image forming apparatus. The image forming apparatus acquires the user information corresponding to the requesting identification code from the user information storage section 87. The acquired user information includes pattern data of the user to be used for the identification by the identifying section 89*b*, and the height level information of the user. The identifying section 89*b* uses the acquired pattern data to identify the accessing user. The microprocessor 81*a* uses the height level information of the user to control the vertical movement of the main body 1.

Where the user requests a copy job, the user inputs the identification code from the ten keys 70*b* of the operation panel 67*b*. The microprocessor 81*a* acquires user information corresponding to the inputted identification code from the user information storage section 87. The acquired user information includes the height level information of the user. The microprocessor 81*a* uses the height level information of the user to control the vertical movement of the main body 1.

If the identifying section 89*b* judges that the accessing object does not match any of the registered users, the microprocessor 81*a* may control the main body 1 so as not to move the main body 1 from the standby position. Thus, only the registered users can take out printed sheets. Where the standby height level and a height level for a printing process are set at the uppermost level of the vertical movement range, there is no possibility that a third person looks at the sheets ejected after the printing. Only when the registered user accesses the image forming apparatus, the main body 1 is moved down to the height level which permits the user to take out the sheets. This is advantageous for security.

The vertical movement of the main body 1 over time from the turn-on of the apparatus will be described according to this embodiment.

The main body control circuit 81 determines the standby height level (first height level) when the main body 1 is installed, and stores the standby height level in the nonvolatile RAM 81C. The standby height level is, for example, generally equal to the height level of the upper ends of the posts 3.

When the apparatus is turned on, the microprocessor 83*a* of the lift control circuit 83 moves down the main body 1 to cause the lift home position sensor 10 to detect the floor 11. The height level detected at this time is employed as a home position which serves as a reference position for the subsequent vertical movement control (initializing operation). Then, the main body 1 is moved up to the first position to open up the floor. At the first height level, the main body 1 is fully warmed up, and then kept in standby.

When a user accesses the main body 1, the access sensor 99 detects the accessing user. The microprocessor 81*a* detects a detection signal from the access sensor 99, and outputs a command to the lift control circuit 83 for vertically moving the main body 1 to a height level (second height level) which permits the user to easily operate the operation panel 67*b*. In response to the command, the lift control circuit 83 drives the lift drive motors 9 to locate the main body 1 at the second height level.

The second height level is herein defined as a height level determined for the user of an average stature, and the value of the second height level is stored in the ROM 81*b*.

Alternatively, when the access sensor 99 detects the accessing user, the accessing object identifying circuit 89 determines whether the accessing user matches any of the registered users. If the accessing user is identified as a registered user, the microprocessor 81*a* vertically moves the main body 1 to a height level which permits the user to easily operate the operation panel 67*b* according to height level information registered as the user information for that user.

Where a print job is requested from a terminal connected to the apparatus via the network and a user preliminarily registered as a user of the terminal is detected as an accessing object during or after the job, the microprocessor 81*a* may judge that the requesting user accesses the apparatus to take out printed sheets, and vertically move the main body 1 to a height level which permits the user to easily take out the sheets from a sheet ejection tray.

When the user presses the copy job key 22C and then the start key 70*a* after setting a document original, the microprocessor 81*a* starts a copy job. Then, an image of the document original is read and printed on sheets.

After the last sheet is printed, the microprocessor 81*a* vertically moves the main body 1 to a height level (fifth height level) which permits the user to easily take out the ejected sheets from the sheet ejection tray 63. Here, the fifth height level is determined in the following manner. A level difference between the operation panel 67*b* and the sheet ejection tray 63 is preliminarily stored in the ROM 81*b* of the main body control circuit 81. The microprocessor 81*a* acquires the level difference of the sheet ejection tray 63 onto which the sheets are ejected, and vertically moves the main body 1 according to the level difference.

When the user removes the sheets from the sheet ejection tray 63, the sheet ejection tray sensor 95 detects the removal of the sheets, and outputs a detection signal. Based on the detection signal, the microprocessor 81*a* detects the removal of the sheets. Then, the microprocessor 81*a* moves up the main body 1 to the first height level, and keeps the main body 1 in standby.

While one exemplary operation has thus been described, the microprocessor 81*a* vertically moves the main body 1 based on detection signals of the respective sensors when a print job or a fax job is performed or when the sheet depletion or the toner depletion occurs.

Embodiment 5

An image forming apparatus according to this embodiment includes a plurality of posts disposed upright perpendicularly to a floor, engagement members respectively engaged with the posts in a vertically movable manner, a main body which is supported by the engagement members and performs a plurality of operations for a reading process for reading a document original and/or a printing process for printing an image on a sheet, a lift drive section which moves up and down the main body together with the engagement members, and a control section which controls the lift drive section so as to locate the main body at a height level predetermined according to an operation performed by the main body.

The main body may include an operation section to be used by a user to input a command, and an input request receiving section which receives an input request externally applied for permitting the user to use the operation section. The control section may vertically move the main body to a predetermined height level which permits the user to easily operate the operation section in response to the received input request.

The main body may include a reading section which reads a document original set in a predetermined position, and a reading request receiving section which receives a reading request externally applied for permitting the user to use the reading section. The control section may vertically move the main body to a predetermined height level which permits the user to easily set a document original in a predetermined position in response to the received reading request.

The main body may include a sheet ejecting section which ejects a printed sheet, and the control section may vertically move the main body to a predetermined height level which permits the user to easily take out the ejected sheet in response to the ejection of the sheet.

The main body may include a sheet stack section in which printing sheets are stacked, and a sheet supply sensor which detects the presence or absence of the sheets in the sheet stack section. The control section may vertically move the main body to a predetermined height level which permits the user to easily replenish the sheet stack section with sheets in response to the detection of the absence of the sheets in the sheet stack section by the sheet supply sensor.

The main body may include a plurality of sheet stack sections, and sheet supply sensors provided in association with the respective sheet stack sections. The control section may vertically move the main body to a height level according to one of the sheet stack sections to be replenished with sheets.

The main body may include a sheet transport section which transports a sheet, and a sheet jam sensor which detects a sheet jam occurring in the sheet transport section. The control section may vertically move the main body to a predetermined height level which permits the user to easily remove a jammed sheet in response to the detection of the sheet jam by the sheet jam sensor.

The main body may include a toner supply section which supplies toner for printing, and a toner supply sensor which detects a need for toner replenishment of the toner supply section. The control section may vertically move the main body to a predetermined height level which permits the user to easily replenish the toner supply section with toner in response to the detection of the need for the toner replenishment by the toner supply sensor.

The main body may include an image forming section which requires a maintenance operation by an operator, and a maintenance request detecting section which receives a request for starting the maintenance operation of the image forming section. The control section may vertically move the main body to a predetermined height level which permits the operator to easily perform the maintenance operation in response to the reception of the request.

The height levels may be preliminarily determined according to the operation status of the apparatus.

The apparatus may further include a user registration section which registers user information on a plurality of users in a user information storage section, and a retrieval section which retrieves particular user information from the registered user information in response to a predetermined operation. The control section may determine the height level based on the retrieved user information.

The user information may include user-specific height level information which facilitates an operation to be performed by each user, and the control section may determine the height level based on the registered height level information.

The main body may include a timer section which measures time elapsed from completion of a process, and the control section may move the main body to an uppermost height level of a vertical movement range in response to a lapse of a predetermined period from the completion of the process.

The main body may be shiftable into a power saving mode in which power consumption of the main body in a standby state is reduced or power supply to the main body is substantially stopped. The control section may shift the main body into the power saving mode after the main body reaches the uppermost height level.

The main body may be shiftable into a power saving mode in which power consumption of the main body in a standby state is reduced or power supply to the main body is substantially stopped. The apparatus may further include a power saving request receiving section which receives a power saving request externally applied for shifting the main body into the power saving mode. The control section may move the main body to the uppermost height level of the vertical movement range in response to the reception of the power saving request, and then shift the main body into the power saving mode.

The apparatus may further include a restoration request receiving section which receives a mode restoration request externally applied for restoration from the power saving mode. The control section may restore the main body from the power saving mode in response to the reception of the restoration request, and then moves down the main body to the predetermined height level.

An electrophotographic copying apparatus according to Embodiment 5 of the present invention will hereinafter be described in detail with reference to the attached drawings.

Figure 60:
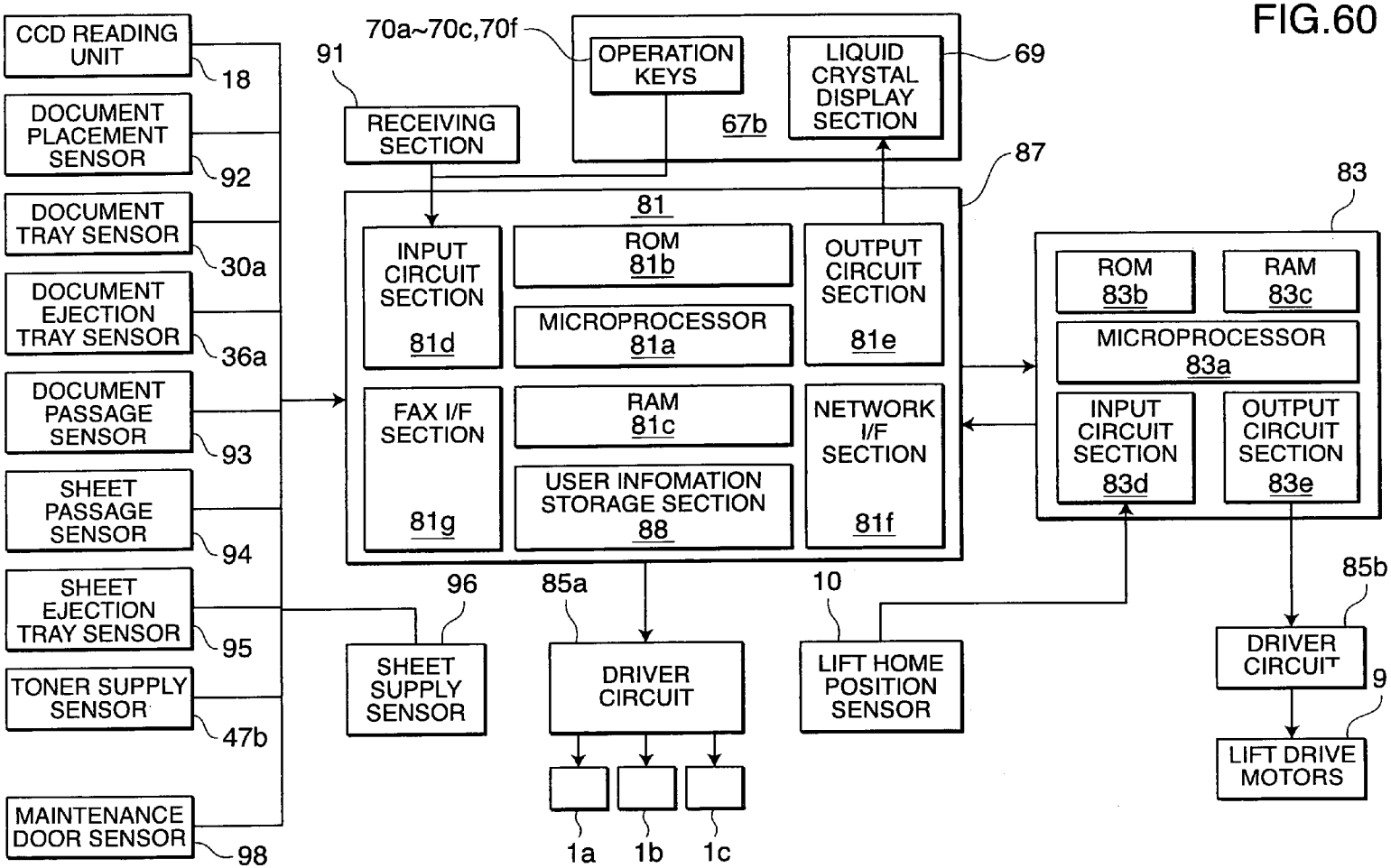
FIG. 60 is a diagram of a control circuit of Embodiment 5 of the present invention.

FIG. 60 illustrates a control circuit which controls the overall electrophotographic copying apparatus according to Embodiment 5. The control circuit has substantially the same circuit configuration as that shown in FIG. 59, except that the access sensor 99 and the accessing object identifying circuit 89 are replaced with a remote control signal receiving section 91.

Figure 61:
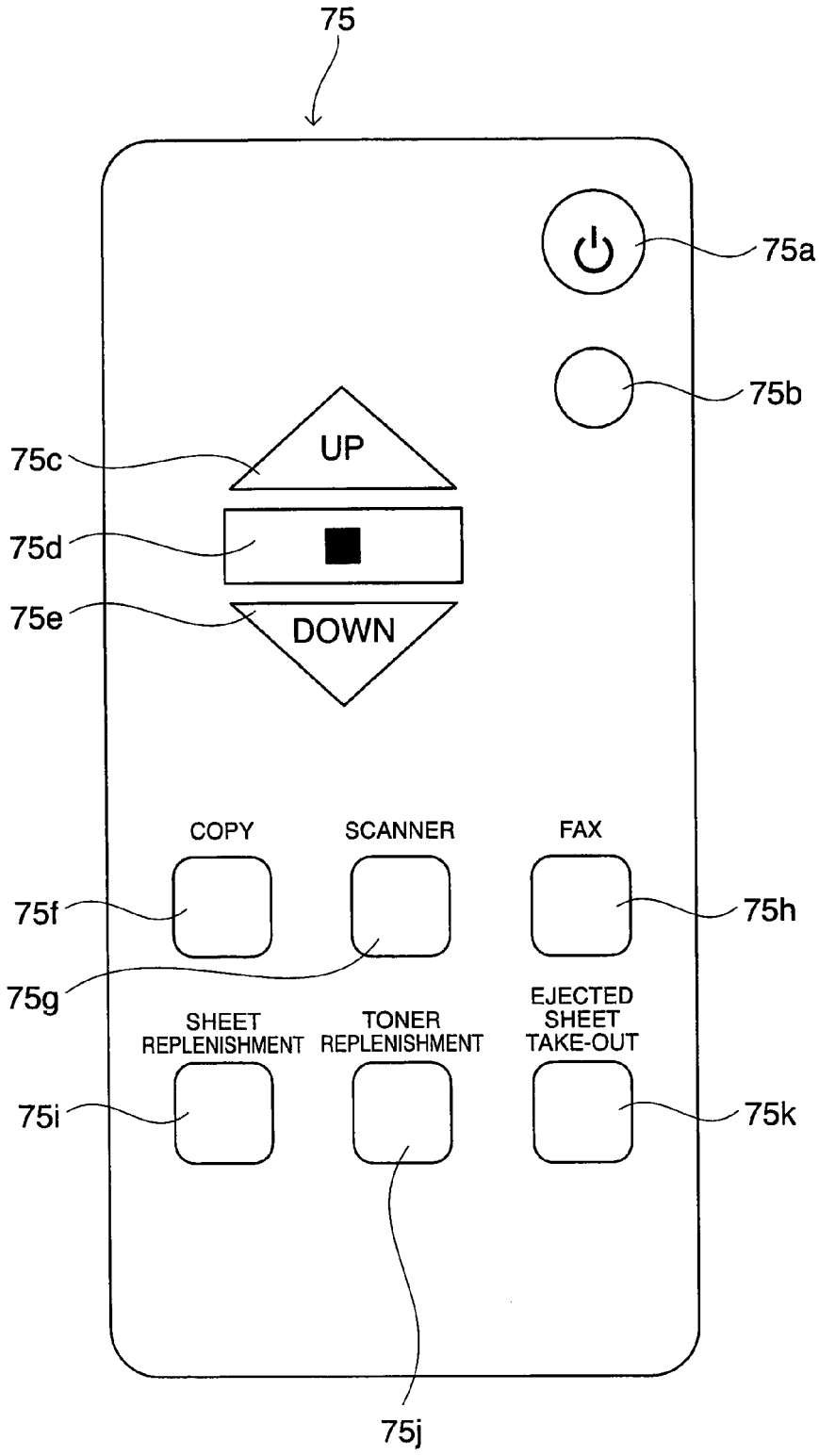
FIG. 61 is a front view of a remote controller to be used in Embodiment 5.
Figure 62:
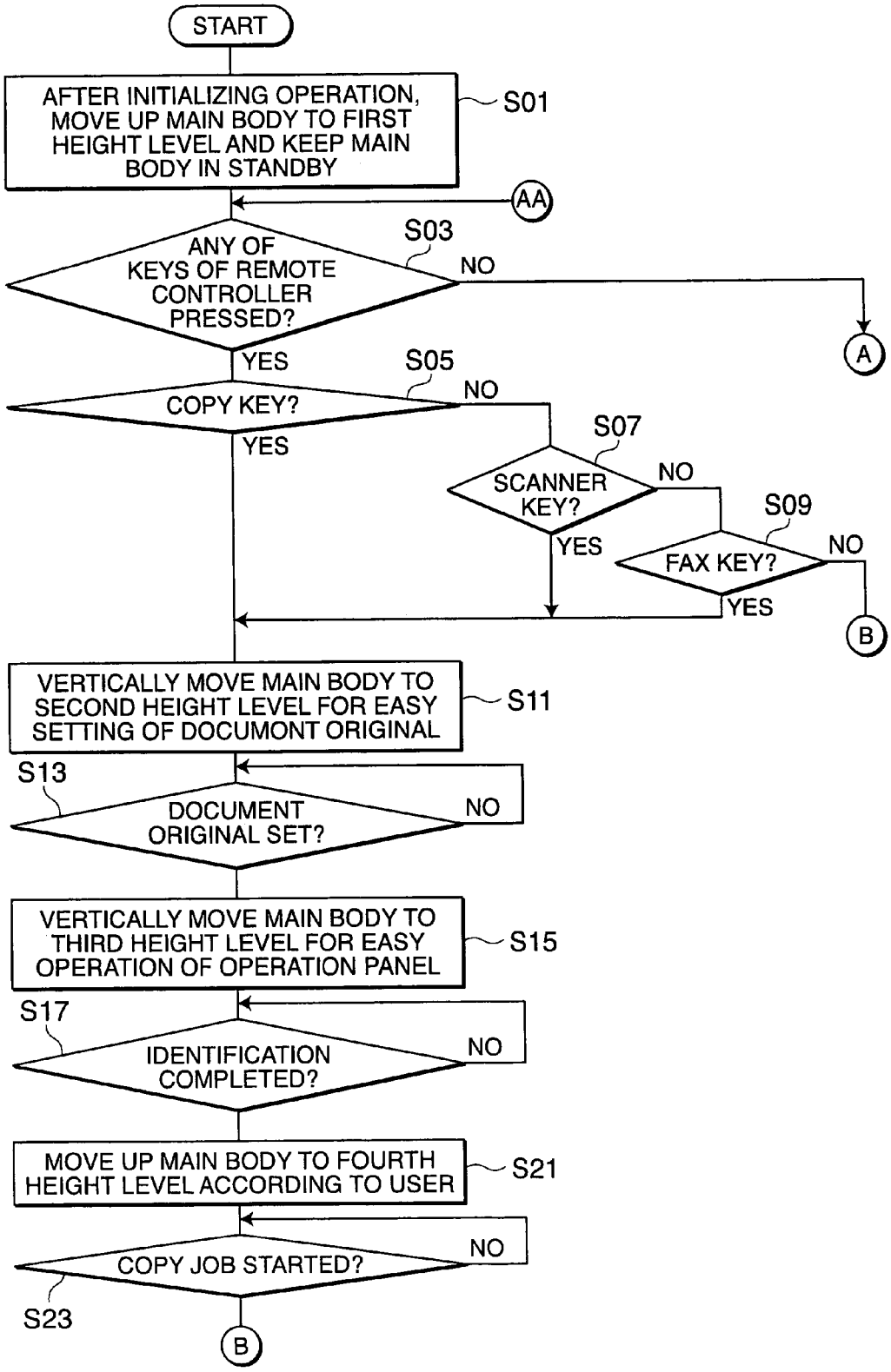
FIGS. 62 to 67 are flow charts showing an operation to be performed according to Embodiment 5.
Figure 63:
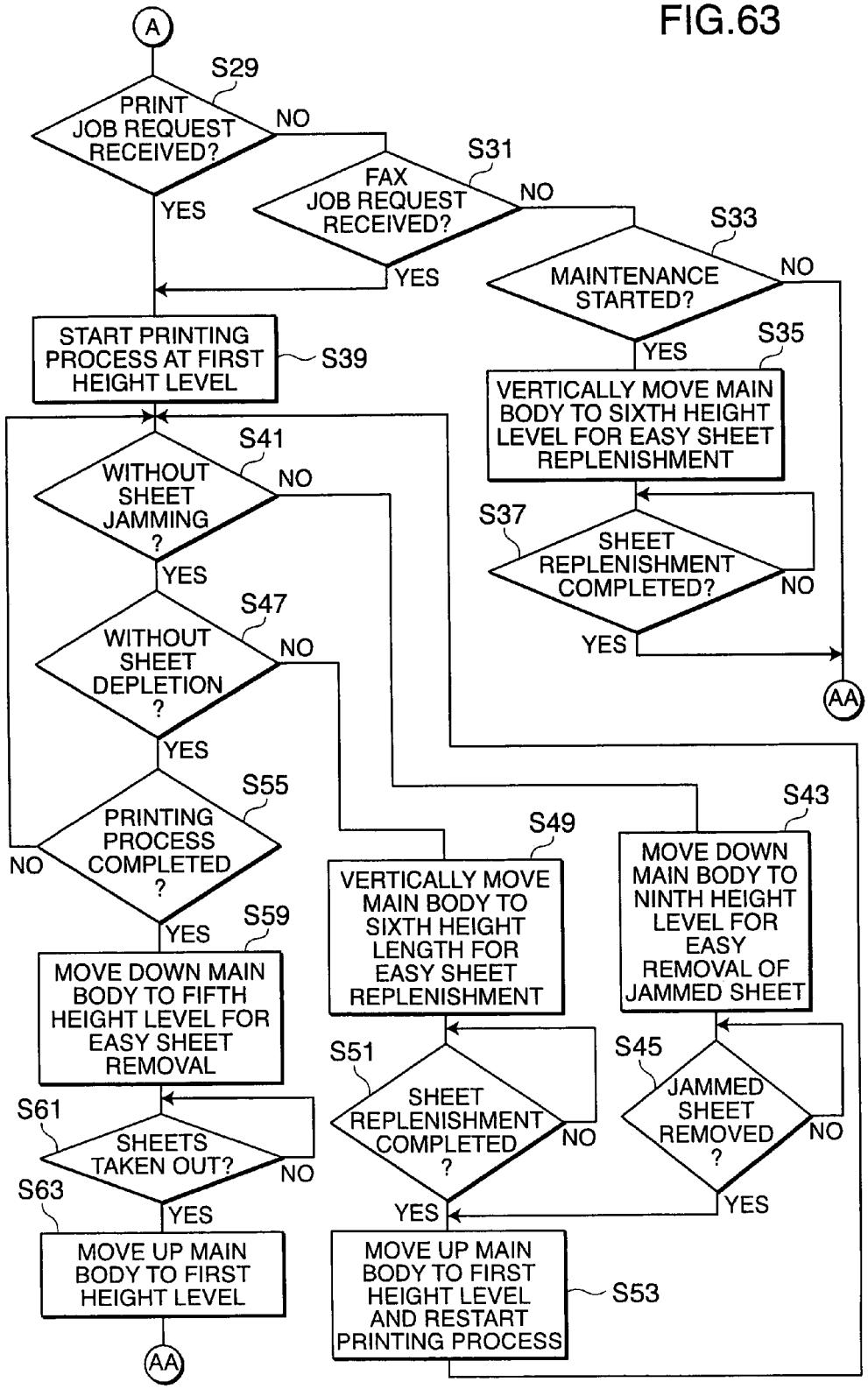
Figure 64:
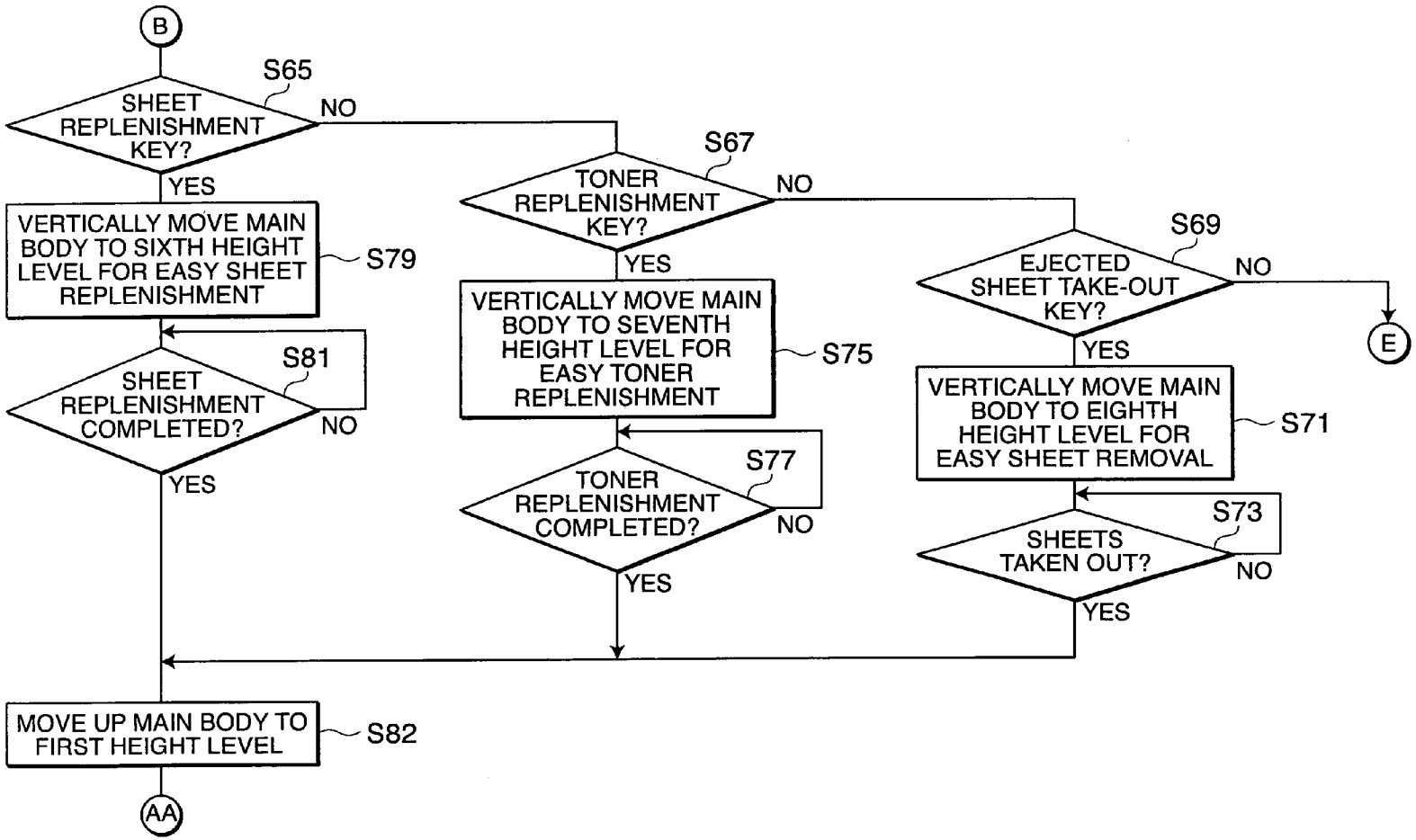

FIG. 61 is a front view of a remote controller attached to the electrophotographic copying apparatus of Embodiment 5. The electrophotographic copying apparatus of Embodiment 5 has substantially the same construction as that of Embodiment 4 including the components shown in FIGS. 54, 55 and 58, except for the aforementioned points.

In this embodiment, a user can remotely control the vertical movement of the main body 1 by using the remote controller 75 shown in FIG. 61. As shown in FIG. 61, the remote controller 75 has a plurality of operation keys for applying commands to the main body 1. The operation keys include a power key 75*a* for switching on and off a power supply, a power saving mode key 75*b* for applying commands for shifting the main body 1 into and out of the power saving mode, and keys 75*c* to 75*e* for vertically moving the main body 1 to a given height level and stopping the vertical movement.

A copy key 75*f* which vertically moves the main body 1 for causing the main body 1 to perform a copy job, a scanner key 75*g* which vertically moves the main body 1 for causing the main body 1 to perform a print job, and a fax key 75*h* which vertically moves the main body 1 for causing the main body 1 to perform a fax job are provided below the aforementioned keys. Further, a sheet replenishment key 75*i* which vertically moves the main body 1 for replenishing the sheet cassette section with sheets, a toner replenishment key 75*j* which vertically moves the main body 1 for toner replenishment, and an ejected sheet take-out key 75*k* which vertically moves the main body 1 for taking out sheets ejected into the sheet ejection tray are provided below the aforementioned keys.

When the user presses the power key 75*a*, for example, a signal generated by pressing the power key 75*a* is transmitted to the main body 1. Where the power key 75*a* is pressed when the main body 1 is in a power-on state, the main body control circuit 81 moves up the main body 1 to the uppermost position (predetermined first height level) to open up a space adjacent to the floor. When the main body 1 reaches the first height level, the main body control circuit 81 stops the upward movement of the main body 1 and switches off the main body 1. However, a power source and a power supply circuit for the main body 1 are configured so that a part of the power supply circuit for receiving a command from the remote controller 75 is active even if the main body 1 is in a power-off state.

If the main body 1 performs a job when the power key 75*a* is pressed, the main body control circuit 81 may suspend operations for the upward movement of the main body 1 and the power-off until the currently performed job is completed.

If the power key 75*a* is pressed again when the main body 1 is in the power-off state, the main body 1 receives a signal generated at this time, and switches on the main body 1. When the main body 1 is turned on, the main body control circuit 81 causes the lift control circuit 83 to move down the main body 1 to a predetermined second height level which permits the user to easily set a document original on the document tray 30 or the document platen 19.

When the copy key 75*f*, the scanner key 75*g* or the fax key 75*h* is pressed, the main body control section 81 also vertically moves the main body 1 to the second height level.

When the user presses the ejected sheet take-out key 75*k* after the print job, the main body control circuit 81 vertically moves the main body 1 to a height level which permits the user to easily take out the printed and ejected sheets from the sheet ejection tray. When the sheet replenishment key 75*i* is pressed after the sheets in the sheet cassette are used up, the main body control circuit 81 vertically moves the main body 1 to a height level which permits the user to easily replenish the sheet cassette with sheets. When the toner replenishment key 75*j* is pressed, the main body control circuit 81 vertically moves the main body 1 to a height level which permits the user to easily change the toner container 47*a*.

The first height level which is substantially equal to the height of the upper ends of the posts 3 is stored in the non-volatile RAM 81C of the main body control circuit 81 when the main body 1 is installed.

When the main body 1 is turned on, the microprocessor 83*a* of the lift control circuit 83 moves down the main body 1 to cause the lift home position sensor 10 to detect the floor. The height level of the main body 1 determined at this time is employed as a home position which serves as a reference height level for the subsequent lift control (initializing operation). Then, the main body 1 is moved up to the first height level to open up a space adjacent to the floor. At the first height level, the main body 1 is fully warmed up and kept in standby.

When the user presses the copy key 75*f* of the remote controller 75, a signal indicating the pressing of the copy key 75*f* is transmitted from the remote controller 75. The transmitted signal is received by the receiving section 91. The microprocessor 81*a* detects the received signal, and applies a command to the lift control circuit 83 for vertically moving the main body 1 to a height level (second height level) which permits the user to easily set a document original on the document tray 30 or the document platen 19. In response to the command, the lift control circuit 83 drives the lift drive motors 9 to locate the main body 1 at the second height level.

The second height level is determined for a user of an average stature, and the value of the second height level is stored in the ROM 81*b*. When the user sets a document original on the document tray 30, the microprocessor 81*a* detects the setting of the document original based on a signal from the document tray sensor 30*a*, and vertically moves the main body 1 to a predetermined third height level which permits the user to easily operate the operation panel 67*b*.

With the main body 1 located at the third height level, the user operates the ten keys 70*b* of the operation panel 67*b* to input his own identification code. The microprocessor 81*a* judges whether the inputted identification code matches any of identification codes stored in the user information storage section 87. If a match occurs, the microprocessor 81*a* vertically moves the main body 1 to a user-specific fourth height level which is suitable for the user. That is, the microprocessor 81*a* compares the user-specific height level registered as user information for that user with the third height level, and vertically moves the main body according to a difference between these height levels.

When the user presses the start key 70*a* after setting the document original, the microprocessor 81*a* starts performing the copy job. Then, an image of the document original is read and printed on sheets.

After the last sheet is printed, the microprocessor 81*a* vertically moves the main body 1 to a height level (fifth height level) which permits the user to easily take out the ejected sheets from the sheet ejection tray 63. Here, the fifth height level is determined in the following manner. A level difference between the operation panel 67*b* and the sheet ejection tray 63 is preliminarily stored in the ROM 81*b* of the main body control circuit 81. The microprocessor 81*a* acquires the level difference of the sheet ejection tray 63 on which the sheets are ejected, and vertically moves the main body 1 according to the level difference.

When the user removes the sheets from the sheet ejection tray 63, the sheet ejection tray sensor 95 detects the removal of the sheets, and outputs a detection signal. Based on the detection signal, the microprocessor 81*a* detects the removal of the sheets. Then, the microprocessor 81*a* moves up the main body 1 to the first height level, and keeps the main body 1 in standby.

While one exemplary operation has thus been described, the microprocessor 81*a* vertically moves the main body 1 based on detection signals of the respective sensors when a print job or a fax job is performed or when the sheet depletion or the toner depletion occurs.

An operation to be performed by the microprocessor 81*a* for the vertical movement of the main body 1 in the apparatus having the aforementioned construction will be described in greater detail with reference to a flow chart shown in FIGS. 62 to 67.

After the image forming apparatus is turned on, the initializing operation is performed. After completion of the initializing operation, the microprocessor 81*a* moves up the main body 1 to the first height level, and keeps the main body 1 in a standby state (Step S01).

In the standby state, the microprocessor 81*a* judges whether or not any of the keys of the remote controller 75 is pressed (Step S03). If none of the keys are pressed, the routine goes to Step S29 shown in FIG. 63 to judge whether or not a print job request is received. If the print job request is not received, the routine goes to Step S31 to judge whether or not a fax job request is received. If the fax job request is not received, the routine goes to Step S33 to judge whether or not a maintenance starting request is received. If the maintenance starting request is not received, the routine returns to Step S03 shown in FIG. 62. These judgment steps are repeated during a standby period.

Figure 67:
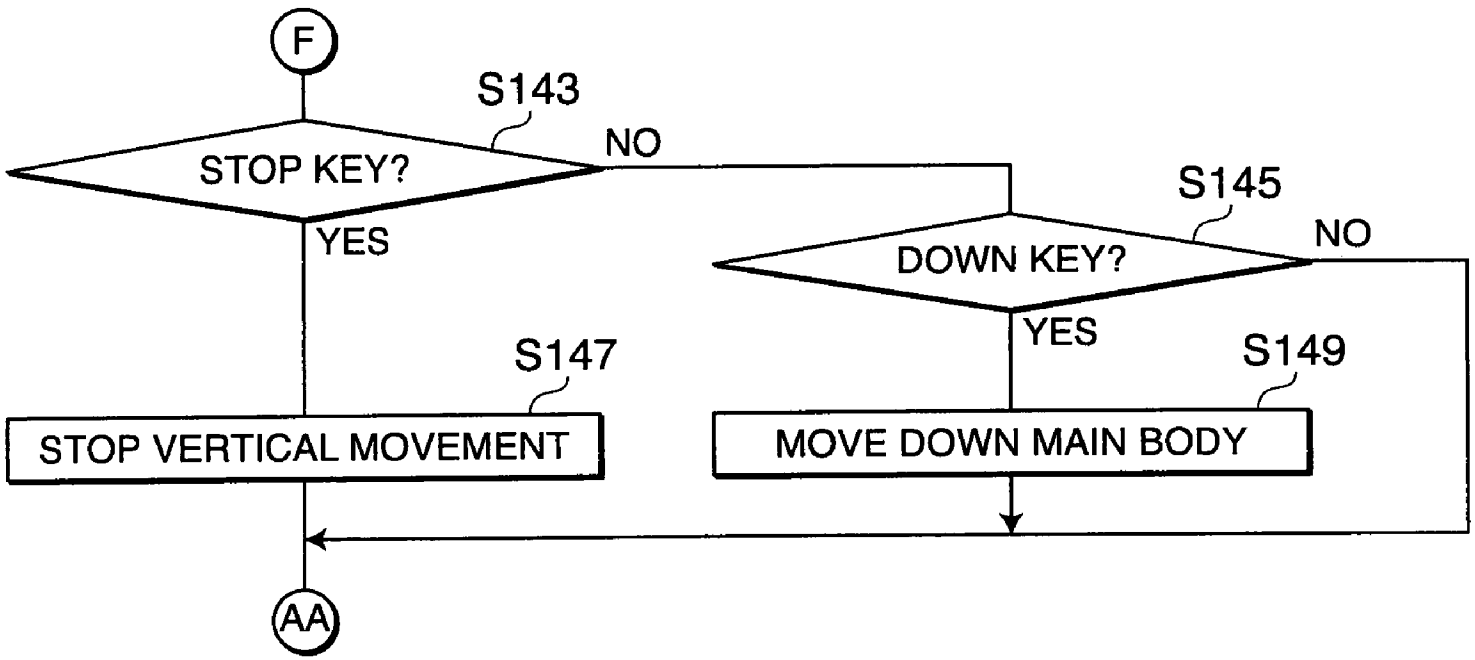

If any of the keys of the remote controller 75 is pressed during the standby period, the routine goes to Step S05 based on the judgment in Step S03. Then, the type of the pressed key is judged. Steps S05, S07 and S09 shown in FIG. 62, Steps S65, S67 and S69 shown in FIG. 64, Steps S131, S133, S135 shown in FIG. 66, and Steps S143 and S145 shown in FIG. 67 are performed in this order for the judgment.

Where the copy key 75*f*, the scanner key 75*g* or the fax key 75*h* is pressed (Step S05, S07 or S09), the routine goes to Step S11 to move the main body 1 to the second height level which permits easy setting of a document original (Step S11). After the document original is set, the microprocessor 81*a* vertically moves the main body 1 to the third height level which permits the user to easily operate the operation panel 67*b* (Step S15). After the user performs an identification operation (Step S17), the microprocessor 81*a* acquires user information of the identified user and, based on the acquired user information, vertically moves the main body 1 to the fourth height level which is suitable for the user (Step S21).

The microprocessor 81*a* awaits a job starting command (Step S23).

If the sheet replenishment key 75*i* is pressed (Step S65), the microprocessor 81*a* vertically moves the main body 1 to a sixth height level which permits the user to easily perform a sheet replenishment operation (Step S79). After the sheet replenishment operation is completed, the main body 1 is moved up to the first height level (Step S82), and kept in the standby state. Then, the routine returns to Step S03.

If the toner replenishment key 75*j* is pressed (Step S67), the microprocessor 81*a* vertically moves the main body 1 to a seventh height level which permits the user to easily perform a toner replenishment operation (Step S75). After the toner replenishment operation is completed, the main body 1 is moved up to the first height level (Step S82), and kept in the standby state. Then, the routine returns to Step S03.

If the ejected sheet take-out key 75*k* is pressed (Step S69), the microprocessor 81*a* vertically moves the main body 1 to an eight height level which permits the user to easily take out ejected sheets from the sheet ejection tray 63 (Step S71). After the sheets are taken out, the main body 1 is moved up to the first height level (Step S82), and kept in the standby state. Then, the routine returns to Step S03.

If the power key 75*a* is pressed (Step S131), the microprocessor 81*a* performs a power-off operation, and then the routine ends.

If the power saving mode key 75*b* is pressed (Step S133), the microprocessor 81*a* performs a power saving mode operation, and moves the main body 1 to the first height level (Step S139). Then, the routine returns to Step S03.

If the UP key 75*c* is pressed (Step S135), the microprocessor 81*a* moves up the main body 1 (Step S141), and then the routine returns to Step S03.

If the stop key 75*d* is pressed (Step S143), the microprocessor 81*a* stops the vertical movement of the main body 1 (Step S147). Then, the routine returns to Step S03.

If the DOWN key 75*e* is pressed (Step S145), the microprocessor 81*a* moves down the main body 1 (Step S149). Then, the routine returns to Step S03.

Though not shown, the main body control circuit 81 has a timer section for measuring time elapsed from the completion of a process. When a lapse of a predetermined period from the completion of the process is detected by the timer section, the microprocessor 81*a* moves the main body 1 to the uppermost height level of the vertical movement range to open up the floor. At this time, the microprocessor 81*a* shifts the main body 1 into the power saving mode after the main body 1 reaches the predetermined uppermost height level.

If the power saving mode key 75*b* is pressed in the power saving mode, the microprocessor 81*a* restores the main body 1 from the power saving mode in response to the reception of a restoration request. At this time, the main body 1 may be kept located at the uppermost height level of the vertical movement range, or may be moved down to a predetermined height level. Where the image forming apparatus is often used as a copier rather than as a printer, for example, the main body 1 may be moved down to a height level which permits the user to easily operate the main body 1, and kept in the standby state. In this case, the main body 1 is preferably restored from the power saving mode in a period during which the main body 1 is moved down from the uppermost height level of the vertical movement range to the predetermined height level.

If a print job request is received (Step S29) or a fax job request is received (Step S31) during the standby period, the routine goes to Step S39. The microprocessor 81*a* starts a printing process as requested with the main body 1 located at the first height level (Step S39).

During the printing process, the microprocessor 81*a* judges whether or not sheet jamming occurs (Step S41). Further, the microprocessor 81*a* judges whether or not sheet depletion occurs (Step S47). Then, the microprocessor 81*a* awaits completion of the printing process (Step S55).

If it is judged in Step S41 that a sheet jam occurs, the routine goes to Step S43. The microprocessor 81*a* vertically moves the main body 1 to a ninth height level which permits the user to easily remove a jammed sheet (Step S43). After the jammed sheet is removed (Step S45), the microprocessor 81*a* moves up the main body 1 to the first height level and restarts the printing process (Step S53). Thereafter, the routine goes to Step S103.

If it is judged in Step S47 that the sheet depletion occurs, the routine goes to Step S49. The microprocessor 81*a* vertically moves the main body 1 to the sixth height level which permits the user to easily perform a sheet replenishment operation (Step S43). After the sheet replenishment (Step S51), the microprocessor 81*a* moves up the main body 1 to the first height level and restarts the printing process (Step S53). Thereafter, the routine goes to Step S103.

Upon completion of the printing process, the microprocessor 81*a* vertically moves the main body 1 to the fifth height level which permits the user to easily take out the sheets from the sheet ejection tray 63 (Step S119). After the sheets are taken out (Step S121), the main body 1 is moved up to the first height level and kept in the standby state (Step S123). Then, the routine goes to Step S03.

Figure 65:
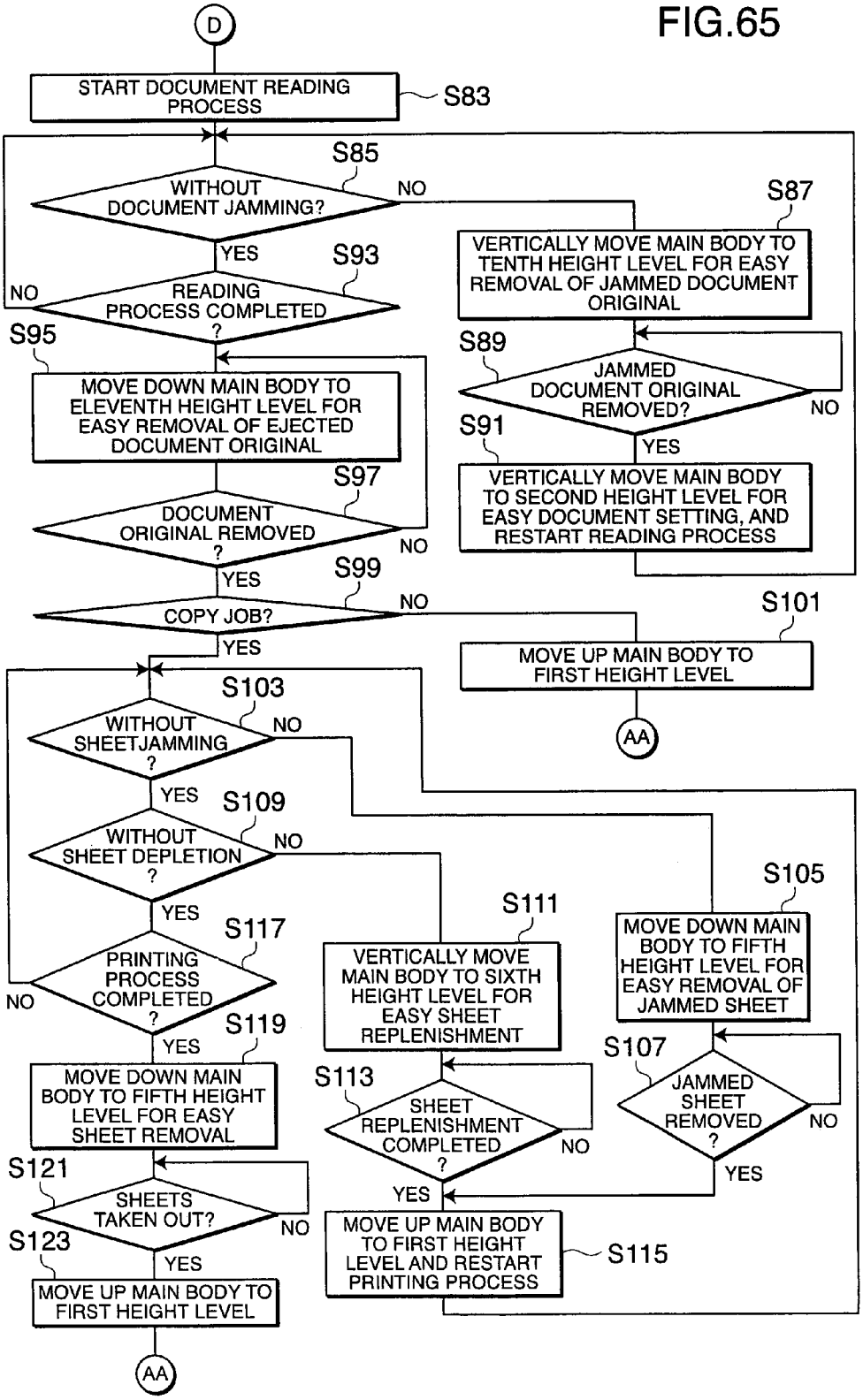
Figure 66:
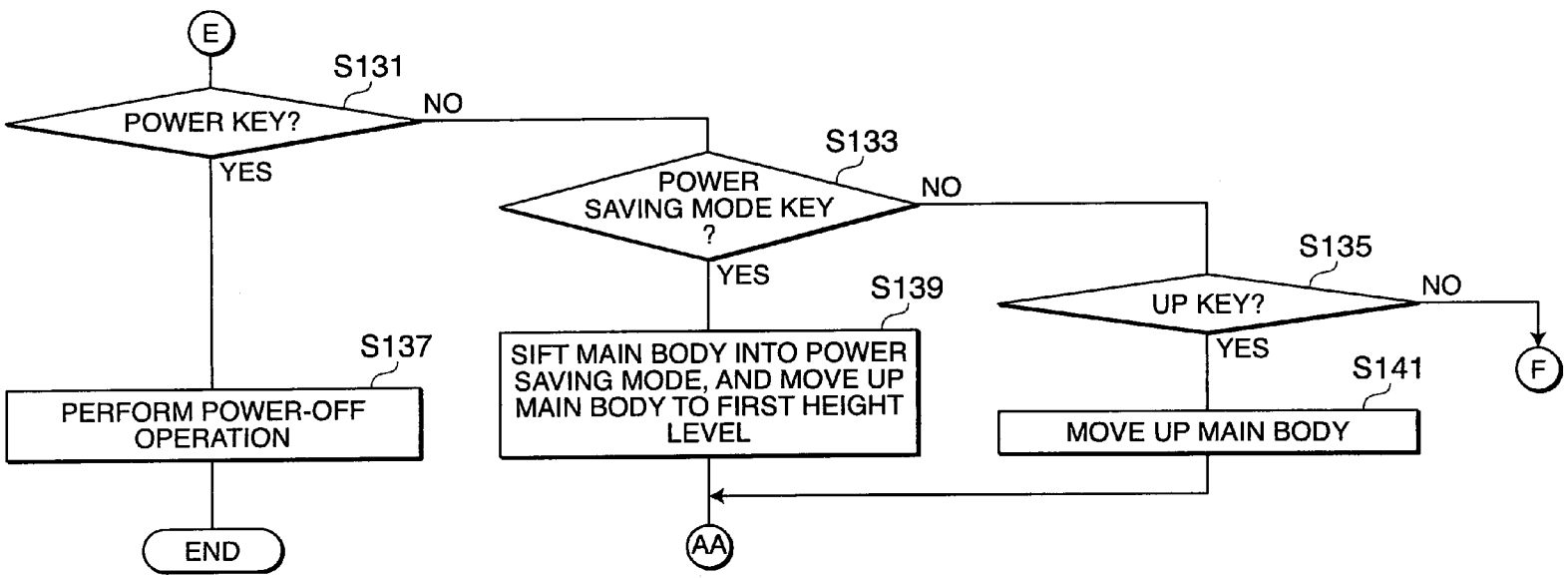

If the job starting command is received in Step S23, the routine goes to Step S83 shown in FIG. 65. The microprocessor 81*a* starts a document reading process (Step S83). Where the document original is read by using the document transport device 17, the microprocessor 81*a* judges whether or not document jamming occurs (Step S85). Then, the microprocessor 81*a* awaits completion of the document reading process (Step S93). However, where the document original is read on the document platen 19, the judgment on the document jamming is not made.

If a document jam occurs during the document reading process, the routine goes to Step S87. The microprocessor 81*a* vertically moves the main body 1 to a tenth height level which permits the user to easily remove a jammed document original (Step S87). After the jammed document original is removed (Step S89), the microprocessor 81*a* vertically moves the main body 1 to the second height level which permits the user to easily set the document original, and the document reading process is restarted (Step S91).

Where the document transport device 17 is used, the microprocessor 81*a* vertically moves the main body 1 to an eleventh height level which permits the user to easily take out the ejected document original from the document ejection tray 36 upon completion of the document reading process (Step S95). After the ejected document original is taken out (Step S97), the routine goes to Step S99. The microprocessor 81*a* judges whether the currently performed job is a copy job or any other job (a scanner job or a fax job).

Where the document platen is used, the routine goes to Step S99 upon completion of the reading process.

If it is judged in Step S99 that a job other than the copy job is performed, the microprocessor 81*a* moves up the main body 1 to the first height level (Step S101), and keeps the main body 1 in the standby state. Then, the routine goes to Step S03.

On the other hand, if the copy job is performed, the routine goes to Step S103, and then the microprocessor 81*a* awaits completion of the printing process. Steps S103 to S123 correspond to Steps S41 to S63 for the print job and the fax job. The microprocessor 81*a* awaits the completion of the printing process while checking for the sheet jamming and the sheet depletion. After the printing process is completed and the ejected sheets are taken out of the sheet ejection tray 63, the microprocessor 81*a* moves up the main body 1 to the first height level, and keeps the main body 1 in the standby state.

What is claimed is:

1. An image forming apparatus comprising:

a processing unit which performs an image recording process for recording an image on a recording medium based on image data;

a movement mechanism which moves the processing unit;

a first control section which controls the image recording process performed by the processing unit; and a second control section which acquires a state of progress of the image recording process and controls the movement mechanism so as to move the processing unit to a position according to the progress state, wherein the processing unit comprises a first processing unit which performs a part of an image recording process for recording an image on a recording medium based on image data; and a second processing unit which performs the rest of the process.

2. An image forming apparatus as set forth in claim 1, wherein the first processing unit is a unit which performs a process for reading the image data from a document original, the second processing unit being a unit which performs a process for recording the image on the recording medium based on the read image data.

3. An image forming apparatus as set forth in claim 1, wherein the first processing unit is a unit which performs a process for recording the image on the recording medium based on the image data, the second processing unit being a unit which processes the recording medium subjected to the process performed by the first processing unit.

4. An image forming apparatus as set forth in claim 1, wherein the first and second processing units are coupled to each other to perform the image recording process.

5. An image forming apparatus as set forth in claim 1, wherein the movement mechanism includes a mechanism which moves the first and second processing units independently.

6. An image forming apparatus as set forth in claim 1, wherein the second control section moves one of the first and second processing units to a predetermined position upon completion of the process performed by the first and second processing units.

7. An image forming apparatus as set forth in claim 1, wherein the second control section starts moving one of the first and second processing units to a predetermined position before completion of the process performed by the first and second processing units.

8. An image forming apparatus as set forth in claim 1, wherein if one of the first and second processing units is interrupted during the process, the second control section moves the interrupted processing unit to a predetermined position.

9. An image forming apparatus as set forth in claim 8, wherein when the process once interrupted is restarted by the one processing unit, the second control section moves the one processing unit from the predetermined position to another predetermined position.

10. An image forming apparatus comprising:

a processing unit which performs an image recording process for recording an image on a recording medium based on image data;

a movement mechanism which moves the processing unit;

a first control section which controls the image recording process performed by the processing unit; and a second control section which acquires a state of progress of the image recording process and controls the movement mechanism so as to move the processing unit to a position according to the progress state, wherein the processing unit comprises a first processing unit which performs a reading process for reading image data from a document original; and a second processing unit which performs an image recording process for recording an image on a recording medium based on the read image data, the movement mechanism comprising a lift mechanism which holds the second processing unit at a higher level than the first processing unit and moves up and down the first and second processing units, and the second control section acquiring a state of progress of the processes performed by the first and second processing units and controlling the lift mechanism so as to move the first and second processing units to height levels according to the progress state.

11. An image forming apparatus as set forth in claim 10, wherein the second control section locates the second processing unit at a first position in standby during the reading process performed by the first processing unit.

12. An image forming apparatus as set forth in claim 11, wherein the second control section moves the second processing unit to a second position which is lower than the first position upon completion of the image recording process performed by the second processing unit.

13. An image forming apparatus as set forth in claim 11, wherein the second control section starts moving the second processing unit to a second position which is lower than the first position before completion of the image recording process performed by the second processing unit.

14. An image forming apparatus as set forth in claim 11, wherein when the second processing unit becomes unable to continue the image recording process or the image recording process is interrupted, the second control section moves the second processing unit to a second position which is lower than the first position.

15. An image forming apparatus as set forth in claim 11, wherein when the second processing unit is in standby or performs the image recording process, the second control section locates the second processing unit at the first position.

16. An image forming apparatus as set forth in claim 14, wherein when the image recording process once interrupted is restarted by the second processing unit, the second control section moves the second processing unit to the first position.

17. An image forming apparatus as set forth in claim 10, further comprising a manual operation section which causes the second control section to vertically move the second processing unit.

18. An image forming apparatus as set forth in claim 10, further comprising an informing section which gives information on a vertical movement state of the second processing unit.

19. An image forming apparatus comprising:

a processing unit which performs an image recording process for recording an image on a recording medium based on image data;

a movement mechanism which moves the processing unit;

a first control section which controls the image recording process performed by the processing unit; and a second control section which acquires a state of progress of the image recording process and controls the movement mechanism so as to move the processing unit to a position according to the progress state, wherein the processing unit comprises a first processing unit which performs the image recording process for recording the image on the recording medium based on the image data and a second processing unit which performs another image recording process.

20. The image forming apparatus according to claim 19, wherein the movement mechanism moves the first and second processing units independently.

* * * * *